US010438532B2

(12) United States Patent
Yanase et al.

(10) Patent No.: US 10,438,532 B2
(45) Date of Patent: Oct. 8, 2019

(54) DISPLAY APPARATUS AND METHOD OF MANUFACTURING DISPLAY APPARATUS WITH BRANCH SOURCE WIRINGS

(71) Applicant: NLT TECHNOLOGIES, LTD., Kawasaki, Kanagawa (JP)

(72) Inventors: Jiro Yanase, Kawasaki (JP); Yojiro Matsueda, Kawasaki (JP); Yoshihiro Nonaka, Kawasaki (JP)

(73) Assignee: Tianma Japan, LTD., Kawasaki, Kanagawa (JP)

( * ) Notice: Subject to any disclaimer, the term of this patent is extended or adjusted under 35 U.S.C. 154(b) by 0 days.

(21) Appl. No.: 15/389,673

(22) Filed: Dec. 23, 2016

(65) Prior Publication Data

US 2017/0186372 A1 Jun. 29, 2017

(30) Foreign Application Priority Data

Dec. 25, 2015 (JP) ..... 2015-254777
Sep. 2, 2016 (JP) ..... 2016-172060

(51) Int. Cl.
*G09G 3/32* (2016.01)
*G09G 3/3233* (2016.01)

(52) U.S. Cl.
CPC ... *G09G 3/3233* (2013.01); *G09G 2300/0842* (2013.01); *G09G 2310/08* (2013.01); *G09G 2320/0233* (2013.01)

(58) Field of Classification Search
CPC ..... G09G 3/3233; G09G 2300/0842; G09G 2310/08; G09G 2320/0233
See application file for complete search history.

(56) References Cited

U.S. PATENT DOCUMENTS

2003/0218586 A1* 11/2003 Wu ..... G09G 3/3648 345/87
2007/0002226 A1 1/2007 Sakamoto et al.
2007/0085782 A1 4/2007 Matsumoto et al.
2009/0179572 A1 7/2009 Fukumoto et al.
2011/0001690 A1 1/2011 Mori et al.
2012/0086687 A1 4/2012 Tsubata
2012/0147060 A1 6/2012 Jeong
2015/0138171 A1* 5/2015 Kim ..... H01L 27/3223 345/205

(Continued)

FOREIGN PATENT DOCUMENTS

JP 2007-41572 A 2/2007
JP 2007-114425 A 5/2007

(Continued)

*Primary Examiner* — Stephen G Sherman
(74) *Attorney, Agent, or Firm* — Sughrue Mion, PLLC

(57) ABSTRACT

An object is to provide a display device of an organic light emitting type suppressing luminance unevenness. The display device includes: a pixel including an organic light emitting element and a pixel circuit that controls a current supplied to the organic light emitting element; a first wiring 41 and a second wiring 42 supplying a first signal used for controlling the pixel circuit to the pixel circuit; and a third wiring 43 suppling a second signal used for controlling the pixel circuit to the pixel circuit. The first wiring 41 to the third wiring 43 are arranged inside an area in which the pixel circuit is arranged in a first direction, and the third wiring 43 is arranged between the first wiring 41 and the second wiring 42.

13 Claims, 41 Drawing Sheets

(56) References Cited

U.S. PATENT DOCUMENTS

| | | | | |
|---|---|---|---|---|
| 2015/0187270 | A1* | 7/2015 | Lee | G09G 3/3233 345/76 |
| 2015/0255523 | A1* | 9/2015 | Her | H01L 27/3262 345/76 |
| 2015/0379956 | A1 | 12/2015 | Nonaka et al. | |
| 2016/0210892 | A1* | 7/2016 | Ohara | G09G 3/3258 |

FOREIGN PATENT DOCUMENTS

| | | | |
|---|---|---|---|
| JP | 2011-013444 | A | 1/2011 |
| JP | 2012-128386 | A | 7/2012 |
| JP | 2013-200580 | A | 10/2013 |
| JP | 2014-133382 | A | 7/2014 |
| WO | 2010/146747 | A1 | 12/2010 |

* cited by examiner

VDD=13V, VSS=3V, Vref=Vrst=2.75V
Vdata=0.5V~2.5V, t1=1us, t2=9us

DISPLAY APPARATUS AND METHOD OF MANUFACTURING DISPLAY APPARATUS WITH BRANCH SOURCE WIRINGS

FIELD

This non-provisional application claims priorities under 35 U.S.C. § 119(a) on Patent Application No. 2015-254777 filed in Japan on Dec. 25, 2015 and Patent Application No. 2016-172060 filed in Japan on Sep. 2, 2016, the entire contents of which are hereby incorporated by reference.

The present disclosure relates to a display device and a method of manufacturing a display device.

BACKGROUND

Display devices displaying images with organic light emitting diodes (OLED) are proposed (see Japanese Patent Application Laid-Open No. 2007-114425 and 2013-200580). Here, a display device of the OLED will be abbreviated to a display device.

The display device includes a display area in which a plurality of pixels is arrayed in a matrix pattern. In the case of a color display device, for example, one pixel includes a total of three subpixels, specifically the pixel includes one red subpixel, one blue subpixel, and one green subpixel.

Each subpixel includes a pixel circuit that controls a current supplied to an organic light emitting element. The organic light emitting element emits light with luminance that is based on a current supplied by the pixel circuit. During the display area displays one screen, the organic light emitting element continues to emit light.

The pixel circuit, in order to cause the organic light emitting element to emit light with luminance corresponding to an image signal, supplies a current corresponding to the image signal to the organic light emitting element.

There are cases in which a current corresponding to the image signal and a drive current actually supplied to the organic light emitting element do not match each other. This mismatch may cause unevenness of the luminance of organic light emitting elements on a display panel (so-called luminance unevenness). When the luminance unevenness occurs, the image quality is decreased.

SUMMARY

According to one aspect of the present disclosure, there is provided a display device including: a pixel including an organic light emitting element and a pixel circuit that controls a current supplied to the organic light emitting element; a first wiring and a second wiring that supply a first signal used for controlling the pixel circuit to the pixel circuit; and a third wiring that supplies a second signal used for controlling the pixel circuit to the pixel circuit. The first wiring to the third wiring are arranged inside an area in which the pixel circuit is arranged in a first direction, and the third wiring is arranged between the first wiring and the second wiring.

It is to be understood that both the foregoing general description and the following detailed description are exemplary and explanatory and are not restrictive of this disclosure.

DETAILED DESCRIPTION OF THE PREFERRED EMBODIMENTS

Hereinafter, display devices according to embodiments will be described with reference to the drawings as is appropriate. In description and claims presented here, ordinal numbers such as "a first" and "a second" are assigned for clarifying a relation among elements and preventing confusion among the elements. Thus, such ordinal numbers are not for the purpose of limiting the elements in a numerical manner.

Furthermore, the dimensions and the ratios of the illustrated components may not be illustrated so as to coincide with those of the actual components. Also, for the convenience of illustrations and descriptions of the drawings, some components actually included may be omitted, or the dimensions of the illustrated components may be presented more exaggeratedly than those of the actual components.

A term called "connection" means that connection targets are electrically connected. The "electrically connected" includes a case where connection targets are connected through an electrical element such as an electrode, a wiring, resistor, or a capacitor as well.

Here, the term "electrode" or "wiring" does not functionally limit such a constituent element. For example, the "wiring" may be used as a part of the "electrode". To the contrary, the "electrode" may be used as a part of the "wiring".

[Embodiment 1]

Figure 1:
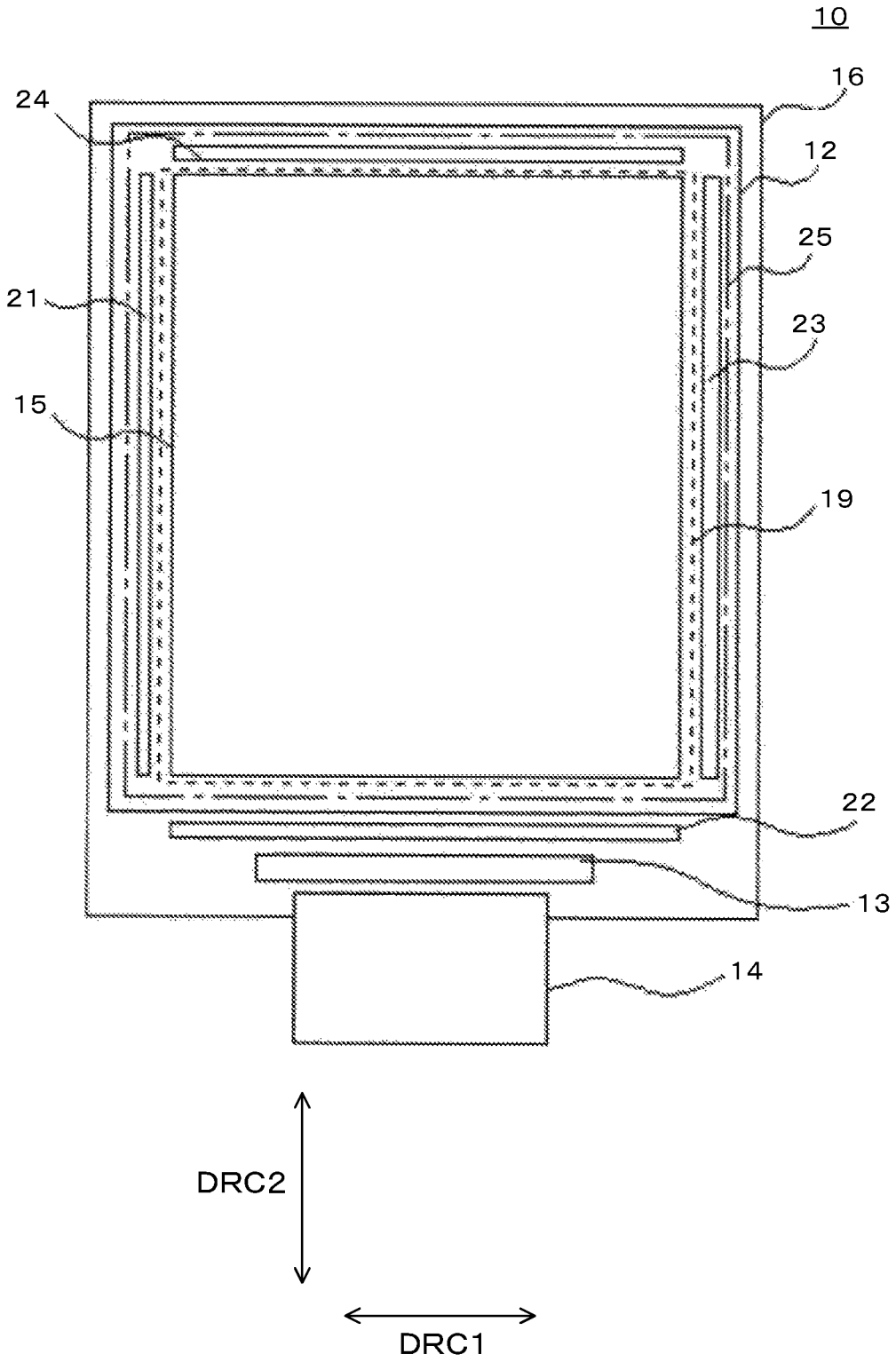
FIG. 1 is an external view of a display device.
Figure 2:
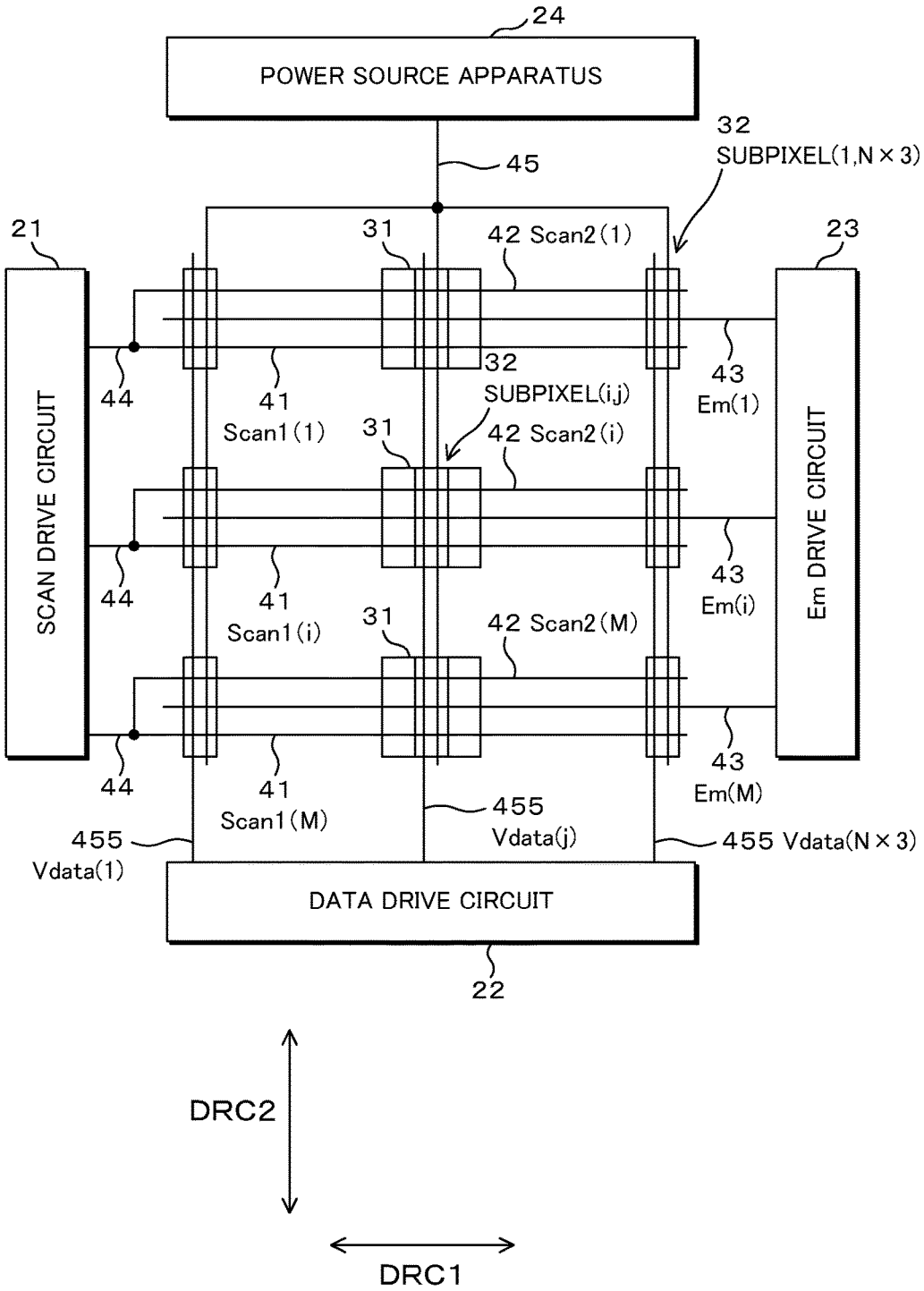
FIG. 2 is a diagram that schematically illustrates a plurality of pixels and a drive circuit driving the plurality of pixels.
Figure 3:
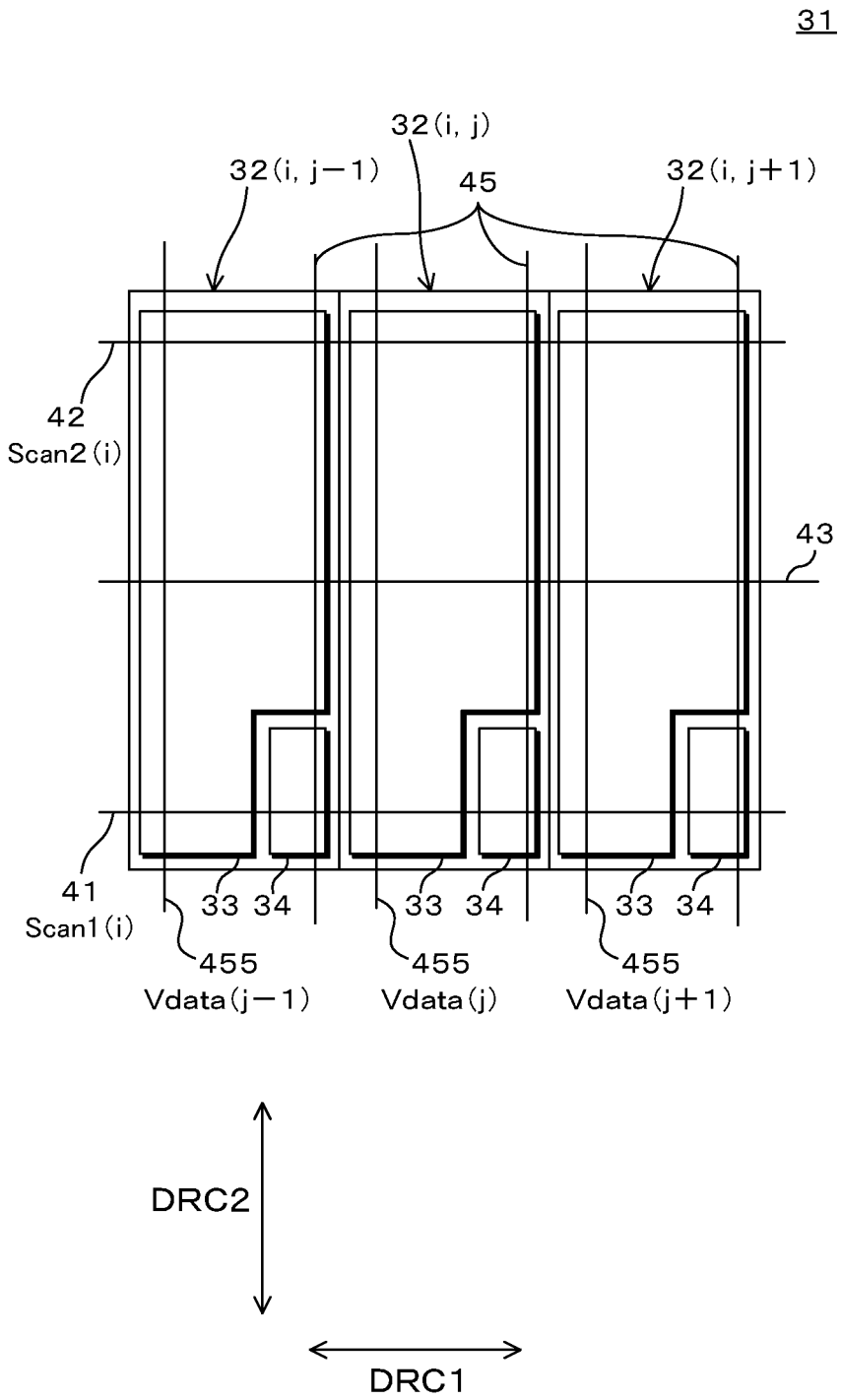
FIG. 3 is a diagram that schematically illustrates a pixel.

FIG. 1 is an external view of a display device 10. FIG. 2 is a diagram that schematically illustrates a plurality of pixels 31 and a drive circuit 20 (refer to FIG. 21) driving the plurality of pixels 31. FIG. 3 is a diagram that schematically illustrates a pixel 31. An overview of Embodiment 1 will be described with reference to FIG. 1 to FIG. 3.

FIG. 1 is a diagram of the display device 10 viewed from the front side, in other words, from the side of a face at which an image is displayed. The display device 10 is an apparatus that displays a still image and a moving image. The display device 10 is used with being built in an electronic apparatus. The electronic apparatus, for example, is a smartphone, a tablet terminal, a personal computer, a television set, or the like. The display device 10 according to this embodiment is a display panel of an OLED. In description presented hereinafter, the upper side, the lower side, the left side, and the right side of each drawing will be used.

The display device 10 includes: a TFT substrate 16; a second substrate 12; a driver IC 13; a power source apparatus 24; and a flexible printed circuit (FPC) 14. The TFT substrate 16 includes a display area 15, a cathode electrode 19, a drive circuit 20, and a wiring not illustrated in the drawing at one face. The TFT substrate 16, for example, is a substrate made of glass.

The second substrate 12 is a substrate that covers the display area 15 and the drive circuit 20 through a space. The second substrate 12, for example, is a substrate made of glass. The TFT substrate 16 and the second substrate 12 may be flexible substrates using organic films or the like as substrates. A space between the TFT substrate 16 and the second substrate 12 is sealed to be airtight by a sealing member 25. The sealing member 25 encloses the display area 15 and the drive circuit 20.

The driver IC 13 is an integrated circuit that is mounted at the TFT substrate 16 by using an anisotropic conduction film. The function of the driver IC 13 will be described later.

The FPC 14 is a substrate having flexibility that is connected to the TFT substrate 16. Wirings, which are not illustrated, included in the TFT substrate 16 connects the FPC 14, the driver IC 13, and the drive circuit 20. The display device 10 acquires an image signal from a control device of an electronic apparatus through the FPC 14.

The display area 15 includes a plurality of pixels 31 (refer to FIG. 2) that is arrayed in a matrix pattern. The display area 15 is covered with a cathode electrode 19. Each pixel 31 includes subpixels 32 (refer to FIG. 2). The structures of the pixel 31 and the subpixels 32 will be described later.

A structure in which the organic light emitting element 34 emits light in a direction toward the front faces of the TFT substrate 16 and the second substrate 12 is called a top emission structure. On the other hand, a structure in which the organic light emitting element 34 emits light in a direction toward the rear faces of the TFT substrate 16 and the second substrate 12 is called a bottom emission structure. In the top emission structure, a pixel circuit 33 can be formed by using the whole area of the subpixel 32.

Each subpixel 32 includes an organic light emitting element 34 (refer to FIG. 3) and a pixel circuit 33 (refer to FIG. 3) that controls a current supplied to the organic light emitting element 34. The organic light emitting element 34 emits light based on a current supplied by the pixel circuit 33. The pixel circuit 33 will be described later.

The cathode electrode 19 is a common electrode connected to the subpixels 32. The cathode electrode 19, for example, is an electrode made of a transparent or semi-transparent material such as indium tin oxide (ITO), transparent conductive ink, or graphene. The cathode electrode 19 is a cathode electrode of the organic light emitting element 34 according to this embodiment.

The drive circuit 20 includes: a scan (scan line) drive circuit 21; a data drive circuit 22; and an emission (hereinafter, referred to Em) drive circuit 23. The drive circuit 20 is formed by a thin film semiconductor (TFT) process. Hereinafter, an overview of the drive circuit 20 will be described.

The scan drive circuit 21 is positioned at the outer side of the display area 15 along the left side of the display area 15. The scan drive circuit 21 sequentially drives a plurality of pixels 31 arrayed in each row in units of rows, thereby controlling light emission. In other words, the scan drive circuit 21 drives wirings extending from the scan drive circuit 21 in the horizontal direction, thereby controlling the light emission of the pixels 31. Hereinafter, the wirings will be appropriately referred to as scan lines. The scan drive circuit 21 is a circuit that selects and drives a scan line of the display area 15 based on an image signal acquired through the FPC 14. The scan line is disposed along a plurality of pixels 31 arrayed in a first direction denoted by a horizontal arrow DRC1 in FIG. 1. In other words, the scan line expands along a plurality of subpixels 32 arrayed in the first direction. The luminance values of pixels 31 aligned in one scan line are simultaneously changed. In other words, the luminance values of subpixels 32 aligned in one scan line are simultaneously changed.

A vertical arrow DRC2 illustrated in FIG. 1 represents a second direction. The scan drive circuit 21 performs switching of scan lines to be driven in the second direction. An order in which the scan drive circuit 21 switches the scan lines may be one of an order from the upper side of the display area 15 toward the lower side and an order from the lower side toward the upper side. In addition, the scan drive circuit 21 may perform switching of the scan lines in an arbitrary order. In description presented below, the first direction may be described as a scan line direction, and the second direction may be described as a scan direction.

As described above, the first direction and the second direction are orthogonal to each other. By using such a display area 15, the display device 10 displaying an image at the display area 15 by using an image signal that is generally used can be provided.

The data drive circuit 22 is positioned on the outer side of the display area 15 along the lower side of the display area 15. The data drive circuit 22 simultaneously outputs signals representing the luminance values of subpixels 32 to the subpixels 32 of one row.

The Em drive circuit 23 is positioned on the outer side of the display area 15 along the right side of the display area 15. The Em drive circuit 23, similar to the scan drive circuit 21, is a circuit that sequentially changes an output signal for each row. Mainly, the signal output is in an On (connected) state during an emission period of the switching transistor.

The power source apparatus 24 is positioned on the outer side of the TFT substrate 16. The power source apparatus 24 is an apparatus that supplies a voltage to each power source line disposed on the TFT substrate 16 through the FPC 14.

Details of the operations of the scan drive circuit 21, the data drive circuit 22, the EM drive circuit 23, and the power source apparatus 24 will be described later.

FIG. 2 is a diagram that schematically illustrates a plurality of pixels 31 and a drive circuit 20 driving the plurality of pixels 31. In FIG. 2, the horizontal direction is the first direction described above, in other words, a direction (scan line direction) in which the scan line expands. In FIG. 2, the vertical direction is the second direction described above, in other words, a sequential scan direction (scan direction).

Inside the display area 15 (refer to FIG. 1), subpixels 32 are aligned in a matrix pattern of M rows and N×3 columns. Here, M and N are integers of two or more. As will be described later, three subpixels 32 configure one pixel 31. Accordingly, inside the display area 15, pixels 31 of M rows and N columns are aligned.

FIG. 3 is a diagram that schematically illustrates the pixel 31. In FIG. 3, the horizontal direction is the first direction described above, in other words, the scan line direction. In FIG. 3, the vertical direction is the second direction described above, in other words, the scan direction.

The pixel 31 includes three subpixels 32. Each subpixel 32 includes a pixel circuit 33 and an organic light emitting element 34. One subpixel 32 is one of three parts into which the pixel 31 is divided by using vertical lines. In description presented below, a subpixel 32 that is an i-th subpixel from the upper side and is a j-th subpixel 32 from the left side will be denoted as a subpixel 32($i, j$). In a case where the position does not need to be specified, a subpixel will be denoted as a subpixel 32. As illustrated in FIG. 3, one pixel 31 includes three subpixels including a subpixel 32($i, j-1$), a subpixel 32($i, j$), and a subpixel 32($i, j+1$).

In FIG. 3, the subpixels 32 are represented using rectangles. The display device 10 does not include a sensible member representing a boundary between the subpixels 32. One subpixel 32 according to this embodiment represents one rectangular area of a case where the display area 15 is delimited into a matrix pattern corresponding to the number of subpixels 32. The subpixels 32 adjacent to each other are arrayed without any gap.

Description will be continued with reference to FIG. 2 and FIG. 3. The pixels 31 are connected to a first wiring 41, a second wiring 42, and a third wiring 43 traversing the arrangement area of the pixels 31 in the horizontal direction. All the three subpixels 32 included in one pixel 31 are connected to three wirings including the first wiring 41, the second wiring 42, and the third wiring 43. In other words, the three subpixels 32 included in one pixel 31 share three wirings including the first wiring 41, the second wiring 42, and the third wiring 43.

The first wiring 41 to the third wiring 43 are also called a first signal wiring 41 to a third signal wiring 43. In addition, the first wiring 41, the second wiring 42, and the third wiring 43 are respectively also called a first scan signal line 41, a second scan signal line 42, and an emission control line 43.

FIG. 2 illustrates a case where the first wiring 41 is arranged at the lower side, and the second wiring 42 is arranged at the upper side. It may be configured such that the first wiring 41 is arranged at the upper side, and the second wiring 42 is arranged at the lower side.

In the subsequent drawings, the first wiring 41, the second wiring 42, and the third wiring 43 will be respectively denoted as Scan1, Scan2, and Em. In addition, the first wiring 41 positioned i-th from the upper side will be denoted as Scan1(i), the second wiring 42 positioned i-th from the upper side will be denoted as Scan2(i), and the third wiring 43 positioned i-th from the upper side will be denoted as EM(i).

The pixel 31 is connected to a power source line 45 that traverses the pixel 31 in the vertical direction. The power source line 45 includes a data power source line 455. All the three subpixels 32 included in the pixel 31 are connected to the power source line 45. In other words, all the three subpixels 32 included in the pixel 31 are also connected to the data power source line 455.

In the subsequent drawings, the data power source line 455 will be denoted as Vdata. A data power source line 455 positioned j-th from the left will be denoted as Vdata(j).

The scan drive circuit 21 is positioned at the left side of the subpixels 32 aligned in a matrix pattern, in other words, the display area 15. The data drive circuit 22 is positioned at the lower side of the subpixels 32 aligned in the matrix pattern. The Em drive circuit 23 is positioned at the left side of the subpixels 32 aligned in the matrix pattern.

Toward the right side from the scan drive circuit 21, M branch source wirings 44 extend to the right side. The scan drive circuit 21 supplies (also called outputs) a first signal used for controlling the pixel circuit 33 to the branch source wirings 44. Each branch source wiring 44 branches into a first wiring 41 and a second wiring 42 between the scan drive circuit 21 and a first subpixel 32. In other words, the number of first wirings 41 is M, and the number of second wirings 42 is M. The first wiring 41 and the second wiring 42 supply the first signal used for controlling the pixel circuit 33 to the subpixels 32.

Toward the left side from the EM drive circuit 23, M third wirings 43 extend. The Em drive circuit 23 supplies a second signal used for controlling the pixel circuit 33 to the third wirings 43. Each third wiring 43 supplies the second signal to the subpixels 32. The third wiring 43 does not intersect with the first wiring 41, the second wiring 42, and the branch source wiring 44. The third wiring 43 positioned i-th is located between the first wiring 41 positioned i-th and the second wiring 42 positioned i-th.

Accordingly, the first wiring 41 supplies the first signal used for controlling the pixel circuit 33 to the pixel 31. The second wiring 42 supplies the first signal used for controlling the pixel circuit 33 to the pixel 31. The third wiring 43 supplies the second signal used for controlling the pixel circuit 33 to the pixel 31.

As described above, the plurality of pixels 31, each of which includes the organic light emitting element 34 and the pixel circuit 33 that controls a current supplied to the organic light emitting element 34. The display device 10 includes the first wirings 41 and the second wirings 42 supplying the first signal to control the pixel circuit 33 to the pixel circuit 33. The display device 10 includes the third wirings 43 supplying the second signal to control the pixel circuit 33 to the pixel circuit 33. The first wirings 41, the second wirings 42, and the third wirings 43 extending along the first direction (DRC1). The third wiring 43 is disposed between the first wiring 41 and the second wiring 42.

The first signal is so-called a scan signal. The first signal is a signal (also called a scan signal) used for controlling a process of storing (also called maintaining or writing) a voltage (electric charge) corresponding to an image (in other words, a pixel value or emission luminance) in a holding capacitor 47 (refer to FIG. 4) disposed within the pixel circuit 33. In addition, the first signal is a signal used for controlling a process of detecting a threshold of a drive transistor 56 (refer to FIG. 4) controlling a current supplied to the organic light emitting element 34 by controlling the pixel circuit 33 and the like. The process of detecting the threshold of the drive transistor 56 is also called a process of compensating the threshold (threshold compensation).

The second signal, for example, is a signal (also referred to as an Em signal) used for controlling emission or no-emission of the organic light emitting element 34 by controlling the pixel circuit 33.

As will be described in detail with reference to FIG. 4, FIG. 14, and FIG. 15, by arranging the first wirings 41 to the third wirings 43 as illustrated in FIG. 2 and FIG. 3, the lead-around of the first wirings 41 to the third wirings 43 within the subpixels 32 is suppressed from being complicated. According to such suppression, some of connection wirings (also called wiring nodes) connecting transistors in the pixel circuit 33 can be shortened. In addition, some of the connection wirings and at least one of the first wiring 41 to the third wiring 43 can be suppressed from intersecting with each other. Some of the connection wirings described above are parts sensitive to the characteristics of the pixel circuit 33, for example, parts influencing the emission luminance of the organic light emitting element 34.

Here, in a case where signal wirings (for example, the first wiring 41 to the third wiring 43) and a connection wiring intersect with each other, parasitic capacitance is generated at the intersection thereof. There are cases where the amount of actual electric charge maintained in the holding capacitor 47 of the pixel circuit 33 and the original amount of electric charge corresponding to the emission luminance of the organic light emitting element 34 become different from each other due to the parasitic capacitance. As a result, a drive current of the organic light emitting element 34 changes, and there are cases where the organic light emitting element 34 emits light with luminance different from target emission luminance.

However, as described above, since the lead-around of the first wiring 41 to the third wiring 43 can be suppressed from being complicated, the generation of parasitic capacitance is suppressed, and a change in the current value of the drive current can be suppressed. As a result, luminance unevenness can be suppressed, and degradation of the image quality can be suppressed.

As described above, the first wiring 41 and the second wiring 42 supply the first signal to the pixel circuit 33 of each of a plurality of pixels 31 arrayed in the first row among the M rows. The third wiring 43 supplies the second signal to the pixel circuit 33 of each of the plurality of pixels 31 is arrayed in the first row among the M rows.

By supplying signals to the pixels 31 disposed in the display area 15 in this way, the display device 10 displaying an image in the display area 15 by using an image signal that is generally used can be provided.

The display device 10 includes the drive circuit 20 that is arranged on the outer side of the display area 15 in which a plurality of pixels 31 is arrayed and drives the pixel circuit 33 of each of a plurality of pixels 31 based on the first signal and the second signal. The scan drive circuit 21 supplies the same first signal to the first wirings 41 and the second wirings 42. The scan drive circuit 21 supplies the second signal to the third wirings 43.

By using the drive circuit 20, the display device 10 having reduced luminance unevenness can be provided without using the driver IC 13, the drive circuit 20, and the like that are dedicatedly used.

The scan drive circuit 21 is connected to the branch source wiring 44 that branches into the first wiring 41 and the second wiring 42. The scan drive circuit 21 supplies the first signal to the branch source wiring 44. In an area disposed between the display area 15 and the arrangement area of the scan drive circuit 21, the branch source wiring 44 branches into the first wiring 41 and the second wiring 42.

By using such branching, the high-image quality display device 10 having reduced luminance unevenness can be provided without broadening the frame area of the periphery of the display area 15.

The display device 10 includes M branch source wirings 44 and M third wirings 43. The first wiring 41 and the second wiring 42 of an i-th (here, i is an integer of 1 to M) branch source wiring 44 supply the first signal to the pixel circuits 33 of a plurality of pixels 31 arrayed in the i-th row. The third wiring 43 positioned i-th supplies the second signal to the pixel circuits 33 of the plurality of pixels 31 arrayed in the i-th row.

By using such wirings, the display device 10 displaying an image in the display area 15 by using image signals that are generally used can be provided.

From the data drive circuit 22 toward the subpixel 32, N×3 data power source lines 455 extend. The data drive circuit 22 simultaneously outputs signals representing the luminance values of subpixels 32 to the subpixels 32 of one row.

The power source apparatus 24 supplies power to the TFT substrate 16. One power source line 45 extends to the subpixels 32. The power source line 45 branches into N×3 lines between the power source apparatus and the first subpixel 32. The power source line 45, for example, includes a high-power source line 451, a low-power source line 452, a reset power source line 453, and a reference power source line 454 (refer to FIG. 4) to be described later. The power source line 45 branching into N×3 lines includes the same kind and the same number of power source lines 45 as those of the branch source.

N×3 subpixels 32 aligned in one row in the horizontal direction share the first wiring 41, the second wiring 42, and the third wiring 43. In other words, for example, N×3 subpixels 32 of the i-th row is connected to all the first wiring 41 positioned i-th, the second wiring 42 positioned i-th, and the third wiring 43 positioned i-th. Here, i is an integer of one or more and M or less.

M subpixels 32 aligned in one column in the vertical direction share the power source line 45 including the data line 455. In other words, for example, M subpixels 32 positioned j-th are connected to one of power source lines 45 branching between the power source apparatus and the first subpixel 32. In other words, M subpixels 32 positioned j-th are connected to all the power source lines 45 included in the branching power source line 45. In addition, the M subpixels 32 positioned j-th is connected to the j-th data line 455.

Figure 4:
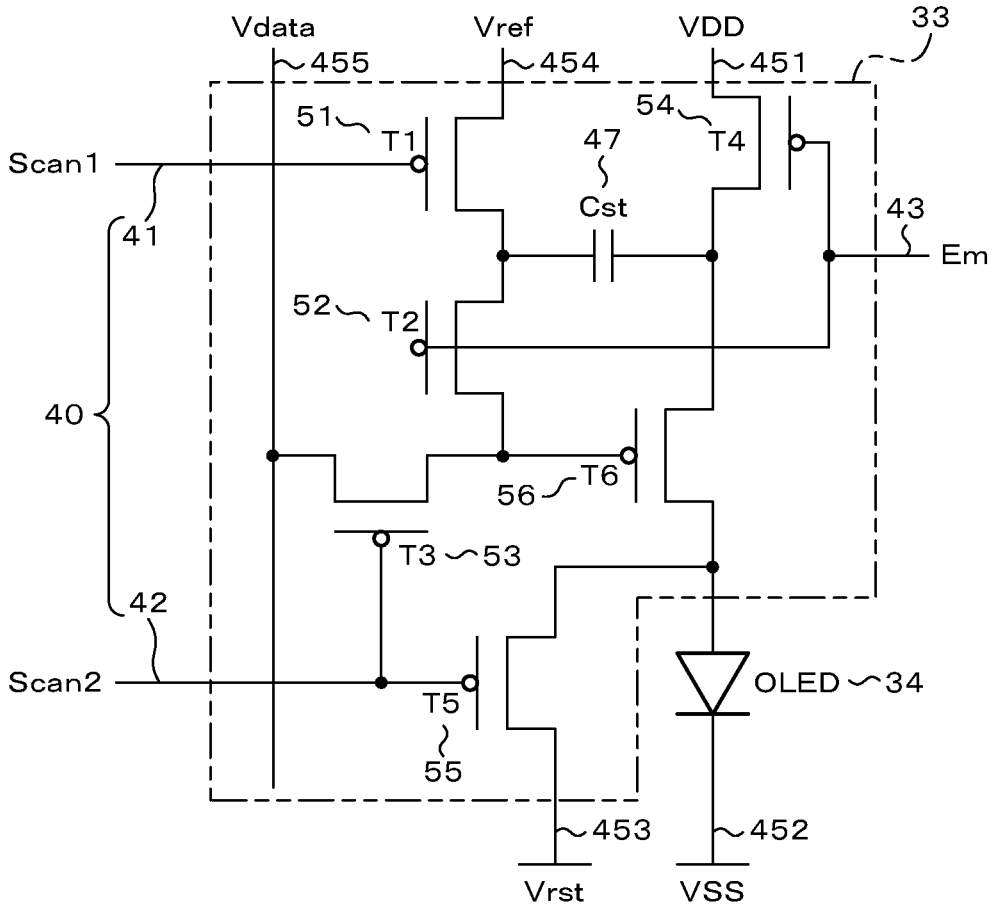
FIG. 4 is an equivalent circuit diagram of a pixel circuit.

FIG. 4 is an equivalent circuit diagram of the pixel circuit 33. The pixel circuit 33 is connected to the organic light emitting element 34. The pixel circuit 33 includes a first transistor 51, a second transistor 52, and a third transistor 53. In addition, the pixel circuit 33 includes a fourth transistor 54, a fifth transistor 55, a drive transistor 56, and a holding capacitor 47. The holding capacitor 47 has a function for maintaining the luminance of the organic light emitting element 34 to be constant during a time in which the display area 15 displays one screen.

FIG. 4 illustrates the pixel circuit 33 and the organic light emitting element 34 included in one subpixel 32. Constituent elements of the pixel circuit 33 included in one subpixel 32 are positioned inside the rectangular area of one subpixel 32 described with reference to FIG. 2.

In the subsequent drawings, the first transistor 51, the second transistor 52, the third transistor 53, the fourth transistor 54, the fifth transistor 55, the drive transistor 56, and the holding capacitor 47 will be respectively illustrated using symbols T1, T2, T3, T4, T5, T6, and Cst.

The first wiring 41, the second wiring 42, the third wiring 43, the high-power source line 451, the reset power source line 453, the reference power source line 454, the data line 455, and an anode electrode 18 (refer to FIG. 6) of the organic light emitting element 34 are connected to the pixel circuit 33. The low-power source line 452 is connected to a cathode electrode of the organic light emitting element 34.

The high-power source line 451 supplies a high-power source voltage VDD. The low-power source line 452 supplies a low-power source voltage VSS. The reset power source line 453 supplies a reset voltage Vrst. The reference power source line 454 supplies a reference voltage Vref. The data line 455, as described above, supplies a signal (also referred to as a data signal) representing the luminance of the subpixel 32 described above.

In this embodiment, the electric potentials of the low-power source line 452, the reset power source line 453 and the reference power source line 454 are set to be lower than the electric potential of the high-power source line 451. For example, the reset power source line 453 and the reference power source line 454 are configured to be common.

The first transistor 51 is connected to the reference power source line 454, the second transistor 52, and a first terminal of the holding capacitor 47. The second transistor 52 is connected to the first terminal of the holding capacitor 47, a gate electrode (hereinafter, abbreviated to a gate) of the drive transistor 56, and the third transistor 53. The third transistor 53 is connected to the data line 455, the gate of the drive transistor 56, and the second transistor 52.

The fourth transistor 54 is connected to the high-power source line 451, a second terminal of the holding capacitor 47, and a source electrode (hereinafter, abbreviated to as a source) of the drive transistor 56.

A drain electrode (hereinafter, abbreviated to a drain) of the drive transistor 56 is connected to an anode electrode of the organic light emitting element 34 and the fifth transistor 55. The fifth transistor 55 is connected to the reset power source line 453 and the drain of the drive transistor 56.

The first wiring 41 is connected to a gate of the first transistor 51. The second wiring 42 is connected to a gate of the third transistor 53 and a gate of the fifth transistor 55. The third wiring 43 is connected to a gate of the second transistor 52 and a gate of the fourth transistor 54.

The drive transistor 56 controls a current supplied to the organic light emitting element 34. Details of the operation of the pixel circuit 33 will be described later.

The pixel circuit 33 will be described using another representation with the first transistor 51, the second transistor 52, and the third transistor 53 focused on. The first transistor 51, the second transistor 52, and the third transistor 53 are connected in series. A connection point of the second transistor 52 and the third transistor 53 is connected to the gate of the drive transistor 56.

As described above, the pixel circuit 33 includes the drive transistor 56 that controls a current supplied to the organic light emitting element 34. The pixel circuit 33 includes the first, second, and third transistors 51, 52, and 53 that are connected in series. The first, second, and third transistors 51, 52, and 53 are connected in series in this order. A connection point of the second transistor 52 and the third transistor 53 is connected to the gate of the drive transistor 56. The first, third, and second wirings 41, 43, and 42 are respectively connected to the gates of the first to third transistors 51 to 53 in this order.

By using the pixel circuit 33 configured in this way, an area required for the layout of the transistors and the like is decreased. As a result, the display device 10 having a small area of the pixels 31, in other words, the display device 10 having high precision can be provided.

As described above, the pixel circuit 33 includes the fourth and fifth transistors 54 and 55 and the holding capacitor 47. The fourth transistor 54 is connected between the high-power source line 451 and the drive transistor 56. The organic light emitting element 34 is connected between the drive transistor 56 and the low-power source line 452 having electric potential lower than the high-power source line 451. The fifth transistor 55 is connected between a connection point of the drive transistor 56 and the organic light emitting element 34 and the reset power source line 453 having electric potential lower than the high-power source line 451. The holding capacitor 47 is connected between a connection point of the first transistor 51 and the second transistor 52 and a connection point of the fourth transistor 54 and the drive transistor 56. The first transistor 51 is connected between the reference power source line 454 and the second transistor 52. The third transistor 53 is connected between the data line 455 supplying a voltage applied to the gate of the drive transistor 56 and the second transistor 52. The second wiring 42 is connected to the gate of the third transistor 53 and the gate of the fifth transistor 55. The third wiring 43 is connected to the gate of the second transistor 52 and the gate of the fourth transistor 54.

Here, a first power source line, for example, is the high-power source line 451, a second power source line, for example, is the low-power source line 452, a third power source line, for example, is the reset power source line 453, a fourth power source line 454, for example, is the reference power source line 454, and a fifth power source line 455, for example, is the data line 455.

By using the pixel circuit 33 configured in this way, an image retention phenomenon and a leakage light emission phenomenon can be prevented. As a result, the display device 10 having high image quality can be provided. The image retention phenomenon and the leakage light emission phenomenon will be described later. In addition, the reason why the image retention phenomenon can be prevented by the pixel circuit 33 according to this embodiment will be described later as well.

Figure 5:
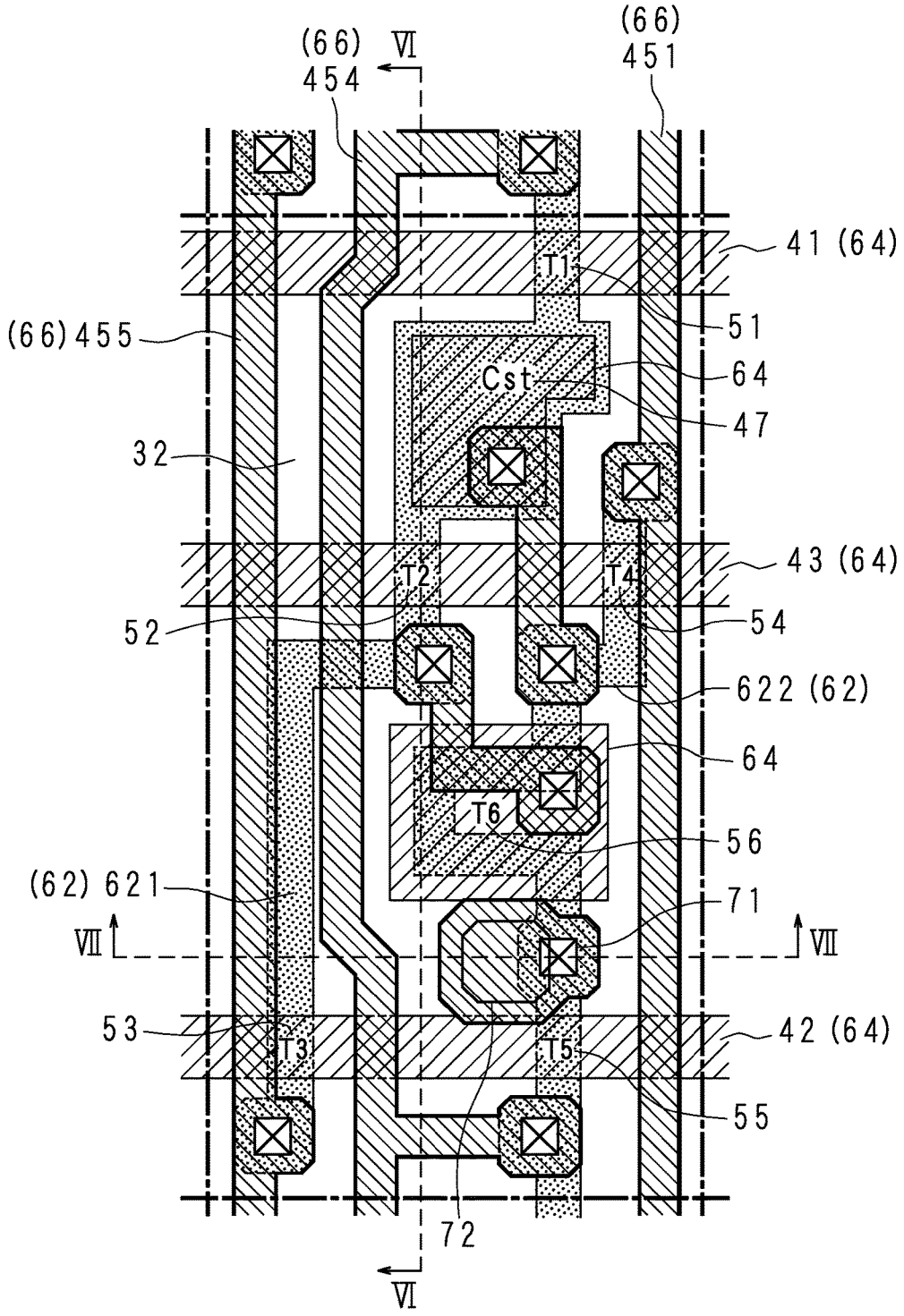
FIG. 5 is a schematic plan view of a subpixel.
Figure 6:
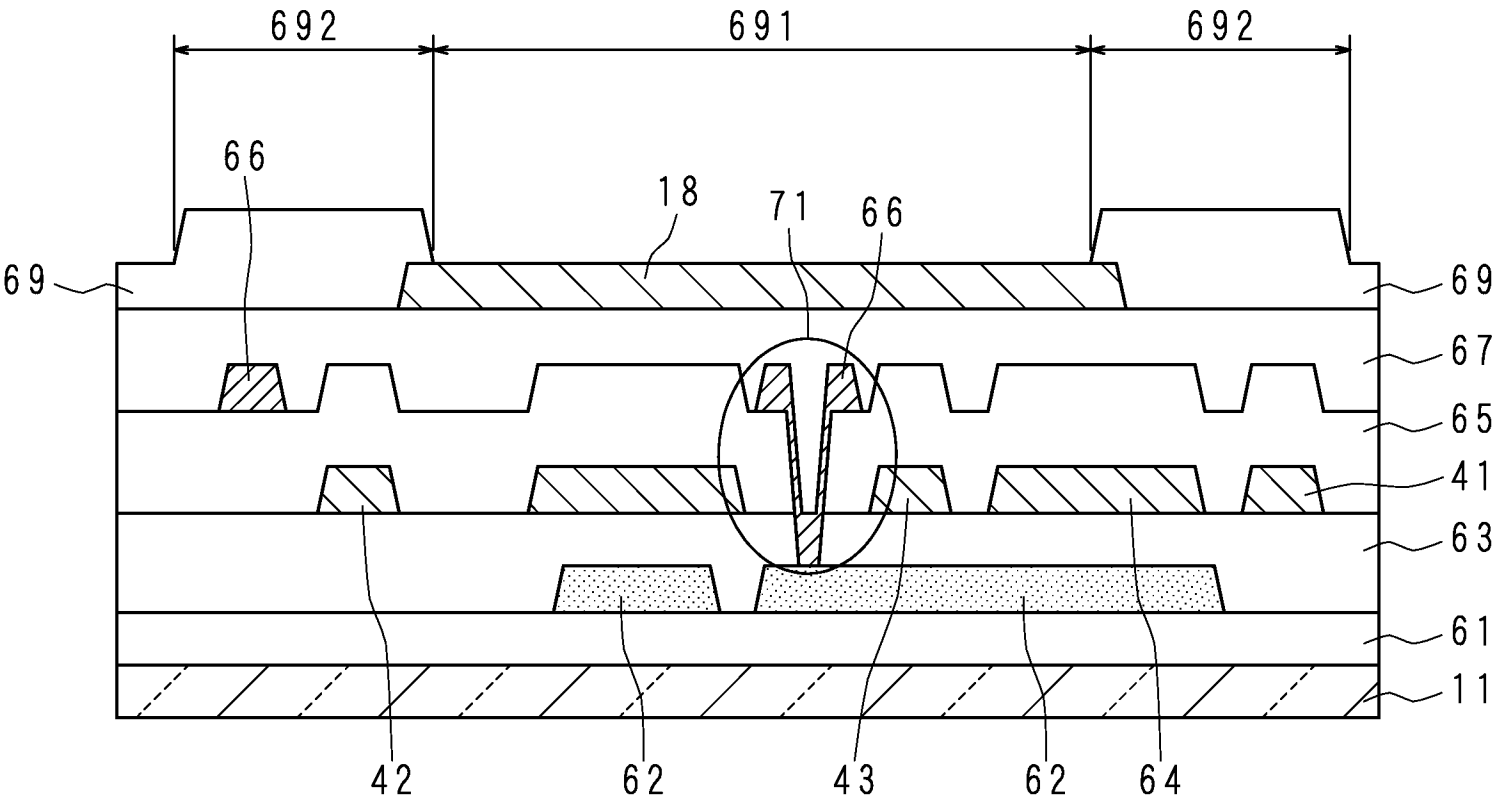
FIG. 6 is a schematic cross-sectional view of a subpixel.
Figure 7:
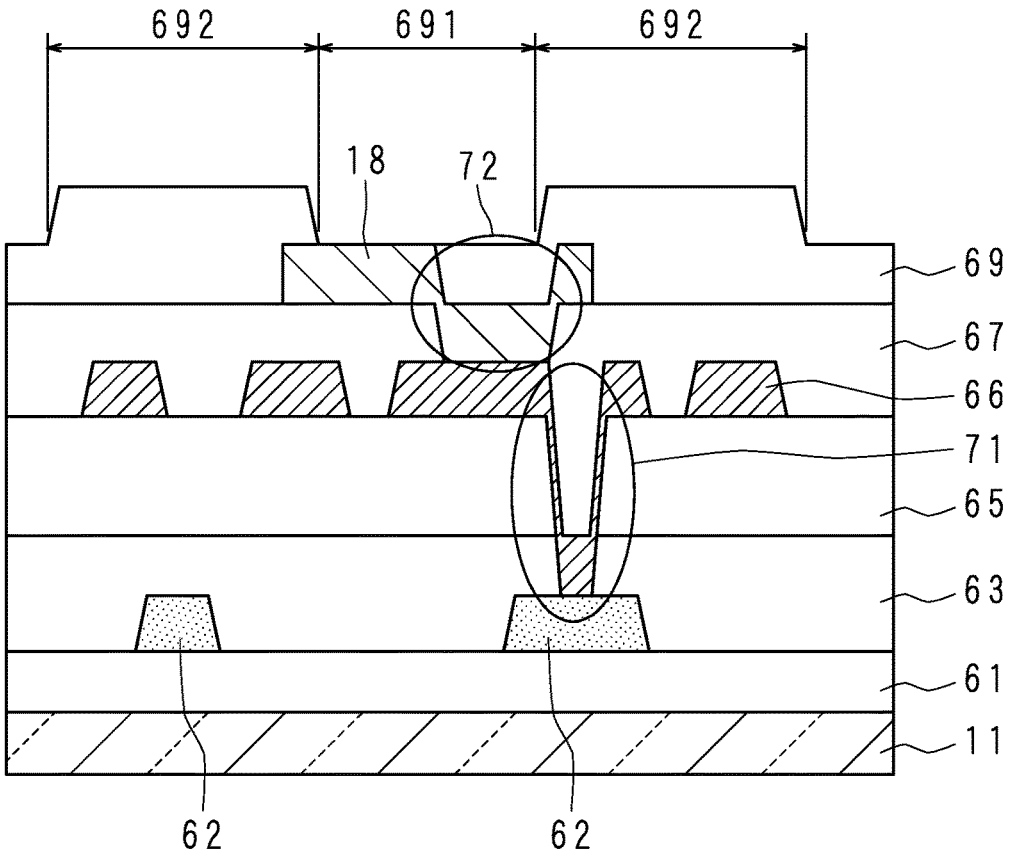
FIG. 7 is a schematic cross-sectional view of a subpixel.

FIG. 5 is a schematic plan view of the subpixel 32. FIG. 6 and FIG. 7 are schematic cross-sectional views of the subpixel 32. In the following schematic plan views, the area of the holding capacitor, the channel length of the drive transistor, the thickness and the interval of each pattern, and the aspect ratio of the subpixel 32 are approximately the same. FIG. 5 is a diagram that illustrates a portion corresponding to one subpixel 32 and the periphery thereof viewed from the front side of the display device 10 in an enlarged scale. FIG. 6 is a schematic cross-sectional view of the subpixel 32 taken along line VI-VI illustrated in FIG. 5. In addition, FIG. 7 is a schematic cross-sectional view of the subpixel 32 taken along line VII-VII illustrated in FIG. 5.

In FIG. 5, a dashed line represents a boundary of the subpixels 32. As described above, the display device 10 does not include a sensible member representing the boundary between subpixels 32. Thus, the dashed line illustrated in FIG. 5 represents not a sensible member but a virtual line for description.

The structure of the display device 10 will be described with reference to FIG. 5 to FIG. 7. First, an overview of the cross-sectional structure of the subpixel 32 will be described with reference to FIG. 6 and FIG. 7. The subpixel 32 includes a first substrate 11, an underlying insulating layer 61, an active layer 62, a gate insulating layer 63, a gate 64 (also referred to as a gate electrode 64 or a gate part 64), an interlayer insulating layer 65, a drain 66 (also referred to as a drain electrode 66 or a drain part 66), a flattening layer 67, an anode electrode 18, and a first insulating part 69. In addition, the subpixel 32 includes an organic light emitting layer, which is not illustrated, at the upper side of the first insulating part 69. The display device 10 includes a cathode electrode 19 (refer to FIG. 1) and a second substrate 12 (refer to FIG. 1) covering the organic light emitting layer and the first insulating part 69 of the subpixels 32 arrayed in a matrix pattern. In FIG. 5 to FIG. 7, the organic light emitting layer, the cathode electrode 19, and the second substrate 12 are not illustrated.

The first substrate 11 is a glass substrate having a rectangular shape. The underlying insulating layer 61 is positioned on the first substrate 11. The underlying insulating layer 61 is a layer of a uniform thickness covering one face of the first substrate 11. The underlying insulating layer 61, for example, is a layer made of an insulating body such as silicon oxide.

The active layer 62 is positioned on the underlying insulating layer 61. As illustrated in FIG. 5, the active layer 62 disposed inside one subpixel 32 includes a first part 621 and a second part 622.

The first part 621 includes a start end portion at the lower left side of the subpixel 32, extends upward along the long side of the subpixel 32, extends upward again at a position bent rightward near the center of the long side of the subpixel 32, after an "L"-shaped area, further extends upward over the edge disposed at the upper side of the area of the subpixel 32. The second part 622 is an extension of the first part of a lower neighboring subpixel 32. The second part 622 starts from the lower edge of the subpixel 32, and extends upward after a "U"-shaped portion having an open right side and includes a tip end portion at the right side of the "L"-shaped portion of the first part 621.

In other words, the first part 621 and the second part 622 are continuous within two subpixels 32 adjacent in the vertical direction. One subpixel 32 includes both the first part 621 shared with a subpixel 32 adjacent to the upper side and the second part 622 shared with a subpixel 32 adjacent to the lower side.

The active layer 62, for example, is a layer made of thin film semiconductor such as polysilicon semiconductor. Alternatively, the active layer 62 is a layer made of InGaZnO that is oxide semiconductor. The material of a wiring connecting transistors or the material of a wiring connecting a transistor and the holding capacitor 47 may be not only an active layer of semiconductor but also metal.

The description will be continued with reference back to FIG. 6 and FIG. 7. The gate insulating layer 63 covers the active layer 62 and whole face of the underlying insulating layer 61 not covered with the active layer 62. The gate insulating layer 63, for example, is a layer, which has an insulating property, of a silicon oxide or the like.

The gate 64 is positioned on the gate insulating layer 63. As illustrated in FIG. 5, the gate 64 includes a first wiring 41, a second wiring 42, a third wiring 43, an "L"-shaped area, and a rectangular area. Each of the first wiring 41, the second wiring 42, and the third wiring 43 has a belt shape extending in the horizontal direction. The first wiring 41, the second wiring 42, and the third wiring 43 extend to neighboring subpixels 32 over boundaries of the right side and the left side of the subpixel 32. The first wiring 41 is positioned at the upper side of the third wiring 43. The second wiring 42 is positioned at the lower side of the third wiring 43.

As described above, the first wiring 41 is arranged at a side of a first side that is an upper side of the pixel 31. The second wiring 42 is arranged at a side of a second side facing the first side of the same pixel 31 as the above-described pixel 31. The third wiring 43 is arranged near the center between the first wiring 41 and the second wiring 42.

According to the arrangement of the first wiring 41 to the third wiring 43, the lead-around of the first wiring 41 to the third wiring 43 can be suppressed from being complicated within the subpixel 32.

By using the first wiring 41, the second wiring 42, and the third wiring 43 having such an arrangement, the generation of parasitic capacitance due to intersections of wirings can be prevented. As a result, the high-image quality display device 10 having decreased luminance unevenness can be provided.

As illustrated in FIG. 5, an "L"-shaped area of the gate 64 illustrated at the upper side of the drawing is positioned between the first wiring 41 and the third wiring 43. The "L"-shaped area of the gate 64 overlaps the "L"-shaped area of the active layer 62 described above. The "L"-shaped area of the gate 64 is slightly smaller than the "L"-shaped area of the active layer 62. Accordingly, the edge of the L-shaped area of the active layer 62 does not overlap the "L"-shaped area of the gate 64.

Portions of the "L"-shaped area of the active layer 62 and the "L"-shaped area of the gate 64 that face each other and the gate insulating layer 63 disposed therebetween form the holding capacitor 47 (refer to sign CST). As described above, the holding capacitor 47 is arranged in an area disposed between the first wiring 41 and the third wiring 43.

Since the holding capacitor 47 is arranged in the area disposed between the first wiring 41 and the third wiring 43, the arrangement of the transistors is optimized, and the pixel area can be decreased. Details thereof will be described with reference to FIG. 9.

A rectangular area of the gate 64 illustrated at the lower side of FIG. 5 is positioned between the third wiring 43 and the second wiring 42. The rectangular area of the gate 64 covers the "U"-shaped portion of the active layer 62.

The material of the gate 64 is a conductor such as a pure metal, an alloy, or an ITO. The gate 64 may be a layered body of a plurality of metals, alloys, ITO, and the like.

The description will be continued with reference back to FIG. 6 and FIG. 7. The interlayer insulating layer 65 covers the gate 64 and the gate insulating layer 63 not covered with the gate 64. The upper side of the interlayer insulating layer 65 includes uneven patterns at which the shape of the lower-side layer is reflected. The interlayer insulating layer 65, for example, is a layer made of an insulating body such as a silicon oxide.

As described above, within the subpixel 32, the first wiring 41, the second wiring 42, the third wiring 43, the "L"-shaped area, and the rectangular area are separate from each other. The lower side of the gate 64 is insulated by the gate insulating layer 63. The upper side of the gate 64 is insulated by the interlayer insulating layer 65. Accordingly, the first wiring 41 and the second wiring 42 are insulated in the pixel circuit 33. According to such insulation, the first wiring 41 and the second wiring 42 are in an electrically non-contact state, and a same signal can be supplied to the first wiring 41 and the second wiring 42 that are different wirings.

The upper portion of the drain 66 is positioned on the interlayer insulating layer 65 and the lower portion of the drain 66 is positioned on the active layer 62. The drain 66 is connected to the active layer 62 through a first conduction part 71. As illustrated in FIG. 5, the high-power source line 451, the reference power source line 454, and the data line 455 are formed by the drain layer.

Each of the high-power source line 451, the reference power source line 454, and the data line 455 has a belt shape extending in the vertical direction. The right side is the high-power source line 451, the center is the reference power source line 454, and the left side is the data line 455. The high-power source line 451, the reference power source line 454, and the data line 455 extend to neighboring subpixels 32 over the boundaries of the upper side and the lower side of the subpixel 32. The planar arrangement of the first conduction part 71 will be described later.

The material of the drain 66 is a conductor such as a pure metal, an alloy, or an ITO. The drain 66 may be a layered body of a plurality of metals, alloys, ITO, and the like. The material of the drain 66 may be different from the material of the gate 64. The material of the drain 66 may be the same as the material of the gate 64.

As described above, the high-power source line 451, the reference power source line 454, and the data line 455 are arranged in the second direction. By using the pixel circuit 33 in which the power source line 45 is arranged as such, the layout of the pixels 31 can be optimized. As a result, the display device 10 having a small area of the pixels 31, in other words, the display device 10 having high precision can be provided.

The description will be continued with reference back to FIG. 6 and FIG. 7. The flattening layer 67 covers the drain 66 and the interlayer insulating layer 65 not covered with the drain 66. The face of the upper side of the flattening layer 67 is flat. The flattening layer 67, for example, is a layer made of an organic material such as a photosensitive acrylic resin.

The anode electrode 18 is positioned on the flattening layer 67. The anode electrode 18 has a shape separate for each subpixel 32 and partly covers the flattening layer 67.

The anode electrode 18 is connected to the drain 66 through a second conduction part 72. The planar arrangement of the second conduction part 72 will be described later.

A first insulating part 69 is positioned on the flattening layer 67 and a part of the anode electrode 18. In the first insulating part 69, an opening portion 691 not covering the anode electrode 18 is formed. In description presented below, the first insulating part 69 except for the opening portion 691 will be described as a non-opening portion 692. The first insulating part 69 is a layer made of an organic material.

The opening portion 691 is covered with an organic light emitting layer not illustrated in the drawing. The organic light emitting layer is a layer of an organic compound that emits light when a current flows. The cathode electrode 19 (refer to FIG. 1) covers the organic light emitting layer and the first insulating part 69.

A relation between the pixel circuit 33 described with reference to FIG. 4 and the structure of subpixels 32 described with reference to FIG. 5 to FIG. 7 will be described.

The cathode electrode 19 is connected to the low-power source line 452 at the outer side of the display area 15 (refer to FIG. 1). The anode electrode 18 is connected to a source of the drive transistor 56 through the second conduction part 72 and the drain 66. The same reference numerals are used in FIG. 4 to FIG. 7 for the first wiring 41, the second wiring 42, the third wiring 43, the high-power source line 451, the reference power source line 454, and the data line 455, and thus, description thereof will not be presented.

The arrangement of transistors within the subpixel 32 will be described. A portion (also referred to as an intersection) of the active layer 62 that overlaps the first wiring 41 forms a channel region of the first transistor 51. The active layer 62 overlaps the third wiring 43 at two portions. Out of these, the active layer 62 of an overlapping portion disposed at the left side forms a channel region of the second transistor 52. In addition, the active layer 62 of an overlapping portion disposed at the right side forms a channel region of the fourth transistor 54.

The active layer 62 overlaps the second wiring 42 at two portions. Out of these, the active layer 62 of an overlapping portion disposed at the left side forms a channel region of the third transistor 53. In addition, the active layer 62 of an overlapping portion disposed at the right side forms a channel region of the fifth transistor 55. A portion acquired by rotating a "U" shape formed in the active layer 62 in the clockwise direction by 90° forms a channel region of the drive transistor 56.

The channel region of the first transistor 51 and the channel region of the second transistor 52 are connected through the active layer 62. In description presented below, the active layer 62 connecting the channel region of the first transistor 51 and the channel region of the second transistor 52 will be described as a first connection wiring. The first connection wiring extends from the channel region of the second transistor 52 to the upper side, in other words, in the second direction and is connected to the channel region of the first transistor 51 through the "L"-shaped area. The first connection wiring is the active layer 62 of which the resistance value is decreased by adding impurities thereto.

The channel region of the second transistor 52 and the channel region of the third transistor 53 are connected through the active layer 62. In description presented below, the active layer 62 connecting the channel region of the second transistor 52 and the channel region of the third transistor 53 will be described as a second connection wiring. The second connection wiring extends from the channel region of the third transistor 53 to the upper side along the long side of the subpixel 32, in other words, in the second direction and is bent to the right side near the center of the long-side direction of the subpixel 32 and connected to the channel region of the second transistor 52. The second connection wiring is the active layer 62 of which the resistance value is decreased by adding impurities thereto.

As described above, the first connection wiring and the second connection wiring are configured from the active layer 62 of the semiconductor. In this way, by using the active layer 62 of the semiconductor configuring a part of the transistor as the wiring, the layout of pixels can be optimized. As a result, the display device 10 having a decreased area of the pixels 31, in other words, the display device 10 having high precision can be provided.

Since the layers are in order of the active layer 62, the gate insulating layer 63, and the gate layer 64 from the lower side to the upper side, a channel region is formed in an area in which a pattern of the active layer 62 and a pattern of the gate 64 intersect with each other, and the pattern of the gate 64 disposed in an area corresponding to the channel region functions as a gate of the transistor. The gate of the first transistor 51 is connected to the first wiring 41. The gates of the second transistor 52 and the fourth transistor 54 are connected to the third wiring 43. The gates of the third transistor 53 and the fifth transistor 55 are connected to the second wiring 42.

As described above, the first wiring 41 and the second wiring 42 supply the first signal. The third wiring 43 supplies the second signal. Each of the first transistor 51 to the fifth transistor 55 performs a switching operation between the source and the drain for switching between a conduction state and a cutoff state. Details of the operation of the pixel circuit 33 will be described later.

As described above, the display device 10 includes the first connection wiring that connects the channel region of the first transistor 51 and the channel region of the second transistor 52. In addition, the display device 10 includes the second connection wiring that connects the channel region of the second transistor 52 and the channel region of the third transistor 53. The first connection wiring and the second connection wiring are arranged in the second direction intersecting with the first direction.

By using such connection wirings, the generation of parasitic capacitance due to an intersection of the wirings can be prevented. As a result, the high-image quality display device 10 having decreased luminance unevenness can be provided.

Since the first connection wiring and the second connection wiring are arranged in the second direction (the direction of the arrow DRC2 in FIG. 1), the layout of long portions of the channel regions of the transistors can be arranged in the vertical direction.

The effects of the display device 10 according to this embodiment having the structure described above will be described with reference to a comparative example. Here, description of portions common to the comparative example and this embodiment will not be presented.

Figure 8:
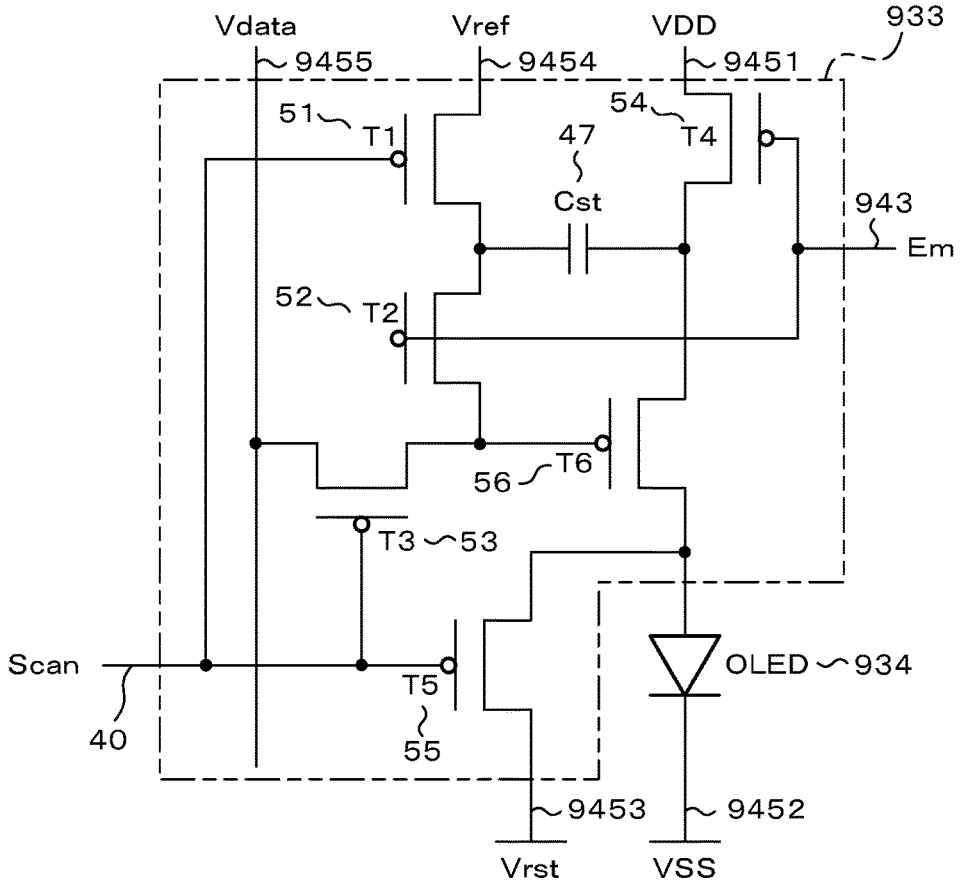
FIG. 8 RELATED ART
FIG. 8 is an equivalent circuit diagram of a pixel circuit of a comparative example.

The structure of the comparative example will be described. FIG. 8 is an equivalent circuit diagram of a pixel circuit 933 of the comparative example. The pixel circuit 933 of the comparative example will be described. Here, descriptions of portions common to the pixel circuit 33 according to this embodiment illustrated in FIG. 4 will not be presented. Same reference numerals as those of corresponding transistors and corresponding capacitors of the pixel circuit 33 according to this embodiment will be assigned to transistors and capacitors configuring the equivalent circuit for description.

A scan line 40, a third wiring 943, a high-power source line 9451, a reset power source line 9453, a reference power source line 9454, a data line 9455, and an anode electrode of an organic light emitting element 934 are connected to the pixel circuit 933. A low-power source line 9452 is connected to a cathode electrode of the organic light emitting element 934.

The high-power source line 9451 supplies a high-power source voltage VDD. The low-power source line 9452 supplies a low-power source voltage VSS. The reset power source line 9453 supplies a reset voltage Vrst. The reference power source line 9454 supplies a reference voltage Vref. The data line 9455, as described above, supplies a signal representing the luminance of a subpixel 932.

A scan drive circuit of the comparative example not illustrated in the drawing supplies a first signal to the pixel circuit 933 through the scan line 40. An Em drive circuit of the comparative example not illustrated in the drawing supplies a second signal to the pixel circuit 933 through the third wiring 943.

A first transistor 51 is connected to the reference power source line 9454, a second transistor 52, and a first terminal of a holding capacitor 47. The second transistor 52 is connected to a first terminal of the holding capacitor 47, a third transistor 53, and a gate of the drive transistor 56. The third transistor 53 is connected to the data line 9455, the second transistor 52, and the gate of the drive transistor 56.

A fourth transistor 54 is connected to the high-power source line 9451, a second terminal of the holding capacitor 47, and a source of the drive transistor 56.

A drain of the drive transistor 56 is connected to an anode electrode of the organic light emitting element 34 and a fifth transistor 55. The fifth transistor 55 is connected to the reset power source line 9453 and the drain of the drive transistor 56.

The scan line 40 is connected to a gate of the first transistor 51, a gate of the third transistor 53 and a gate of the fifth transistor 55.

Major differences between the pixel circuit 933 of the comparative example and the pixel circuit 33 according to this embodiment will be described. In this embodiment, one distribution source wiring 44 (refer to FIG. 2) output from the scan drive circuit 21 branches into two lines outside the pixel circuit 33. More specifically, a branch point is arranged in an area disposed between the display area 15 and the drive circuit 20. In the comparative example, one scan line 40 output from the scan drive circuit of the comparative example not illustrated in the drawing branches into two lines inside the pixel circuit 933.

Figure 9:
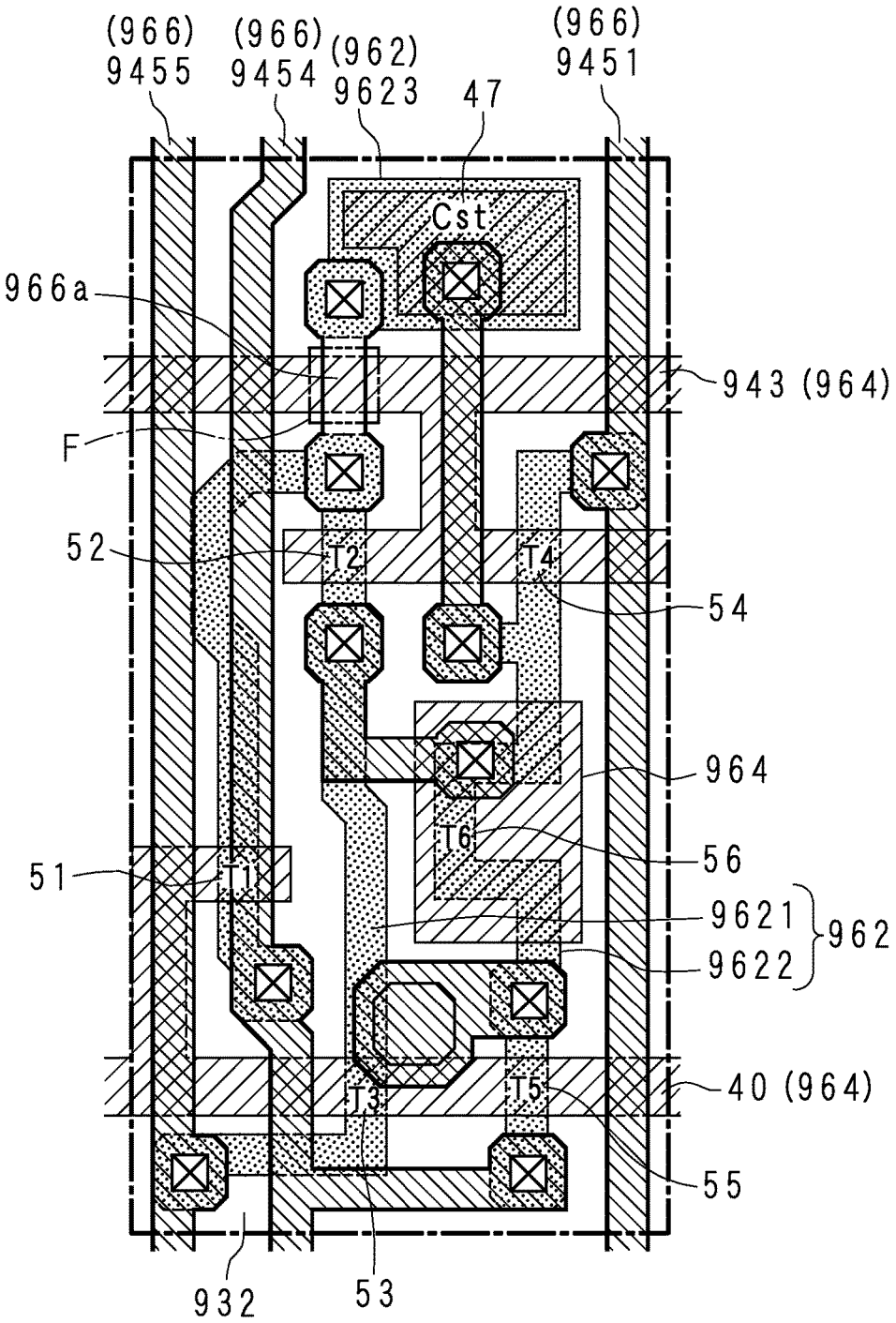
FIG. 9 RELATED ART
FIG. 9 is a schematic plan view of a subpixel of a comparative example.

FIG. 9 is a schematic plan view of a subpixel 932 of the comparative example. FIG. 9 is a diagram that illustrates a portion corresponding to one subpixel 932 of the comparative example and the periphery thereof viewed from the front side of a display device of the comparative example, which is not illustrated in the drawing, in an enlarged scale. Description of portions common to the pixel circuit 33 according to this embodiment illustrated in FIG. 5 will not be presented. The subpixel 932 includes an active layer 962, a gate 964, and a drain 966.

As illustrated in FIG. 9, the active layer 962 within one subpixel 932 includes a first part 9621, a second part 9622, and a third part 9623. The first part 9621 includes a start end portion at the lower left side of the subpixel 932, extends rightward along the short side of the subpixel 932, is bent upward near the center of the short side of the subpixel 932, makes a U turn in the counterclockwise direction at the upper side of the subpixel 932 and extends downward, and includes a tip end portion at the upper right side of the start end portion.

The second part 9622 includes one end at the lower right side of the subpixel 932, extends upward, further extends upward after a "U"-shaped portion of which the right side is open and, and includes a tip end portion at the right side of a position at which the first part makes the U turn. The third part 9623 is an approximately rectangular shape and is positioned at the upper end of the subpixel 932.

As illustrated in FIG. 9, the gate 964 includes the scan line 40, the third wiring 943, an "L"-shaped area, and a rectangular area. The scan line 40 includes a belt-shaped portion and the "L"-shaped portion. The belt-shaped portion extends to the neighboring subpixels 932 over boundaries of the right side and the left side of the subpixel 932. The "L"-shaped portion extends upward from the belt-shaped portion along the left side of the subpixel 932 and is bent to the right side at an about ⅓ position from the lower side of the subpixel 932.

The third wiring 943 includes a belt-shaped portion and a "T"-shaped portion. The belt-shaped portion extends to neighboring subpixels 932 over boundaries of the right side and the left side of the subpixel 932. The T-shaped portion branches to the left and right sides at a position extending from near the center of the belt-shaped portion to the lower side. A branched left portion intersects with the first part 9621 of the active layer 962. A branched right portion intersects with the second part 9622 of the active layer 962.

The "L"-shaped area of the gate 964 is positioned between the third wiring 943 and the upper side of the subpixel 932. The "L"-shaped area of the gate 964 overlaps the third part 9623 of the active layer 962 described above. The "L"-shaped area of the gate 964 is slightly smaller than the third part 9623. Accordingly, the edge of the third part 9623 does not overlap the "L"-shaped area of the gate 964. Portions of the "L"-shaped area of the gate 964 and the third part 9623 that face each other and a gate insulating layer, which is not illustrated, disposed therebetween form the holding capacitor 47.

The rectangular area of the gate 964 is positioned between the third wiring 943 and the scan line 40. The rectangular area of the gate 964 covers a "U"-shaped portion of the second part 9622 of the active layer 962.

As illustrated in FIG. 9, the high-power source line 9451, the reference power source line 9454, and the data line 9455 are formed by the drain layer.

Each of the high-power source line 9451, the reference power source line 9454, and the data line 9455 has a belt shape extending in the vertical direction. The right side is the high-power source line 9451, the center is the reference power source line 9454, and the left side is the data line 9455. The high-power source line 9451, the reference power source line 9454, and the data line 9455 extend to neighboring subpixels 932 over the boundaries of the upper side and the lower side of the subpixel 932.

Portions of the drain 966 other than the high-power source line 9451, the reference power source line 9454, and the data line 9455 will be described later.

Here, the holding capacitor 47 and the second transistor 52 are connected through a connection drain layer 966*a*.

A relation between the pixel circuit 933 of the comparative example described with reference to FIG. 8 and the structure of the subpixel 932 of the comparative example described with reference to FIG. 9 will be described. For the scan line 40, the third wiring 943, the high-power source line 9451, the reference power source line 9454, and the data line 9455, common names are used in FIG. 8 and FIG. 9, and thus, description thereof will not be presented.

A portion of the first part 9621 of the active layer 962 that overlaps the "L"-shaped portion of the scan line 40 forms a channel region of the first transistor 51. A portion of the first part 9621 that overlaps the third wiring 943 at the lower side of the U-turn position forms a channel region of the second transistor 52. A portion of the first part 9621 that overlaps the belt-shaped portion of the scan line 40 forms a channel region of the third transistor 53.

A portion of the second part 9622 of the active layer 962 that overlaps the third wiring 943 forms a channel region of the fourth transistor 54. The "U"-shaped portion of the second part 9622 forms a channel region of the drive transistor 56.

Also in the comparative example, the active layer 962 connecting the channel region of the first transistor 51 and the channel region of the second transistor 52 will be described as a first connection wiring. In addition, the active layer 962 connecting the channel region of the second transistor 52 and the channel region of the third transistor 53 will be described as a second connection wiring. Each of the first connection wiring and the second connection wiring is the active layer 962 of which the resistance value is decreased by adding impurities thereto.

[Effect of Preventing Luminance Unevenness Using Feedthrough Phenomenon]

An effect of preventing luminance unevenness using a feedthrough phenomenon according to this embodiment will be described. In the case illustrated in FIG. 9, the connection drain layer 966*a* is assumed to include a metal member. In addition, the third wiring 943 is made of a metal. Between the connection drain layer 966*a* and the third wiring 943, an insulating layer (not illustrated) is arranged. According to such a configuration, in a portion (refer to sign F) in which the connection drain layer 966*a* connecting the holding capacitor 47 and the second transistor 52 and the third wiring 943 intersects with each other, parasitic capacitance is formed. In description presented below, a portion of the parasitic capacitance formed in this way will be described as a parasitic capacitance forming portion F. As illustrated in FIG. 9, in the subpixel 932 of the comparative example, at the upper side of the channel part of the second transistor 52, the parasitic capacitance forming portion F is positioned.

Figure 10:
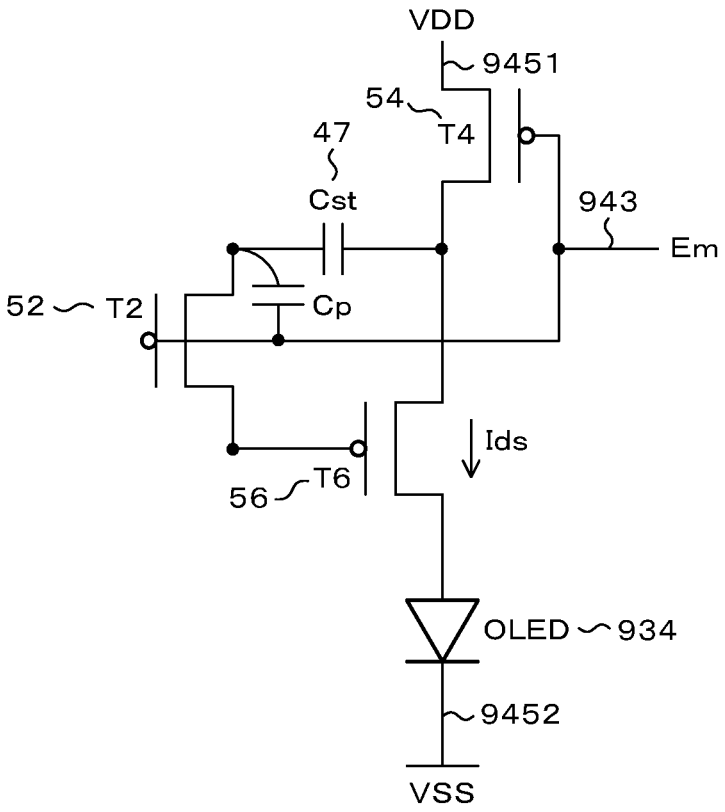
FIG. 10 is a schematic diagram that illustrates a state in which a feedthrough phenomenon occurs.

FIG. 10 is a schematic diagram that illustrates a state in which a feedthrough phenomenon occurs. FIG. 10 illustrates an equivalent circuit of the pixel circuit 933 of case where the organic light emitting element 934 of the comparative example is in the light emitting state. Only transistors that are in the conduction state are illustrated, and the first transistor 51 (refer to FIG. 8), the third transistor 53 (refer to FIG. 8), and the fifth transistor 55 (refer to FIG. 8) are in the cutoff state and thus are not illustrated.

At the start of the emission period t3, as the Em signal falls from H to L, the second transistor 52 changed from the cutoff state to the conduction state, and the pixel circuit 933 is in a state illustrated in FIG. 10. In a case where the pixel circuit 33 becomes the state illustrated in FIG. 10, the organic light emitting element 934 starts emitting light.

A drain current Ids flows from the source to the drain of the drive transistor 56. The drain current Ids is changed according to an electric potential difference between the gate and the source of the drive transistor 56.

The drain current Ids flows from the anode electrode to the cathode electrode of the organic light emitting element 934. The organic light emitting element 934 emits light with luminance according to the amount of current flowing from the anode electrode to the cathode electrode.

The source and the drain of the second transistor 52 are in a floating node state not being conductive for each power source, any other transistor, or the like. Meanwhile, between a wiring connecting the holding capacitor 47 and the source or the drain of the second transistor 52 and the third wiring 943, in other words, in the parasitic capacitance forming portion F illustrated in FIG. 9, parasitic capacitance Cp is generated.

When the Em signal falls from H to L, a feedthrough phenomenon changing the electric potential of the floating node through the parasitic capacitance Cp occurs. The feedthrough phenomenon is a phenomenon in which electric charge disposed inside the floating node moves through parasitic capacitance or the capacitance of the gate insulating film or the like. In the comparative example, the reason for the occurrence of the feedthrough phenomenon is the parasitic capacitance Cp illustrated in FIG. 10.

According to the feedthrough phenomenon, a gate-to-source voltage Vgs of the drive transistor 56 changes. As a result, the drive current Ids changes, and the emission luminance of the organic light emitting element 934 is changed. In other words, in the display device of the comparative example, luminance unevenness occurs according to the feedthrough phenomenon.

Figure 11:
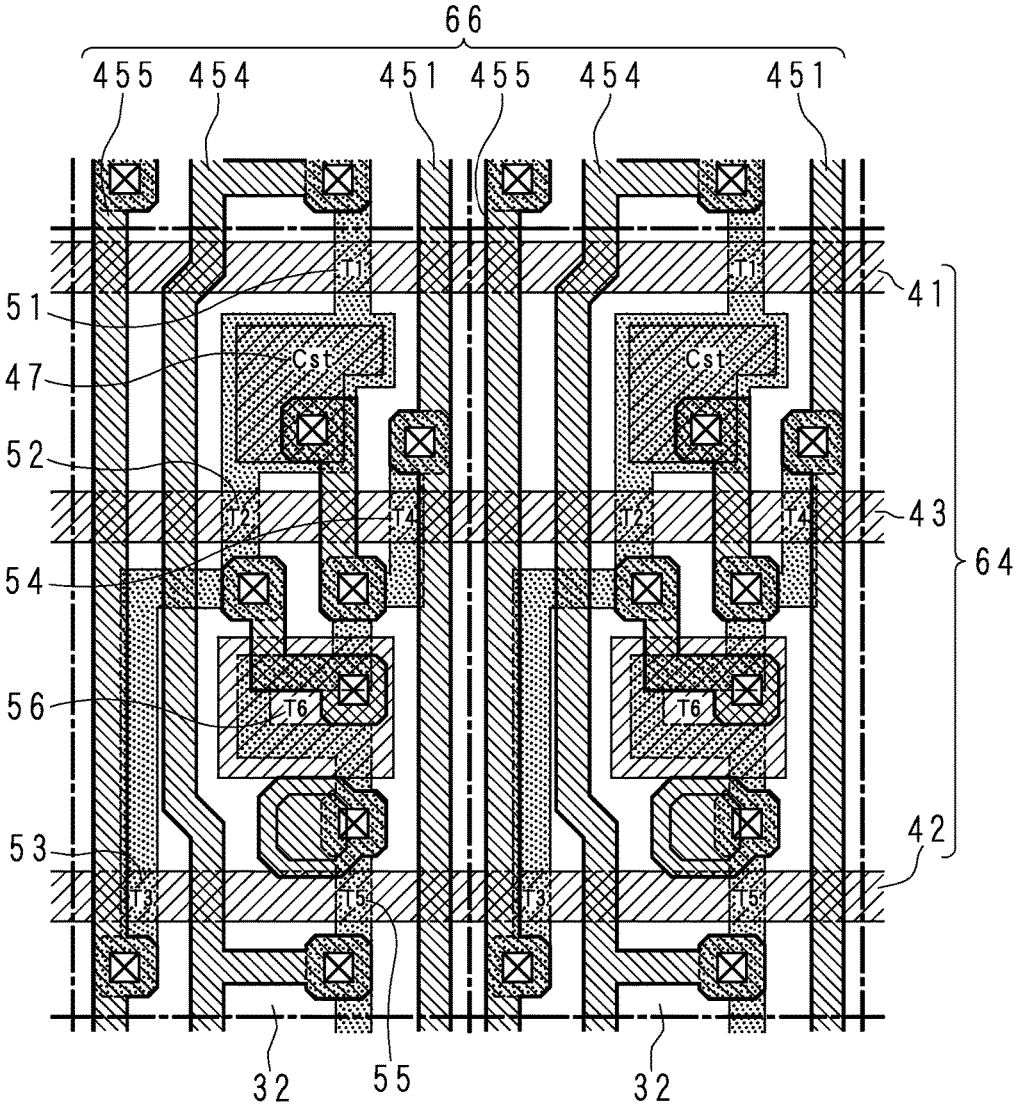
FIG. 11 is a schematic diagram that illustrates a reason why the feedthrough phenomenon can be prevented.

In the display device 10 according to this embodiment, the occurrence of luminance unevenness according to the feedthrough phenomenon can be prevented. FIG. 11 is a schematic diagram that illustrates a reason why the feedthrough phenomenon can be prevented. FIG. 11 illustrates two subpixels 32, which are horizontally consecutive, according to this embodiment.

In the subpixel 932 of the comparative example illustrated in FIG. 9, the holding capacitor 47 and the second transistor 52 are connected through the connection drain layer 966*a*, and the connection drain layer 966*a* and the third wiring 943 intersect with each other in the area represented by the reference sign F in FIG. 9.

On the other hand, in this embodiment illustrated in FIG. 11, the first wiring 41, the second wiring 42, and the third wiring 43 traverse a plurality of the subpixels 32. In the case illustrated in FIG. 11, a wiring part connecting the second transistor 52 and the holding capacitor 47 is directly connected to the pattern of the active layer 62 but does not intersect with the gate layer 64 and the drain layer 66. Accordingly, the subpixel 32 according to this embodiment does not include the parasitic capacitance forming portion F. Accordingly, in the subpixel 32 according to this embodiment, parasitic capacitance Cp according to the parasitic capacitance forming portion F is not generated.

As described above, the cause of the feedthrough phenomenon in the comparative example is the parasitic capacitance Cp. The display device 10 according to this embodiment does not include the parasitic capacitance forming portion F. In addition, certainly, although the second transistor 52 according to this embodiment has capacitance according to the gate insulating film disposed between the gate 64 and the active layer 62, the components thereof are similar in the comparative example and this embodiment.

As above, the display device 10 according to this embodiment can suppress luminance unevenness according to the feedthrough phenomenon. As a result, degradation of the image quality can be suppressed.

In addition, the parasitic capacitance Cp will be described. The magnitude of the parasitic capacitance Cp is in proportion to an area in which the third wiring 943 and the drain 966 face each other. Accordingly, the magnitude of the parasitic capacitance Cp is changed based on the width of the third wiring 943 and the width of the drain 966 in the parasitic capacitance forming portion F. In other words, the magnitude of the parasitic capacitance Cp between the subpixels 932 varies according to the influence of the manufacturing error. For example, in the manufacturing process of a TFT, in an etching process for mainly processing patterns, a distribution of the pattern size is generated within a substrate face.

Figure 12:
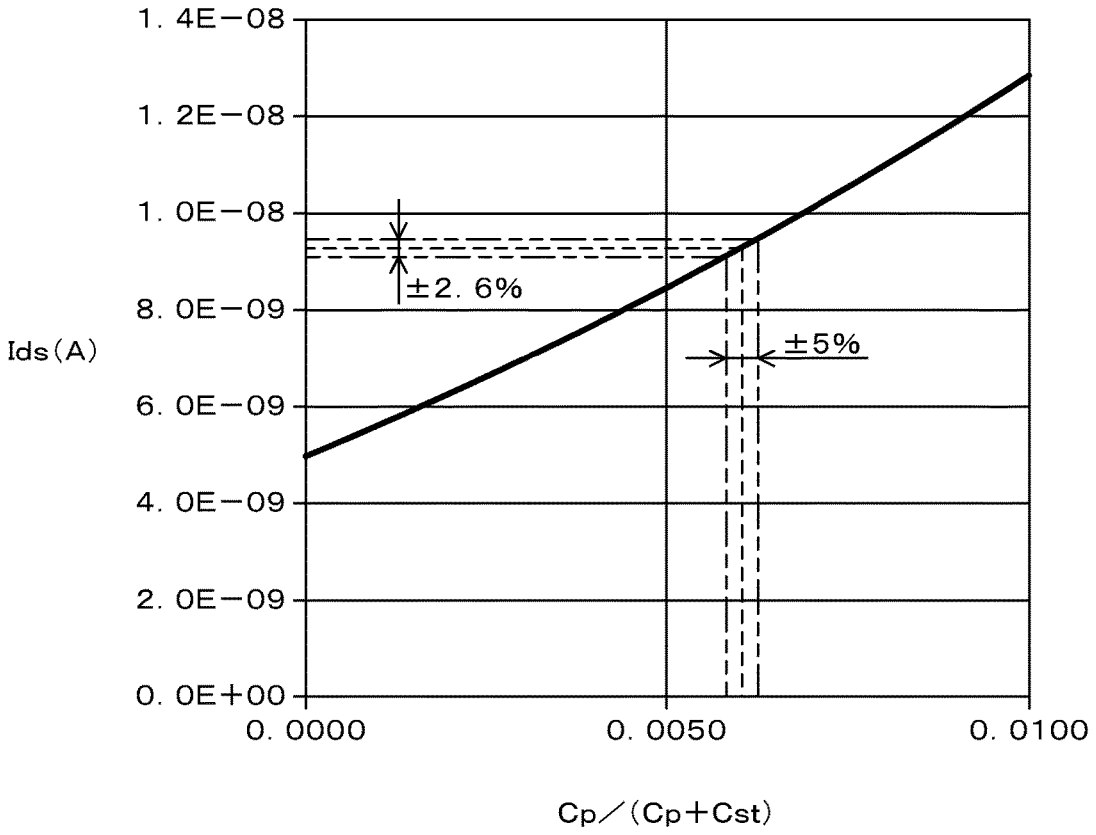
FIG. 12 is a graph that illustrates the influence of a variation in parasitic capacitance Cp.

FIG. 12 is a graph that illustrates the influence of a variation in the parasitic capacitance Cp. In FIG. 12, the horizontal axis is Cp/(Cp+Cst). As described above, Cp represents parasitic capacitance, Cst represents the capacitance of the holding capacitor 47. In FIG. 12, the horizontal axis has no dimension. In FIG. 12, the vertical axis is the drain current Ids of the drive transistor 56. In FIG. 12, the unit of the vertical axis is ampere. In FIG. 12, a solid line represents a relation between Cp/(Cp+Cst) and Ids. A method of deriving the relation between Cp/(Cp+Cst) and the drain current Ids is illustrated below.

By using a numerical formula of the drain current in a saturation region of a semiconductor device (TFT), the drain current Ids is represented in Equation (1). Here, the saturation region represents an application condition that a drain-to-source voltage is sufficiently higher than a gate-to-source voltage.

[Numerical Expression 1]

$$Ids=W/L\times\mu\times Cox/2\times(Vgs-Vth)^2 \quad (1)$$

W is a channel width of the transistor.

L is a channel length.

μ is mobility.

Cox is the capacitance of the gate insulating film.

Vgs is a gate-to-source voltage.

Vth is a threshold voltage.

As represented in Equation (1), while the drain current Ids is determined based on the gate-to-source voltage Vgs of the drive transistor, the source voltage Vs of the drive transistor is connected to VDD during the emission period.

The remaining gate voltage Vg of the drive transistor is derived. Equation (2) is satisfied based on the principle of conservation of charge at three nodes including both ends of the holding capacitor 47 and the Em signal terminal when the second transistor 52 becomes conductive from a cutoff state.

[Numerical Expression 2]

$$Vg=k(Vgl-Vgh)+(1-k)(VDD-V\text{data}+Vth)+V\text{ref} \quad (2)$$

Vgl is an L level of the signal (Em).

Vgh is a H level of the signal.

k is represented in the following equation by using the parasitic capacitance Cp and the capacitance Cst of the holding capacitor 47.

$$k=Cp/(Cp+Cst)$$

Based on Equations (1) and (2) described above, a relation between Cp/(Cp+Cst) and the drain current Ids is acquired.

The graph illustrated in FIG. 12 is an example of a case where the data voltage Vdata=+2.25 V The influence of a case where Cp/(Cp+Cst) varies ±5% from 0.0060 as the center will be described as an example. As illustrated in FIG. 12, a variation in the drain current Ids is ±2.6%. According to the variation in the drain current Ids, the luminance of the organic light emitting element 34 varies. This variation causes luminance unevenness.

As described with reference to FIG. 12, the display device 10 according to this embodiment does not include the parasitic capacitance forming portion F. Accordingly, compared to the display device of the comparative example, the luminance unevenness occurring according to the influence of the parasitic capacitance Cp can be decreased.

[Effect of Suppressing Luminance Unevenness According to External Disturbance]

There are cases where the emission luminance of the organic light emitting element 34 changes in the middle of the emission period. As a result, luminance unevenness occurs.

Figure 13:
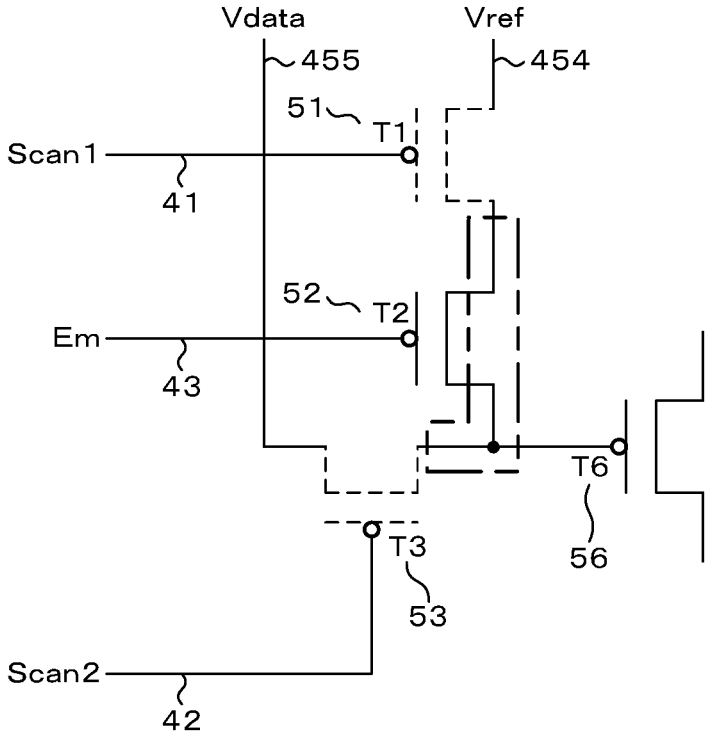
FIG. 13 is a schematic diagram that illustrates an effect of decreasing coupling parasitic capacitance of an active layer.
Figure 14:
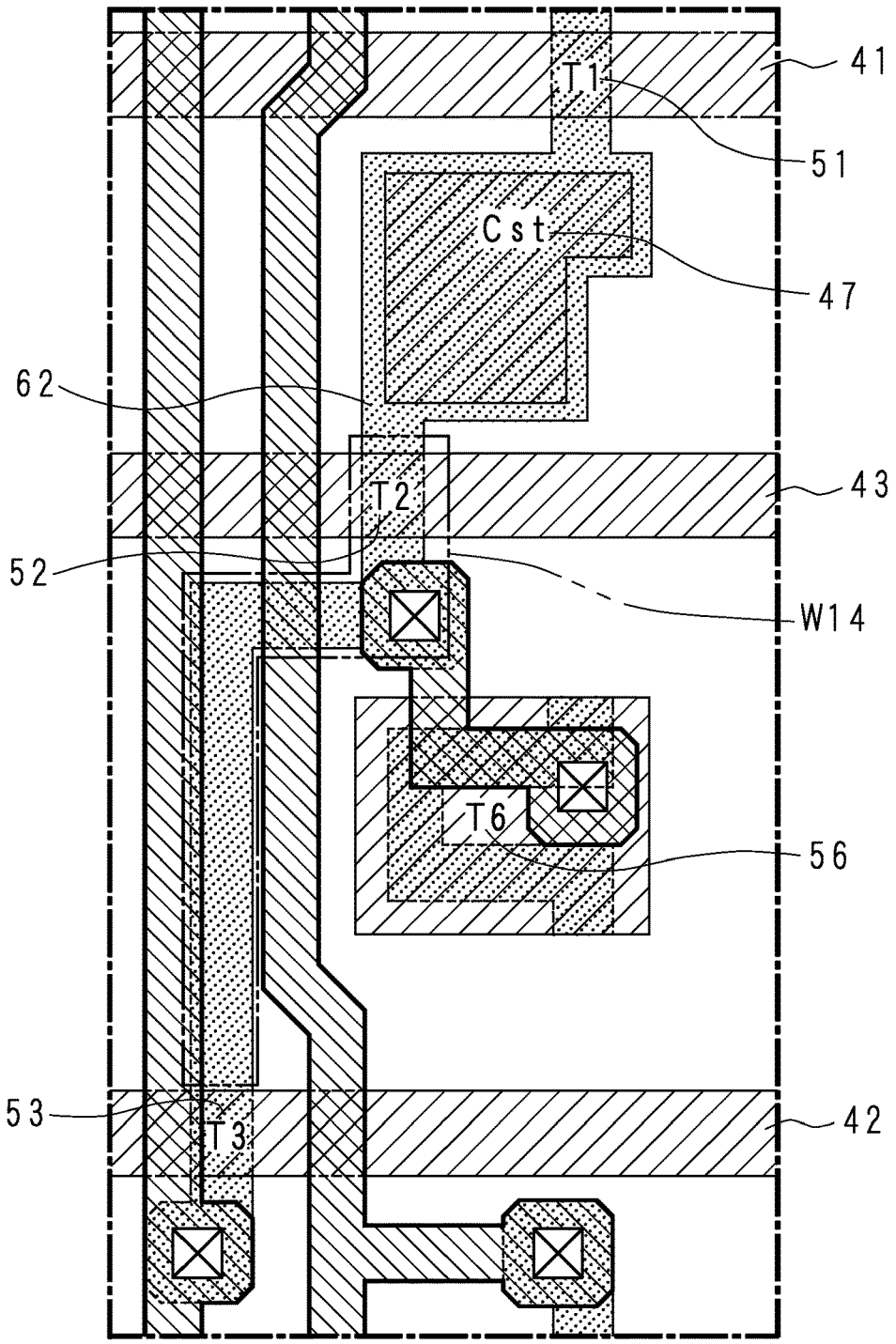
FIG. 14 is a schematic diagram that illustrates the effect of decreasing coupling parasitic capacitance of the active layer.

FIG. 13 and FIG. 14 are schematic diagrams that illustrate an effect of decreasing coupling parasitic capacitance of the active layer 62. FIG. 13 illustrates a part of the pixel circuit 33 in a case where the organic light emitting element 34 according to this embodiment 34 is in the light emitting state. Here, transistors denoted by dotted lines represent transistors that are in the cutoff state. As described above, the first transistor 51 and the third transistor 53 are in the cutoff state.

The source and the drain of the second transistor 52 are in the floating node state not connected to external circuits such as the other transistors. In FIG. 13, a portion enclosed by two-dot chain lines schematically illustrates between the source and the drain of the second transistor 52. The electric potential of the floating node may be easily influenced by external disturbances. The external disturbances, for example, are a change in the electric potential of a neighboring wiring, incidence of an electronic noise from the outside of the display device 10, and the like. In a case where coupling parasitic capacitance generated between a wiring and the other wiring or the like is high, the influence of the external disturbance is increased.

As described above, in a case where the electric potential of the gate of the drive transistor 56 is changed, the luminance of the organic light emitting element 34 changes as well. According to a change in the luminance of the organic light emitting element 34 during the emission period, luminance unevenness occurs.

FIG. 14 is a schematic diagram acquired by eliminating unnecessary portions for description of the floating node from the schematic plan view illustrated in FIG. 5. In FIG. 14, a portion (refer to sign W14) enclosed by a two-dot chain line represents a wiring (hereinafter, referred to as a wiring W14) between the second transistor 52 and the third transistor 53. The wiring W14, as illustrated in FIG. 5, is connected to the gate of the drive transistor 56.

Figure 15:
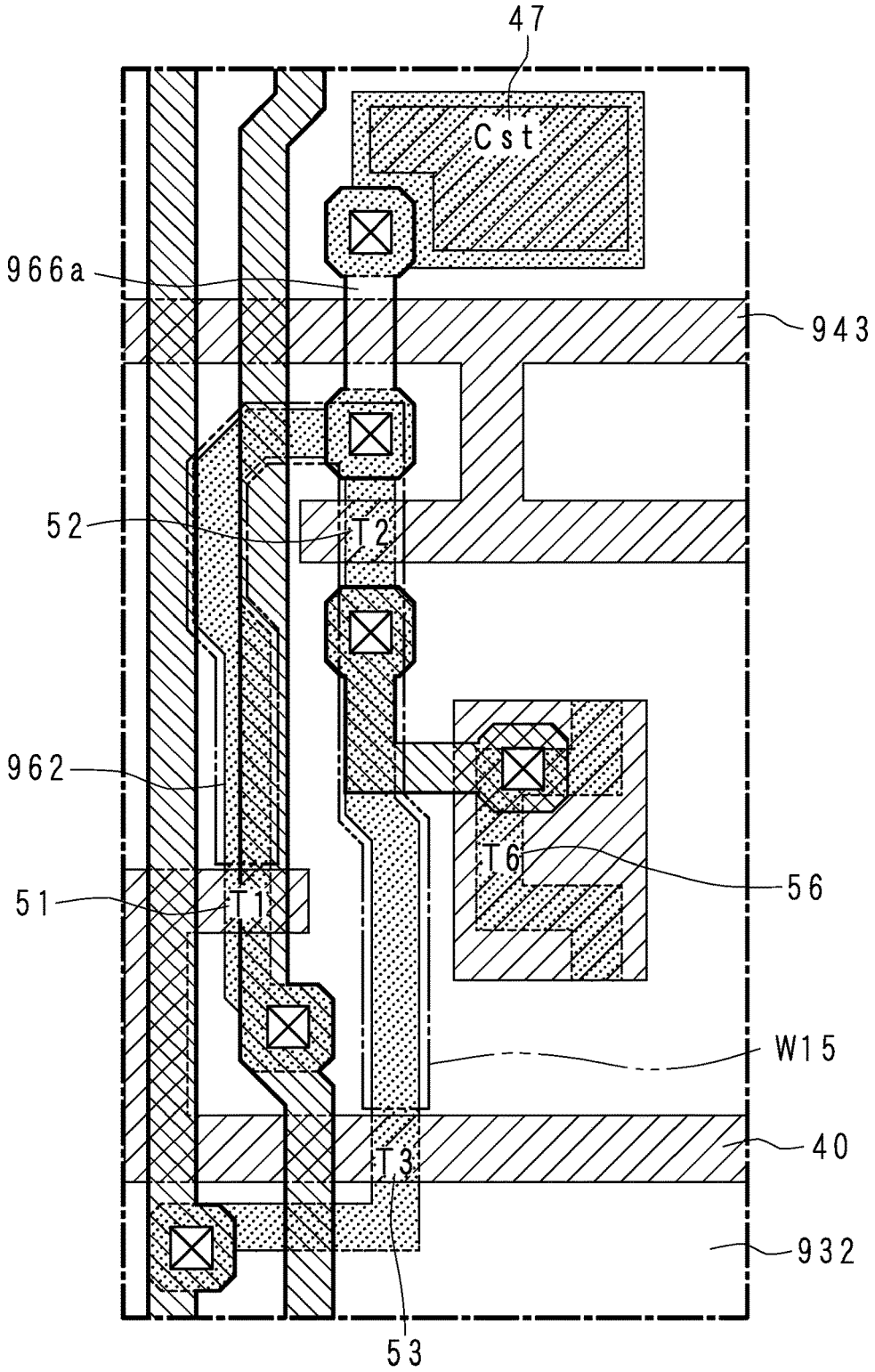
FIG. 15 is a schematic diagram that illustrates a comparative example of an effect of decreasing coupling parasitic capacitance of an active layer.

FIG. 15 is a schematic diagram that illustrates a comparative example of an effect of decreasing coupling parasitic capacitance of the active layer 62. FIG. 15 is a schematic diagram that illustrates a portion of the schematic plan view illustrated in FIG. 9 that corresponds to FIG. 14. In FIG. 15, a portion (refer to sign W15) enclosed by a two-dot chain line illustrates a wiring (hereinafter, referred to as a wiring W15) between the first transistor 51 and the third transistor 53. The wiring W15, as illustrated in FIG. 8, is connected to the gate of the drive transistor 56. The wirings W14 and W15, as described above, are in the floating state during the emission period. In other words, the wirings W14 and W15 include a node that becomes a floating node during the emission period. The wirings W14 and W15 are examples of the parts that are sensitive to the characteristics of the pixel circuit 33 described with reference to FIG. 2 and FIG. 3.

Between the first transistor 51 and the second transistor 52, a wiring portion configured from the active layer 62 is covered with the gate 64 (refer to FIG. 5, FIG. 6, and FIG. 14). According to the gate 64 covering this wiring portion, an external disturbance for the wiring portion can be blocked. Accordingly, for the wiring portion, the influence of external disturbances may not be considered.

In a case where the length of a wiring including the floating node is long, the influence of external disturbances may be easily received. In a case where the influence of external disturbances may be easily received, the electric potential of the gate of the drive transistor 56 varies more. For this reason, by decreasing the length of the wiring including the floating node, the influence of external disturbances is not easily received. As a result, a variation in the luminance of the organic light emitting element 34 according to a variation in the electric potential of the gate is decreased, and accordingly, luminance unevenness can be suppressed.

The case illustrated in FIG. 14 and the case illustrated in FIG. 15 will be compared with each other. As illustrated in the drawings, the length of the wiring W14 according to this embodiment is smaller than the length of the wiring W15 of the comparative example. For this reason, in this embodiment, compared to the comparative example, the coupling parasitic capacitance of wiring W14 is low, and the influence of external disturbances is not easily received. Therefore, according to this embodiment, the display device 10 suppressing luminance unevenness caused by to external disturbances can be realized.

The reason why the length of the wiring W14 according to this embodiment is smaller than the length of the wiring W15 of the comparative example will be described. In this embodiment, the third wiring 43 is arranged between the first wiring 41 and the second wiring 42. The gate of the first transistor 51 is connected to the first wiring 41. The gate of the second transistor 52 is connected to the second wiring 42. The gate of the third transistor 53 is connected to the second wiring 42.

Accordingly, the first transistor 51, the second transistor 52, and the third transistor 53 connected in series can be arranged near the first wiring 41, the third wiring 43, and the second wiring 42. In this way, the arrangement in which the wiring including the floating node is short can be realized.

In addition, as described above, between the first transistor 51 and the second transistor 52, a wiring portion configured from the active layer 62 is covered with the gate 64. Accordingly, for this wiring portion, the influence of external disturbances may not be considered.

On the other hand, in the comparative example, both the gate of the first transistor 51 and the gate of the third transistor 53 are connected to the scan line 40. Meanwhile, the gate of the second transistor 52 connected in series between the first transistor 51 and the third transistor 53 is connected to the third wiring 943.

Accordingly, the first transistor 51 and the third transistor 53 positioned at both ends of three transistors connected in series need to be arranged in a "U" shape so as to approach each other. In this way, as illustrated in FIG. 15, the long wiring W15 bent in the "U" shape is generated.

[Effect of Decreasing Number of Contact Holes]

A contact hole is a conduction part connecting a conduction layer disposed on the upper side of an insulating layer and a conduction layer disposed on the lower side of an insulating layer. The first conduction part 71 and the second conduction part 72 described with reference to FIG. 6 and FIG. 7 are examples of the contact hole.

Figure 16:
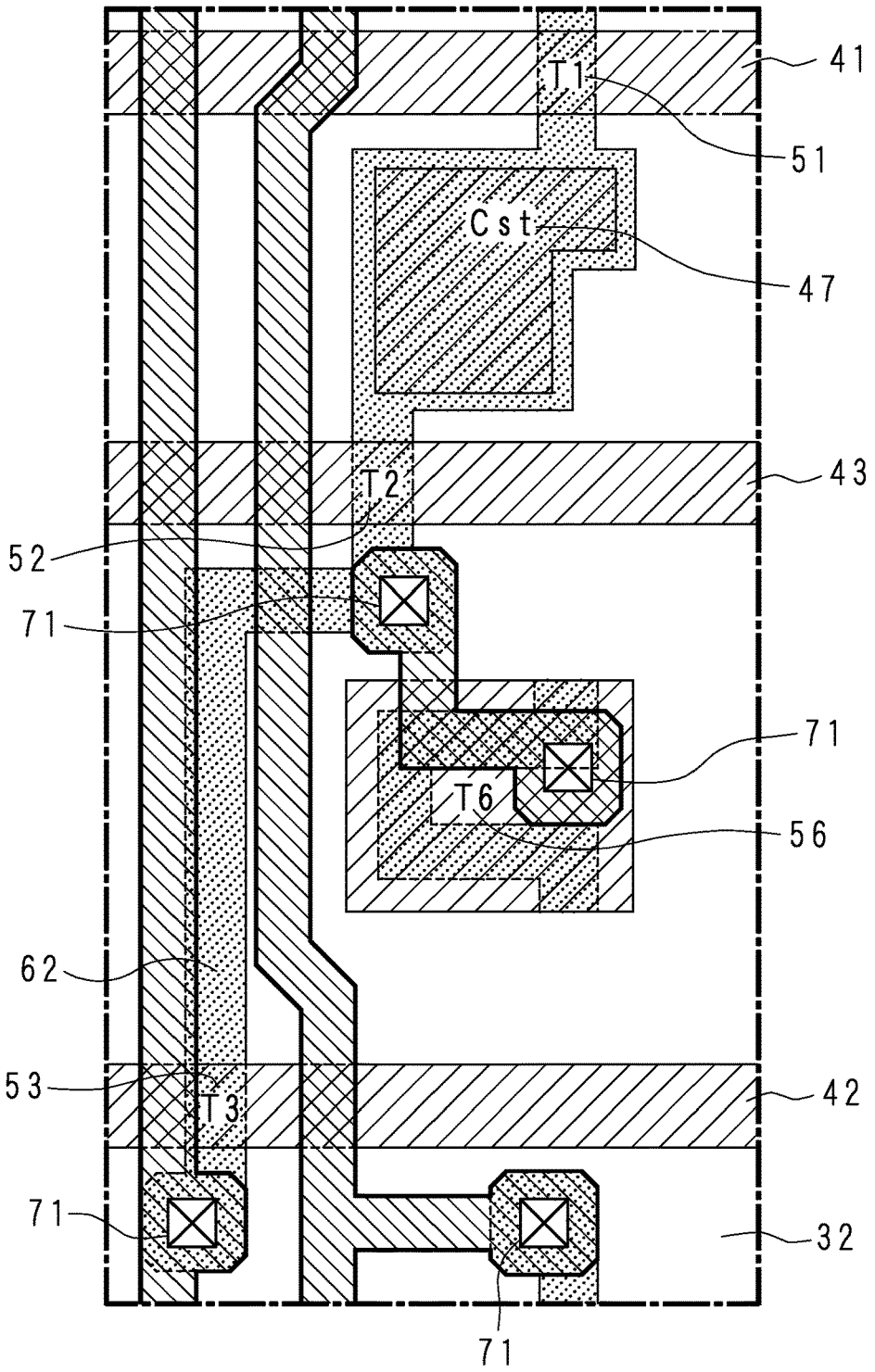
FIG. 16 is a schematic diagram that illustrates an effect of decreasing the number of contact holes.

FIG. 16 is a schematic diagram that illustrates an effect of decreasing the number of contact holes. FIG. 16 is a schematic diagram acquired by eliminating unnecessary portions for description of the effect of decreasing the number of contact holes from the schematic plan view illustrated in FIG. 5. In the following description, a subpixel 32 of a range illustrated in FIG. 16 will be described.

The subpixel 32 according to this embodiment includes four first conduction parts 71, in other words, four contact holes. Two of the first conduction parts 71 are positioned along the lower side of the subpixel 32, one thereof is positioned at a center portion, and one thereof is positioned near a drive transistor 56.

Figure 17:
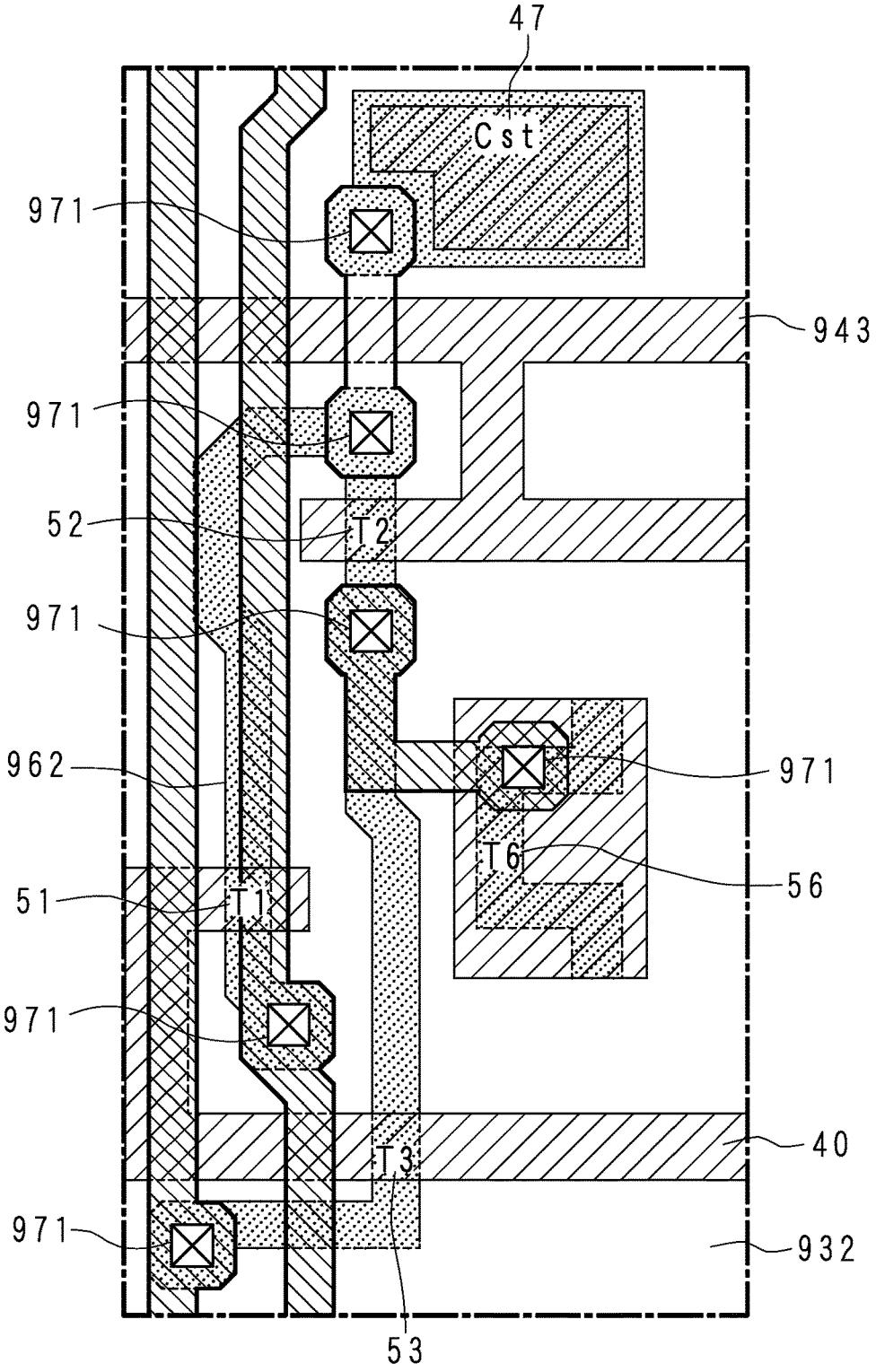
FIG. 17 is a schematic diagram that illustrates a comparative example of the effect of decreasing the number of contact holes.

FIG. 17 is a schematic diagram that illustrates a comparative example of the effect of decreasing the number of contact holes. FIG. 17 is a schematic diagram that illustrates a portion of the schematic plan view illustrated in FIG. 9 that corresponds to FIG. 16. In the following description, a subpixel 932 of a range illustrated in FIG. 17 will be described.

The subpixel 932 of the comparative example includes six first conduction parts 971, in other words, six contact holes. Among the first conduction parts 971, one is positioned at the lower left side of the subpixel 932, one is positioned at the diagonally upper right side thereof, one is positioned at the center portion, two are positioned above the one positioned at the center portion, and one is positioned near the drive transistor 56.

The case illustrated in FIG. 16 and the case illustrated in FIG. 17 will be compared with each other. The number of the contact holes according to this embodiment is smaller than that of the contact holes of the comparative example by two. The number of the contact holes according to this embodiment is ⅔ of the number of the contact holes of the comparative example.

There are cases where the contact holes cause defects such as conduction defects. According to this embodiment, by decreasing the number of the contact holes, the number of defects is decreased, and accordingly, the display device 10 having a high manufacturing yield can be provided.

[Effect of Decreasing Size of Subpixel 32]

Figure 18B:
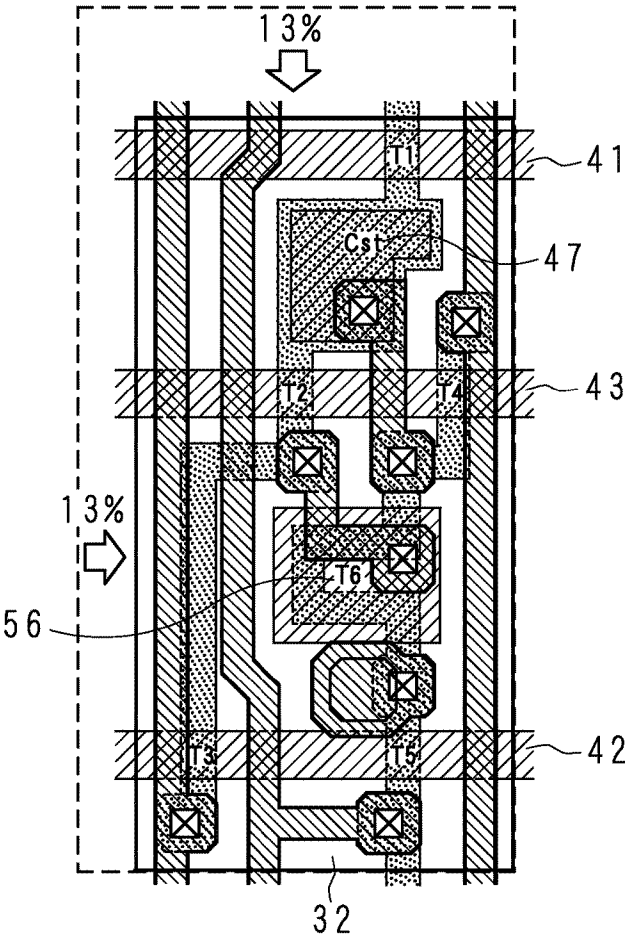
FIG. 18A and FIG. 18B are schematic diagrams that illustrate an effect of decreasing the size of a subpixel.
Figure 18A:
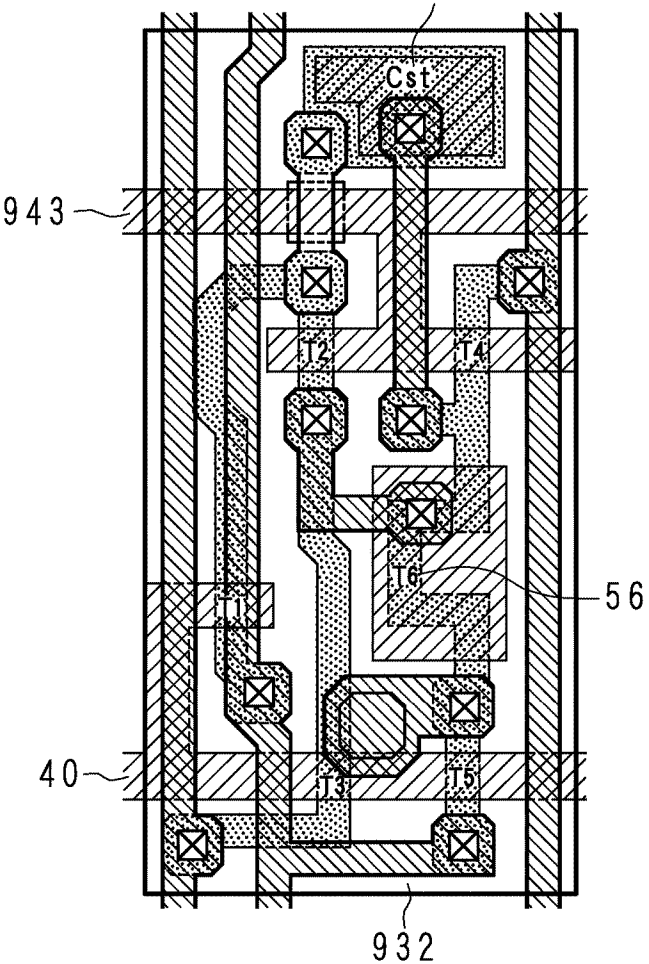

FIG. 18A and FIG. 18B are schematic diagrams that illustrate an effect of decreasing the size of the subpixel 32. FIG. 18A is a schematic plan view of the subpixel 932 of the comparative example illustrated in FIG. 9. FIG. 18B is a schematic plan view of the subpixel 32 according to this embodiment illustrated in FIG. 5.

The cases illustrated in FIG. 18A and FIG. 18B do not directly relate to a difference in the essential configuration illustrated in FIG. 18A and FIG. 18B, and the conditions thereof are uniform. More specifically, the area of the holding capacitor 47, the channel length of the drive transistor 56, the thickness and the interval of each pattern, and the aspect ratios of the subpixel 32 and the subpixel 932 of the comparative example are the same. The vertical size and the horizontal size of the subpixel 32 illustrated in FIG. 18B are shorter than those of the subpixel 932 of the comparative example illustrated in FIG. 18A by 13 percent.

According to this embodiment, the pixel circuit 33 having same function can be arranged in a small area. Accordingly, the display device 10 having small pixels 31, in other words, having high precision can be provided.

[Effect of Simplifying Scan Drive Circuit 21]

Figure 19:
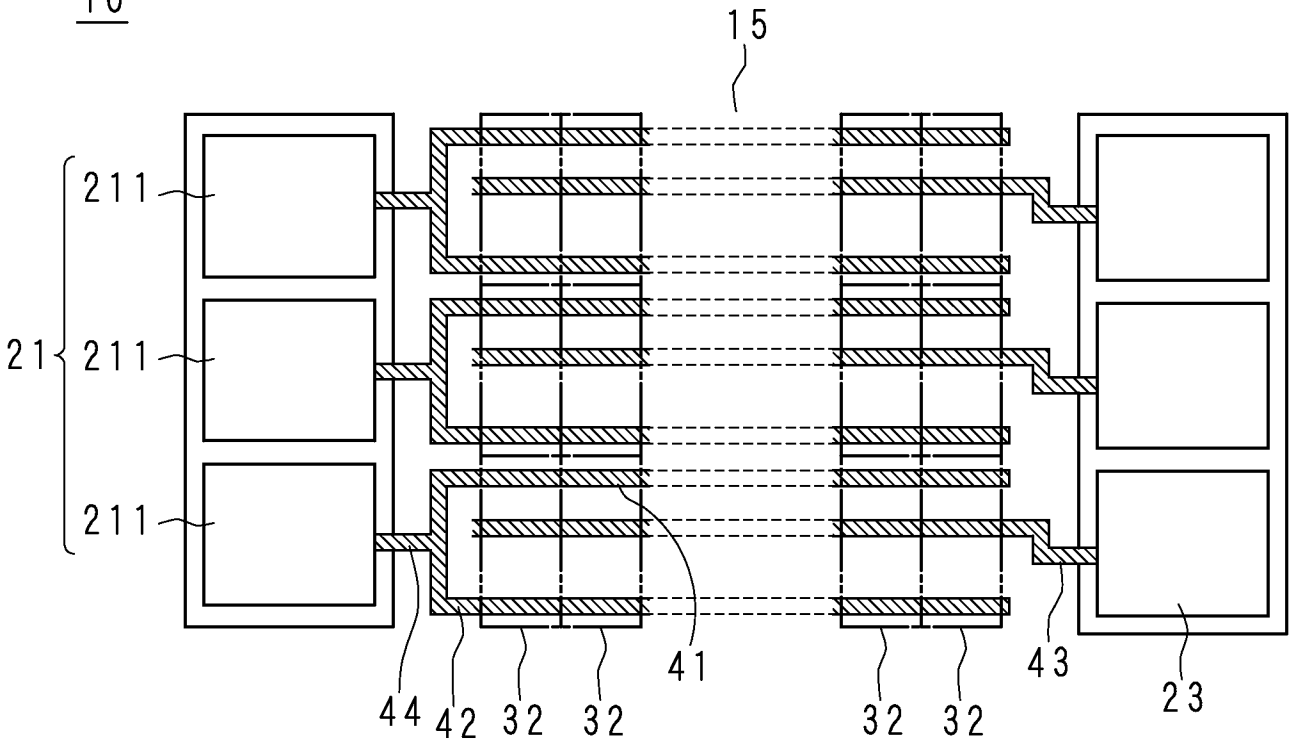
FIG. 19 is a schematic diagram that illustrates an effect of simplifying a scan drive circuit.

FIG. 19 is a schematic diagram that illustrates an effect of simplifying the scan drive circuit 21. FIG. 19 is a schematic plan view of the display device 10. FIG. 19 illustrates the display area 15 in which the subpixels 32 are arrayed, the scan drive circuit 21, the Em drive circuit 23, the branch source wiring 44, the first wiring 41, the second wiring 42, and the third wiring 43.

In FIG. 19, the horizontal direction is the first direction described above, in other words, the scan line direction. In addition, in FIG. 19, the vertical direction is the second direction described above, in other words, the scan direction. A case will be described as an example in which three pixels 31 (refer to FIG. 2) are arrayed in the second direction.

The scan drive circuit 21 includes a plurality of the unitary drive circuits 211. One unitary drive circuit 211 generates the first signal supplied to the subpixels 32 arrayed in one row. The unitary drive circuit 211 is operated under the control of the driver IC 13 (refer to FIG. 1).

The branch source wiring 44 extends from the unitary drive circuit 211 to the right side. The unitary drive circuit 211 outputs the first signal used for controlling the pixel circuit 33 to the branch source wiring 44. One branch source wiring 44 branches into two wirings including the first wiring 41 and the second wiring 42 between the scan drive circuit 21 and the first subpixel 32 (the subpixel 32 positioned at the leftmost side).

The third wiring 43 extends from the Em drive circuit 23 to the left side. The Em drive circuit 23 outputs the second signal used for controlling the pixel circuit 33 to the third wiring 43. The third wiring 43 does not intersect with the first wiring 41, the second wiring 42, and the branch source wiring 44. The third wiring 43 is positioned between the first wiring 41 and the second wiring 42 supplying the first signal to the same subpixel 32.

Figure 20:
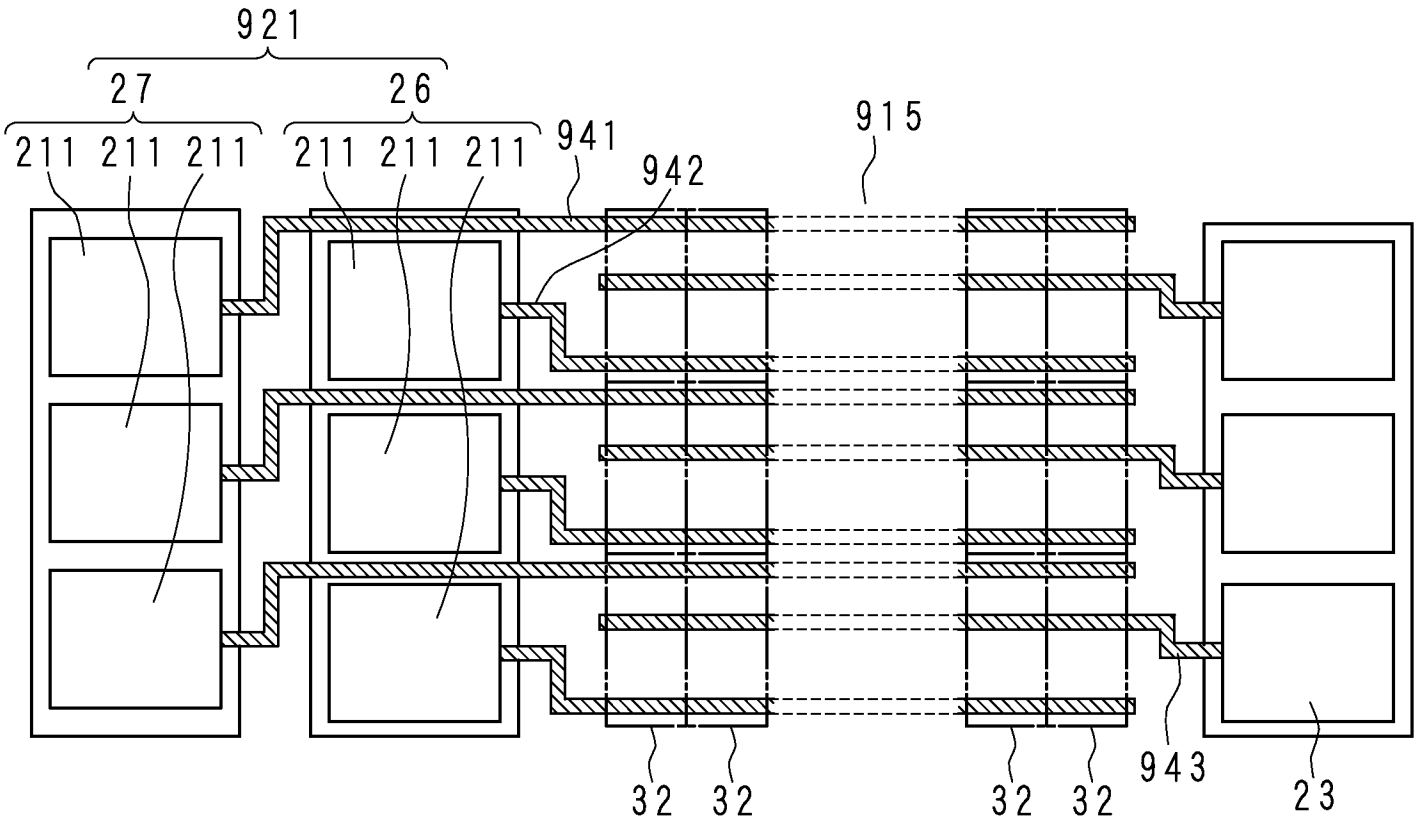
FIG. 20 is a schematic diagram that illustrates a comparative example of an effect of simplifying a scan drive circuit.

FIG. 20 is a schematic diagram that illustrates a comparative example of the effect of simplifying the scan drive circuit 21. In the comparative example illustrated in FIG. 20, the subpixel 32 and the Em drive circuit 23 that are the same as those according to this embodiment described with reference to FIG. 5 and the like are used. Thus, for the subpixel 32 and the Em drive circuit 23, the same reference numerals will be used in this embodiment and the comparative example for description.

FIG. 20 is a schematic plan view of the display device 910 of the comparative example. FIG. 20 illustrates a display area 915 in which subpixels 32 are arrayed, a scan drive circuit 921, an Em drive circuit 23, a first wiring 941, a second wiring 942, and a third wiring 943.

The scan drive circuit 921 of the comparative example includes a right-side scan drive circuit 26 and a left-side scan drive circuit 27. Each of the right-side scan drive circuit 26 and the left-side scan drive circuit 27 includes a plurality of unitary drive circuits 211. Each of the unitary drive circuits 211 disposed inside the right-side scan drive circuit 26 and the left-side scan drive circuit 27 is the same circuit as the unitary drive circuit 211 illustrated in FIG. 19.

The first wiring 941 extends from the unitary drive circuit 211 disposed inside the left-side scan drive circuit 27 to the right side by bypassing the unitary drive circuit 211 disposed inside the right-side scan drive circuit 26. One unitary drive circuit 211 generates the first signal supplied to the first wiring 941 connected to the subpixels 32 arrayed in one scan line. The unitary drive circuit 211 is operated under the control of the driver IC of the comparative example not illustrated in the drawing.

The second wiring 942 extends from the unitary drive circuit 211 disposed inside the right-side scan drive circuit 26 to the right side. One unitary drive circuit 211 generates the first signal supplied to the second wiring 942 connected to the subpixels 932 arrayed in one scan line. The unitary drive circuit 211 is operated under the control of the driver IC 13 of the comparative example not illustrated in the drawing.

FIG. 19 and FIG. 20 will be compared with each other. The display device 10 according to this embodiment includes one scan drive circuit 21 instead of the right-side scan drive circuit 26 and the left-side scan drive circuit 27. The display device 10 according to this embodiment includes the first wiring 41 and the second wiring 42 branching from the branch source wiring 44.

According to this embodiment, the scale of the scan drive circuit 21 can be configured to be a half of that of the scan drive circuit 921 of the comparative example. In addition, since both the right-side scan drive circuit 26 and the left-side scan drive circuit 27 do not need to be controlled, the load of the driver IC 13 can be decreased. In other words, the display device 10 in which the configuration of the scan drive circuit 21 is simplifier can be provided.

As described above, this embodiment realizes the effects of the prevention of luminance unevenness accompanied with intersections of wirings, the prevention of luminance unevenness according to external disturbances, the improvement of the yield according to a decrease in the number of contact holes, high precision according to a decrease in the size of the subpixel 32, the simplification of the configuration of the scan drive circuit 21, and the like.

The technical significance of this embodiment will be described.

Each of the pixel circuit 33 described with reference to FIG. 4 and the pixel circuit 933 of the comparative example described with reference to FIG. 8 includes six transistors and one holding capacitor 47. In description presented below, this pixel circuit 33 will be described as a 6T1C circuit The 6T1C circuit is a pixel circuit capable of preventing an image retention phenomenon and a leakage light emission phenomenon. The operation of the 6T1C circuit will be described later.

The image retention phenomenon is a phenomenon in which, in a case where a signal of white display is input to a pixel 31 that has performed display of black for the time being, several frames are required until the pixel 31 actually emits light with luminance of the white display. The cause of the image retention phenomenon is the hysteresis characteristic of the drive transistor 56.

The leakage light emission phenomenon is a phenomenon in which an organic light emitting element 34 that is in the middle of the non-emission period emits light in accordance with a current flowing from an adjacent subpixel 32 or the like.

In a case where the image retention phenomenon and the leakage light emission phenomenon occur, the image quality of the display device 10 is degraded. By employing the 6T1C circuit as the pixel circuit 33, the display device 10 having high image quality can be provided.

Meanwhile, in layout design, generally, one signal bus line (input line) is used for one signal. The layout of the subpixels 32 illustrated in FIG. 9 is a layout based on the design for using one input line for one signal.

In order to realize the display device 10 having high image quality by using the 6T1C circuit, the inventors of the present disclosure arrange the first wiring 41 and the second wiring 42 supplying the first signal to the pixel circuit 33 and the third wiring 43 supplying the second signal to the pixel circuit 33 inside the subpixel 32 as illustrated in FIG. 2 and FIG. 3. According to such a configuration, inside the subpixel 32, the lead-around of the first wiring 41 to the third wiring 43 can be suppressed from being complicated. According to such suppression, as described with reference to FIG. 14 and FIG. 15, the wiring including the floating node in the pixel circuit 33 can be shortened.

In addition, one of development trends of the display device 10 is implementation of high precision. In order to implement high precision in the display device 10, the sizes of the pixels 31 and the subpixels 32 need to be decreased. In order to decrease the size of the subpixel 32, it is necessary to efficiently arrange the pixel circuit 33 in a small area.

Generally, in the layout design, the area of the circuit is increased as the number of components to be arranged is increased. Accordingly, it is preferable to arrange only one wiring member transferring one signal. In a case where two wiring members transferring one signal are arranged, the size of the subpixel 32 is increased, and it tends to be difficult to realize high precision.

However, by arranging two wirings transferring one signal, the inventors of the present disclosure realize a layout in which the active layer 62 and the connection wiring are short and do not branch. For this reason, the occupied area of the active layer 62 and the connection wiring inside the subpixel 32 is decreased. In addition, the number of contact holes is decreased. For example, as described with reference to FIG. 18, the vertical and horizontal lengths of the subpixel 32 can be shortened by 13%.

In addition, the effects of decreasing the parasitic capacitance Cp, prevention of a variation in the parasitic capacitance Cp, a decrease in the coupling parasitic capacitance, and the like are acquired.

However, there are cases where circuit design is performed such that one signal output line is output from one signal output circuit. In other words, there are cases where the first wiring 41 and the second wiring 42 are connected to mutually-different scan drive circuits.

FIG. 20 is a diagram that illustrates a state in which the first wiring 41 and the second wiring 42 are connected to mutually-different scan drive circuits. As illustrated in FIG. 1, the scan drive circuit 21 according to this embodiment is arranged along the left side of the display area 15.

The scan drive circuit 921 of the comparative example illustrated in FIG. 20 includes unitary drive circuits 211 corresponding to twice the number of the scan drive circuits 21 according to this embodiment illustrated in FIG. 19. In a case where the scan drive circuit 921 of the comparative example, similar to the scan drive circuit 21 illustrated in FIG. 1, is arranged along the left side of the display area 915, the horizontal width of the scan drive circuit 21 becomes double. Accordingly, so-called a frame area disposed on the periphery of the display area 915 becomes thick.

In order to prevent such a frame area from being thick, the inventors of the present disclosure propose a configuration in which one branch source wiring 44 branches to two wirings including the first wiring 41 and the second wiring 42 between the scan drive circuit 21 and the display area 15.

Figure 21:
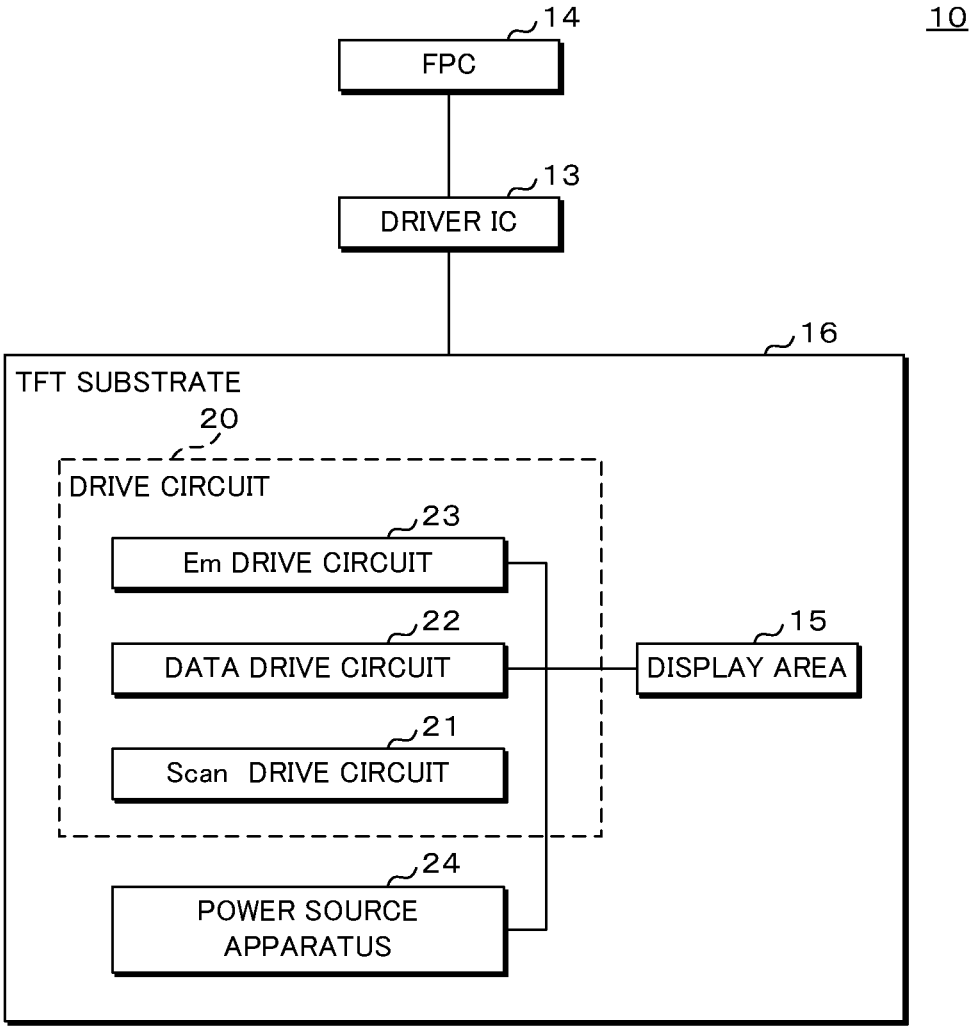
FIG. 21 is a diagram that illustrates the hardware configuration of a display device.

FIG. 21 is a diagram that illustrates the hardware configuration of the display device 10. The display device 10 includes an FPC 14, a driver IC 13, a TFT substrate 16, and a power source apparatus 24. The TFT substrate 16 includes a drive circuit 20 and a display area 15. The drive circuit 20, for example, includes a scan drive circuit 21, a data drive circuit 22, and an EM drive circuit 23.

The driver IC 13 processes an image signal acquired though the FPC 14 and outputs the processed signal to the drive circuit 20 of the TFT substrate 16. The drive circuit 20 controls the subpixels 32 arrayed in the display area 15.

Figure 22:
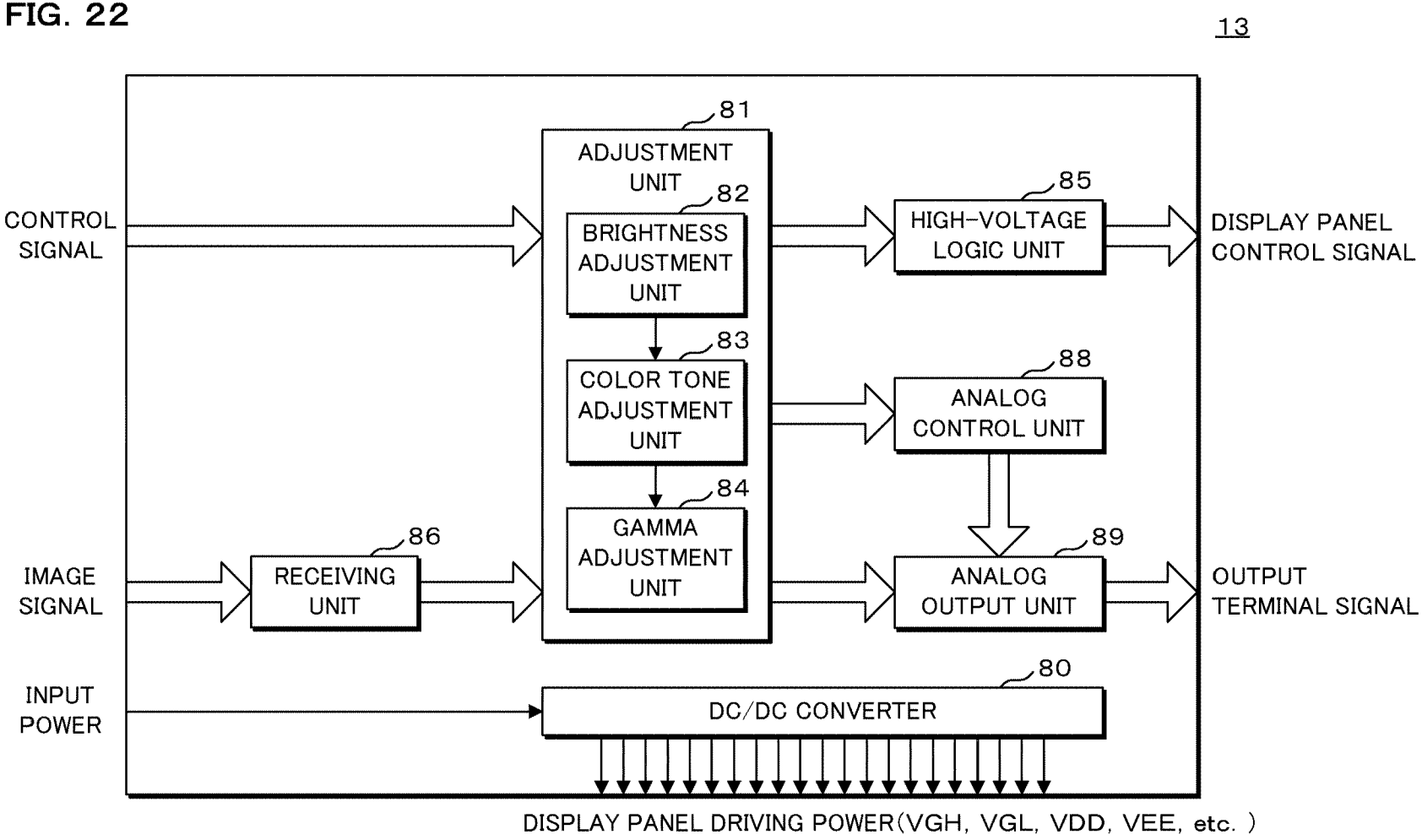
FIG. 22 is a diagram that illustrates the configuration of a driver IC.

FIG. 22 is a diagram that illustrates the configuration of the driver IC 13. The function of the driver IC 13 will be described with reference to FIG. 22. The driver IC 13 includes an adjustment unit 81, a receiving unit 86, a high-voltage logic unit 85, an analog control unit 88, an analog output unit 89, and a DC/DC converter 80.

The adjustment unit 81 is a low-voltage logic circuit that can be operated at a high speed. The adjustment unit 81 includes: a brightness adjustment unit 82, a color tone adjustment unit 83, and a gamma adjustment unit 84. The brightness adjustment unit 82, the color tone adjustment unit 83, and the gamma adjustment unit 84 are respectively realized by a brightness adjustment circuit, a color tone adjustment circuit, and a gamma adjustment circuit.

The adjustment unit 81 may be a processor mounted inside the driver IC 13. In such a case, the adjustment unit 81, for example, expands a control program read from a nonvolatile storage device, which is not illustrated, included inside the driver IC 13 in a DRAM, which is not illustrated, mounted inside the driver IC 13 or the like and executes the control program. As above, the brightness adjustment unit 82, the color tone adjustment unit 83, and the gamma adjustment unit 84 can be realized.

A control signal and an image signal are input to the driver IC 13 through the FPC 14. In addition, input power is supplied to the driver IC 13 through the FPC 14. The image signal, for example, is a signal that is compliant with the standard set by Mobile Industry Processor Interface (MIPI) alliance.

The receiving unit 86 receives an image signal and outputs the received image signal to the adjustment unit 81. The brightness adjustment unit 82, the color tone adjustment unit 83, and the gamma adjustment unit 84 sequentially process the image signal based on the control signal and adjust the image signal to be a signal matching the characteristics of the display device 10.

The high-voltage logic unit 85 generates a display panel control signal based on the image signal processed by the adjustment unit 81. The display panel control signal is a high-voltage digital signal. The high-voltage logic unit 85 outputs the display panel control signal to the scan drive circuit 21 and the Em drive circuit 23 disposed inside the drive circuit 20 through wirings disposed on the TFT substrate 16.

As described above, the scan drive circuit 21 outputs the first signal to the branch source wiring 44 (refer to FIG. 3) based on the display panel control signal. The Em drive circuit 23 outputs the second signal to the third wiring 43 (refer to FIG. 3) based on the display panel control signal.

The analog control unit 88 and the analog output unit 89 process the image signal processed by the adjustment unit 81 and output an output terminal signal. The output terminal signal is an analog signal. The analog output unit 89 outputs an output terminal signal to the data drive circuit 22. The data drive circuit 22 outputs an analog signal representing the luminance of the subpixel 32 to the data line 455 (refer to FIG. 4).

The DC/DC converter 80 generates display panel driving power based on the image signal processed by the adjustment unit 81 and the input power and supplies the generated display panel driving power to each circuit disposed at the TFT substrate 16. Each circuit is operated by the display panel driving power supplied by the DC/DC converter 80.

Based on the power supplied by the DC/DC converter 80, each power is supplied from the high-power source line 451 to the reference power source line 454 (refer to FIG. 4). Here, the input power of the driver IC 13 is supplied from the power source apparatus 24 positioned outside the TFT substrate 16 through the FPC 14.

The scan drive circuit 21, the data drive circuit 22 and the Em drive circuit 23 controls the luminance of the organic light emitting element 34 (refer to FIG. 4) of each subpixel 32 (refer to FIG. 2) through the pixel circuit 33 (refer to FIG. 4). In the display area 15 (refer to FIG. 1), an image is displayed under the control process.

Figure 23:
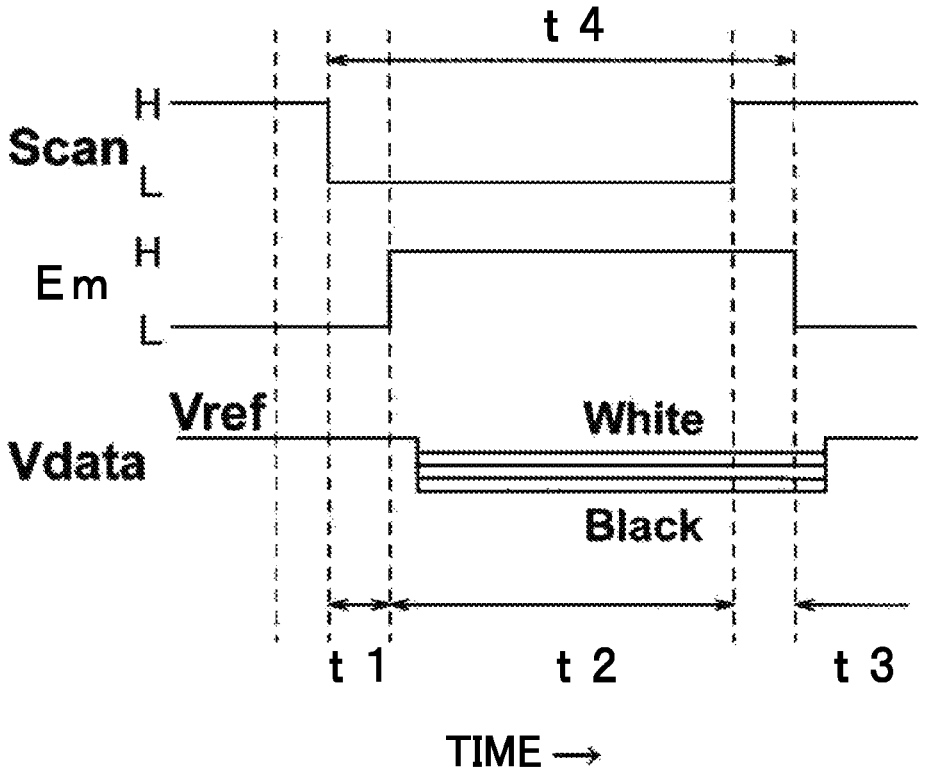
FIG. 23 is a timing diagram that illustrates control signals of a pixel circuit.
Figure 24:
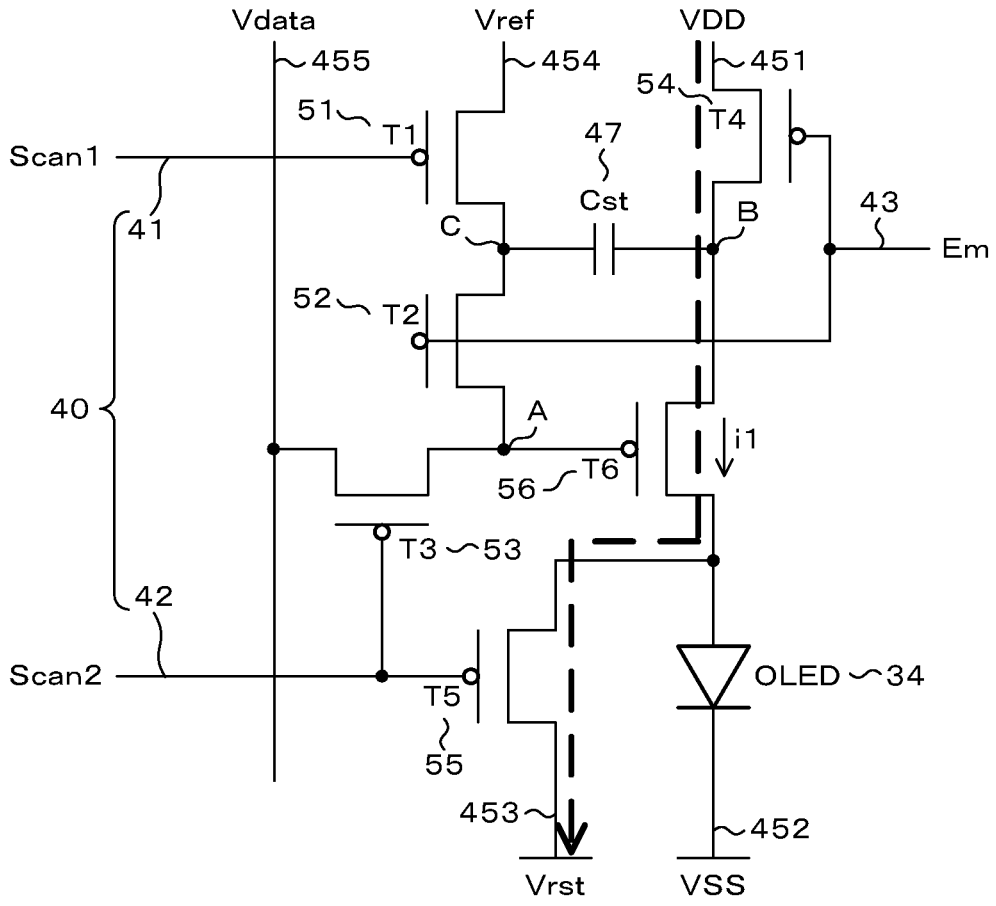
FIG. 24 is a schematic diagram that illustrates the operation of the pixel circuit.
Figure 25:
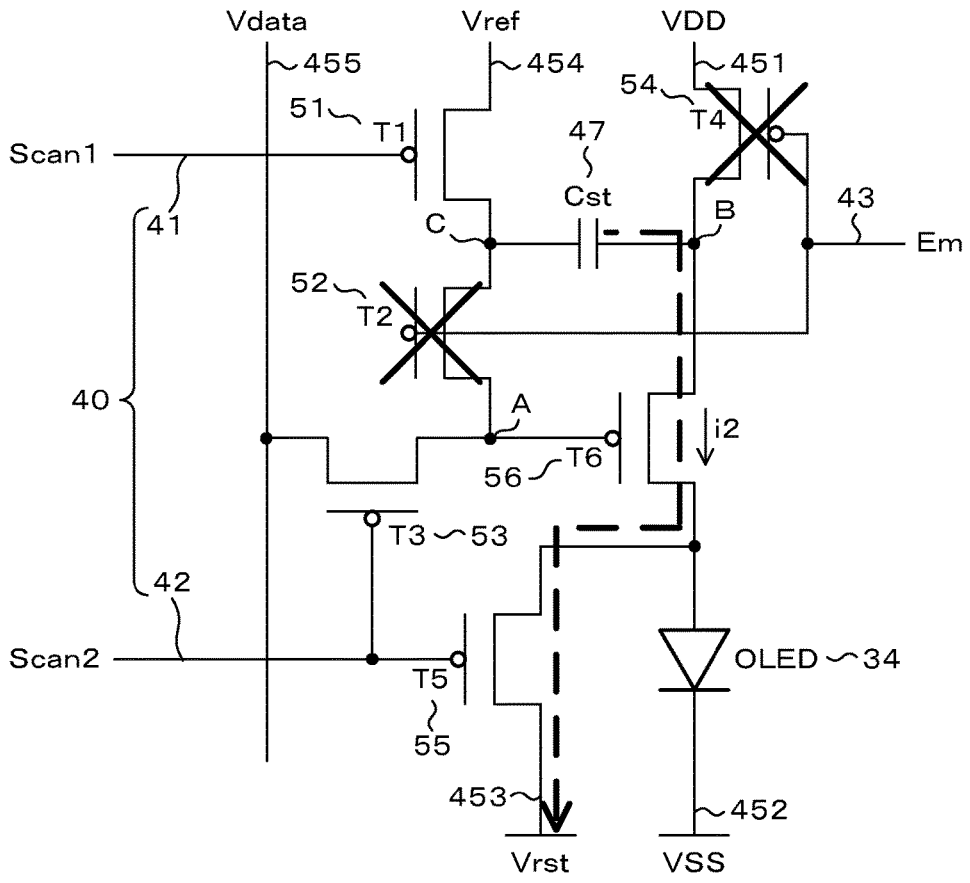
FIG. 25 is a schematic diagram that illustrates the operation of the pixel circuit.
Figure 26:
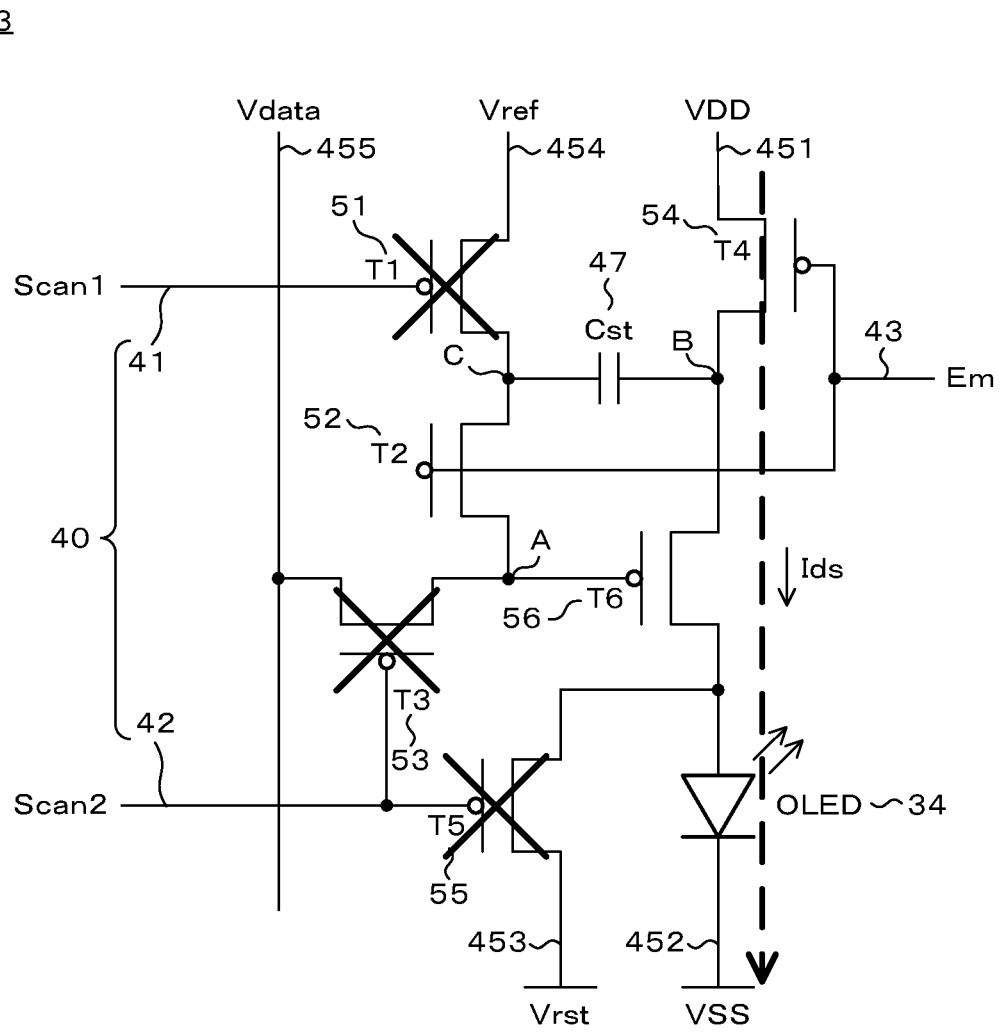
FIG. 26 is a schematic diagram that illustrates the operation of the pixel circuit.

FIG. 23 is a timing diagram that illustrates control signals of the pixel circuit 33. FIG. 24 to FIG. 26 are schematic diagrams that illustrate the operation of the pixel circuit 33. The operation of the 6T1C circuit illustrated in FIG. 4 will be described with reference to FIG. 23 to FIG. 26. In description of drawings presented below, a state in which a transistor is not conductive will be schematically illustrated using an x mark.

An overview of the timing diagram will be described with reference to FIG. 23. In FIG. 23, the horizontal axis is the time. Scan represents the state of the first signal. In a case where Scan is H, the first wiring 41 and the second wiring 42 supply high electric potential. On the other hand, in a case where Scan is L, the first wiring 41 and the second wiring 42 supply low electric potential.

Em represents the state of the second signal. In a case where EM is H, the third wiring 43 supplies high electric potential. On the other hand, in a case where Em is L, the third wiring 43 supplies low electric potential.

Vdata represents a signal input to the data line 455. Vref represents a state in which the same reference voltage Vref as that of the reference power source line 454 is input to the data line 455. Black and White represent voltages that represent luminance values with which the organic light emitting element 34 emits light. In description presented below, a voltage input from the data line 455 will be described as a data voltage Vdata.

The description will be continued with reference to FIG. 23 and FIG. 24. The time in the timing diagram will be divided into a first period t1, a second period t2, and a third period t3 for the description. The first period t1 is a period in which the pixel circuit 33 is initialized. The second period t2 is a period in which the pixel circuit 33 performs the process of detecting a threshold of the drive transistor 56 and storing (also referred to as maintaining or writing) a voltage (electric charge) corresponding to the emission luminance of the organic light emitting element 34 in the holding capacitor 47.

In addition, electric charge corresponding to the emission luminance of the organic light emitting element 34 is a voltage corresponding to an image. The third period t3 is a period in which the organic light emitting element 34 emits light. Until the start of the third period t3 from the start of the first period t1 is a non-emission period t4 in which the organic light emitting element 34 does not emit light.

Each of the first transistor 51 to the fifth transistor 55 becomes the conduction state in a case where the low electric potential is supplied to the gate and becomes the cutoff state in a case where the high electric potential is supplied to the gate.

A power source voltage that is supplied to the pixel circuit 33 by the data line 455 from the high-power source line 451 will now be described. The power source voltage is set to satisfy both of the following equations.

$$VDD>Vref$$

$$VDD>VSS\geq Vrst$$

Here, VDD is a high-power source voltage.

VSS is a low-power source voltage.

Vref is a reference voltage.

Vrst is a reset voltage.

The first period t1 will be described. Since Scan and Em are Low, the first transistor 51 to the fifth transistor 55 are in the conduction state.

Through the third transistor 53, the data line 455 and the gate of the drive transistor 56 become conductive. In the first period t1, the data voltage Vdata is equal to the reference voltage Vref. For this reason, the drive transistor 56 is also in the conduction state, and a current i1 flows between the source and the drain. The current i1 initializes the hysteresis characteristic of the drive transistor 56. By initializing the hysteresis characteristic of the drive transistor 56, the occurrence of the image retention phenomenon described above is prevented.

As illustrated using a broken line in FIG. 24, the current i1 flows to the reset power source line 453 through the fifth transistor 55. The current i1 does not flow into the organic light emitting element 34. For this reason, the leakage light emission phenomenon of the organic light emitting element 34 does not occur.

The reference voltage Vref and the high-power source voltage VDD are applied to left and right terminals of the holding capacitor 47. The holding capacitor 47 accumulates electric charge corresponding to an electric potential difference between the left and right terminals (in other words, between the first and second terminals).

As above, the pixel circuit 33 at the end of the first period t1 is in a state in which the initialization is completed.

The second period t2 will be described with reference to FIG. 23 and FIG. 25. Since Scan is low, the first transistor 51, the third transistor 53, and the fifth transistor 55 are in the conduction state. Since Em is high, the fourth transistor 54 and the second transistor 52 are in the cutoff state.

The data voltage Vdata is input to the gate of the drive transistor 56 from the data line 455 through the third transistor 53. In the second period t2, the data voltage Vdata is a voltage that represents the emission luminance of the organic light emitting element 34. The drive transistor 56 is also in the conduction state, and a current i2 flows between the source and the drain. The electric charge accumulated in the holding capacitor 47 in the first period t1 decreases as the current i2 flows. In accordance with this, an electric potential difference between the electrodes of the holding capacitor 47 is also decreased.

As illustrated using a broken line in FIG. 25, the current i2 flows to the reset power source line 453 through the fifth transistor 55. The current i2 does not flow in the organic light emitting element 34. For this reason, the leakage light emission phenomenon of the organic light emitting element 34 does not occur.

In a state in which the electric potential of the gate of the drive transistor 56 is fixed to Vdata, and the electric potential of the first terminal of the holding capacitor 47 is fixed to Vref, the current i2 is sufficiently decreased. In other words, the drive transistor 56 becomes the cutoff state. Then, an electric potential difference between the gate and the source of the drive transistor 56 is equal to the threshold voltage Vth of the drive transistor 56. Since the gate-to-source voltage Vgs and the threshold voltage Vth are equal, the electric potential of the source of the drive transistor 56, in other words, the second terminal of the holding capacitor 47 is (Vdata−Vth). For this reason, the holding capacitor 47 maintains electric charge corresponding to a voltage (data voltage Vdata−(threshold voltage Vth+reference voltage Vref)) acquired by subtracting the threshold voltage Vth and the reference voltage Vref from the data voltage Vdata.

A threshold voltage Vth variation compensation effect of the drive transistor 56 using the pixel circuit 33 will now be described. In description presented below, the gate of the drive transistor 56 will be described as a node A, the source of the drive transistor 56 will be described as a node B, and the first terminal of the holding capacitor 47 will be described as a node C.

The electric potential VA of the node A, the electric potential VB of the node B, and the electric potential VC of the node C are as in the following equations, and a voltage including the threshold voltage Vth of the drive transistor 56 and the data voltage Vdata is maintained in the holding capacitor 47. In this way, according to this embodiment, a threshold voltage detecting unit of a source follower type is used.

$$VA=Vdata$$

$$VB=VDD=>Vdata-Vth$$

$$VC=Vref$$

In the third period t3 illustrated in FIG. 26, the third transistor 53, the first transistor 51, and the fifth transistor 55 are in the Off state, and the second transistor 52 and the fourth transistor 54 are in the On state. The reference voltage Vref is supplied from the data line 455.

In this way, between the gate and the source of the drive transistor 56, an electric potential difference Vdata−Vth−Vref between both the terminals of the holding capacitor 47 is applied, and a current Ids corresponding thereto flows into the organic light emitting element 34, whereby the organic light emitting element 34 emits light.

At this time, the electric potential VB of the node B becomes the high-power source voltage VDD through the fourth transistor 54. On the other hand, the electric potential VA of the node A has a value acquired by subtracting the electric potential difference between both the terminals of the holding capacitor 47 from the high-power source voltage VDD. Accordingly, the current Ids flowing through the drive transistor 56 is given in the following equation.

$$VA=VC=VDD-(Vdata-Vth-Vref)$$

$$VB=VDD$$

$$\text{Accordingly, } Ids=(\tfrac{1}{2}\beta)((VA-VB)-Vth)^2$$

$$=(\tfrac{1}{2}\beta)((VDD-(Vdata-Vth-Vref))-VDD)-Vth)^2$$

$$=(\tfrac{1}{2}\beta)((VDD-(Vdata-Vth-Vref))-VDD)-Vth)^2$$

$$=(\tfrac{1}{2}\beta)(Vref-Vdata)^2$$

In the equations represented above, β is a constant that is determined based on the structure and the material of the drive transistor 56. In other words, for the drive transistor 56, when the capacitance of the gate insulating film is Cox, the channel width is W, and the channel length is L, β is given in the following equation.

$$\beta=Cox(W/L)$$

As can be understood from the equation represented above, since the current Ids does not include a term of the threshold voltage Vth and thus is not influenced by the fluctuation and the variation in the threshold voltage Vth. This is the threshold voltage Vth variation compensation effect of the pixel circuit 33.

As above, the pixel circuit 33 at the end of the second period t2 completes the detection of the threshold voltage Vth of the drive transistor 56 and the storage of the data voltage Vdata corresponding to the emission luminance of the organic light emitting element 34.

In a period until the third period t3 starts after the end of the second period t2, since Scan and Em are high, the first transistor 51 to the fifth transistor 55 are in the cutoff state. Inside the pixel circuit 33, a current does not flow.

The third period t3 will be described with reference to FIG. 23 to FIG. 26. Since Scan is high, the first transistor 51, the third transistor 53, and the fifth transistor 55 are in the cutoff state. Since Em is low, the fourth transistor 54 and the second transistor 52 are in the conduction state.

The electric potential of the first terminal of the holding capacitor 47, in other words, the gate of the drive transistor 56 is in the floating node state described with reference to FIG. 10. For this reason, an electric potential difference between the terminals of the holding capacitor 47 is maintained to be the electric potential difference Vc that is the electric potential difference at the end of the second period t2 without any change. Accordingly, an electric potential difference between the gate and the source of the drive transistor 56 is also maintained to be the electric potential difference Vc that is the electric potential difference at the end of the second period t2 without any change.

A drain current Ids according to the electric potential difference Vc between the gate and the source flows into the drive transistor 56. As illustrated using a broken line in FIG. 26, the current Ids flows into the low-power source line 452 through the organic light emitting element 34. The organic light emitting element 34 emits light with luminance according to the current Ids. Accordingly, the third period t3 is a period in which the organic light emitting element 34 emits light.

It is preferable that an electric potential difference between the high-power source voltage VDD and the reset voltage Vrst is larger than an electric potential difference between the high-power source voltage VDD and the low-power source voltage VSS. In other words, it is preferable that a relation among the high-power source voltage VDD, the low-power source voltage VSS, and the reset voltage Vrst satisfies the following equation.

[Numerical Expression 3]

$$|VDD-Vrst|>|VDD-VSS| \quad (3)$$

VDD is a high-power source voltage.

VSS is a low-power source voltage.

Vrst is a reset voltage.

By setting as such, in the first period t1 and the second period t2, a current flowing from the source to the drain of the drive transistor 56 can be caused to reliably flow into the reset power source line 453. Accordingly, the leakage light emission of the organic light emitting element 34 can be reliably prevented.

In addition, it is preferable that an electric potential difference between the high-power source voltage VDD and the reset voltage Vrst is larger than a value acquired by subtracting an emission threshold voltage Vf of the organic light emitting element 34 from the electric potential difference between the high-power source voltage VDD and the low-power source voltage VSS. In other words, it is preferable that a relation among the high-power source voltage VDD, the low-power source voltage VSS, the reset voltage Vrst, and the emission threshold voltage Vf satisfies the following equation.

[Numerical Expression 4]

$$|VDD-Vrst|>|VDD-VSS|-Vf \quad (4)$$

VDD is a high-power source voltage.

VSS is a low-power source voltage.

Vrst is a reset voltage.

Vf is an emission threshold voltage.

The emission threshold voltage Vf will be described. The emission threshold voltage Vf is a boundary voltage between a case where the organic light emitting element 34 emits light and a case where the organic light emitting element 34 does not emit light. In a case where the voltage of the anode electrode of the organic light emitting element 34 is equal to or more than a sum of the voltage of the cathode electrode of the organic light emitting element 34 and the emission threshold voltage Vf, the organic light emitting element 34 emits light. On the other hand, in a case where the voltage of the anode electrode of the organic light emitting element 34 is less than the sum of the voltage of the cathode electrode of the organic light emitting element 34 and the emission threshold voltage Vf, the organic light emitting element 34 does not emit light.

In addition, in a case where the reset voltage Vrst has electric potential equal to or less than the low-power source voltage VSS, a current does not flow into the organic light emitting element 34 during the non-emission period t4. Accordingly, leakage light emission can be prevented.

Furthermore, the voltage of the drain of the drive transistor 56 is equal to the reset voltage Vrst. Since the source follower operation of the underlying insulating layer 61 of the drive transistor 56 is stable, a variation in the electric potential difference Vc at the end of the second period t2 can be prevented.

FIG. 27 to FIG. 33 are schematic diagrams that illustrate the manufacturing process of a display panel. An overview of a manufacturing method of a display panel used in the display device 10 according to this embodiment will be described with reference to FIG. 27 to FIG. 33.

Here, manufacturing devices including a deposition device, a sputtering device, a spin coat device, an exposure device, a developing device, an etching device, a sealing device, a cutting device, and a conveyance device connecting such devices used for manufacturing the display panel are not illustrated in the drawings. Such devices are operated according to a predetermined program.

Figure 27:
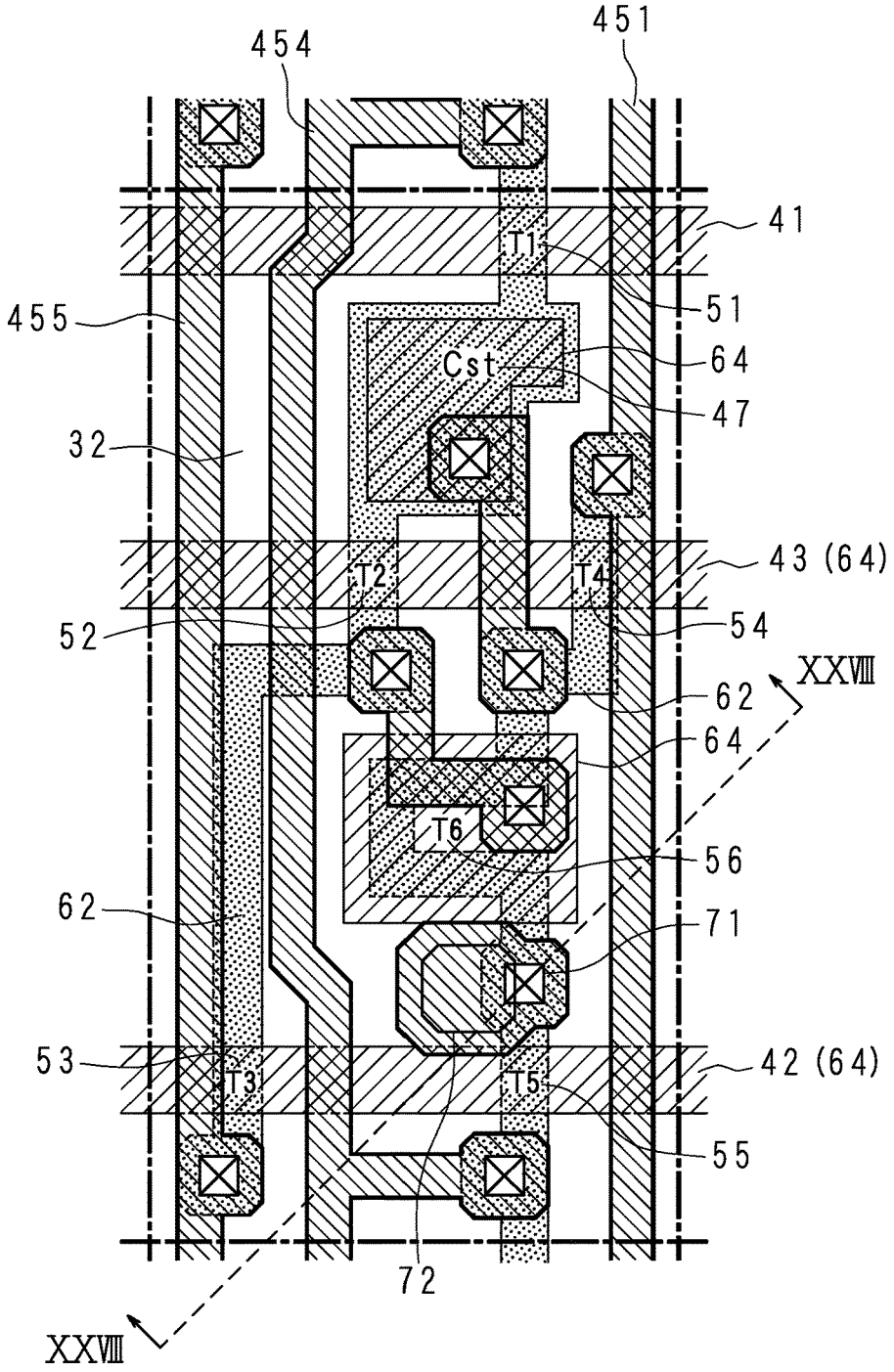
FIG. 27 is a schematic diagram that illustrates the manufacturing process of a display panel.

FIG. 27 is a schematic diagram that illustrates the position of a cross-section illustrating the manufacturing process. In description presented below, a schematic cross-sectional view cut along line XXVIII-XXVIII in FIG. 27 will be used.

Figure 28:
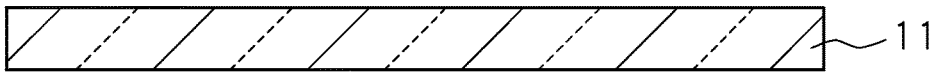
FIG. 28 is a schematic diagram that illustrates the manufacturing process of a display panel.
Figure 29:
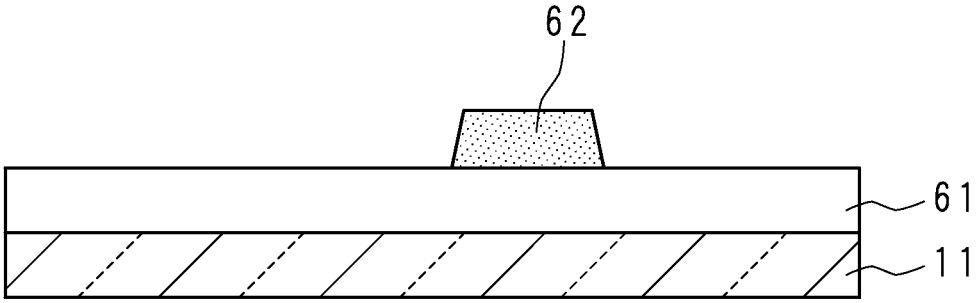
FIG. 29 is a schematic diagram that illustrates the manufacturing process of a display panel.

The description will be presented with reference to FIG. 28. FIG. 28 illustrates a first substrate 11 used for manufacturing subpixels 32. The first substrate 11 is a flat plate. The description will be continued with reference to FIG. 29. As illustrated in FIG. 29, the manufacturing apparatus forms an underlying insulating layer 61 of a uniform thickness by using a CVD method or the like. The manufacturing apparatus forms an active layer 62 of a predetermined shape by using a sputtering method, a photolithographic method, and the like.

Figure 30:
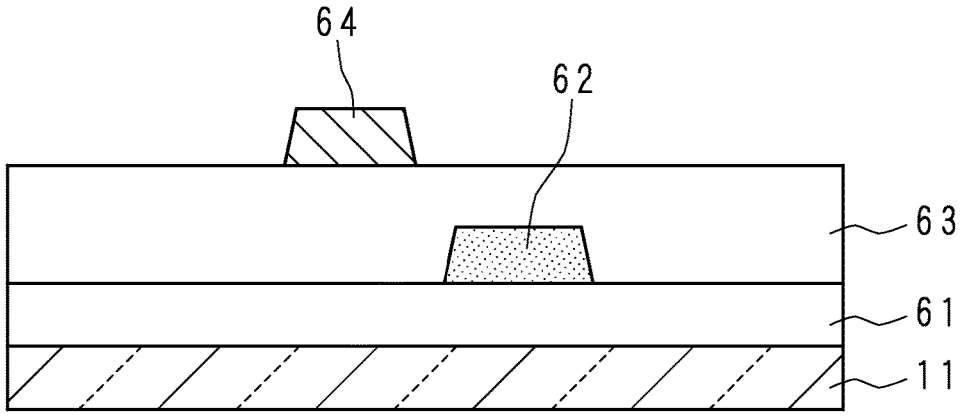
FIG. 30 is a schematic diagram that illustrates the manufacturing process of a display panel.

The description will be continued with reference to FIG. 30. As illustrated in FIG. 30, the manufacturing apparatus forms a gate insulating layer 63 covering the active layer 62 and the underlying insulating layer 61 by using a CVD method or the like. The manufacturing apparatus forms a gate 64 of a predetermined shape by using a sputtering method, a photolithographic method, and the like.

Figure 31:
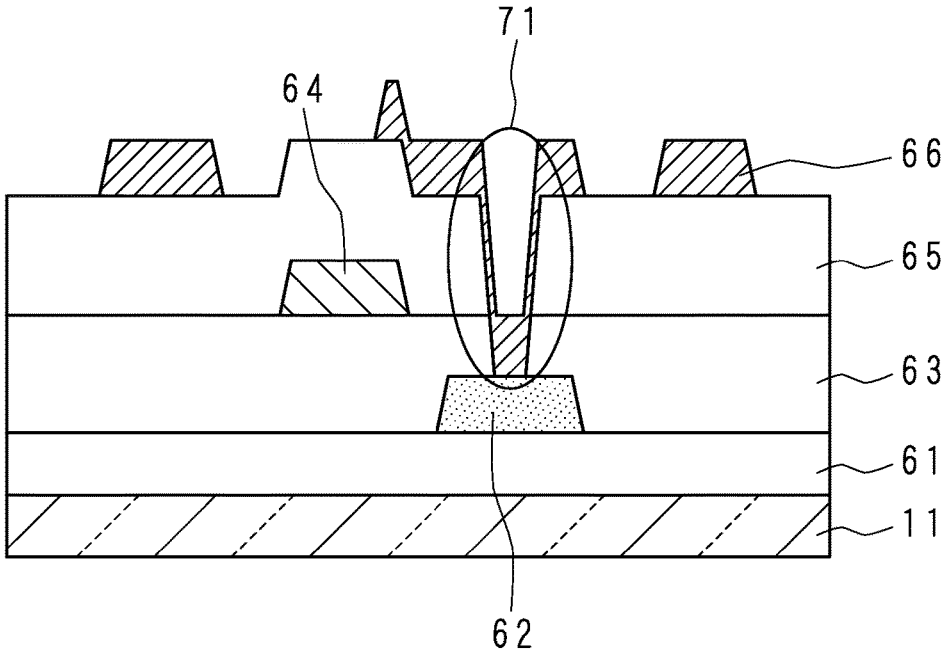
FIG. 31 is a schematic diagram that illustrates the manufacturing process of a display panel.

The description will be continued with reference to FIG. 31. As illustrated in FIG. 31, the manufacturing apparatus forms an interlayer insulating layer 65 covering the gate 64 and the gate insulating layer 63 by using a CVD method or the like. The manufacturing apparatus forms a hole formed from the front face of the interlayer insulating layer 65 up to the active layer 62 by using a dry etching method or the like.

The manufacturing apparatus forms a drain 66 of a predetermined shape by using a sputtering method, a photolithographic method, and the like. As described above, the material of the drain 66 is a conductor. The conductor that is the material of the drain 66 forms a first conduction part 71 that covers also the inner face of the hole and connects the drain 66 and the active layer 62.

Figure 32:
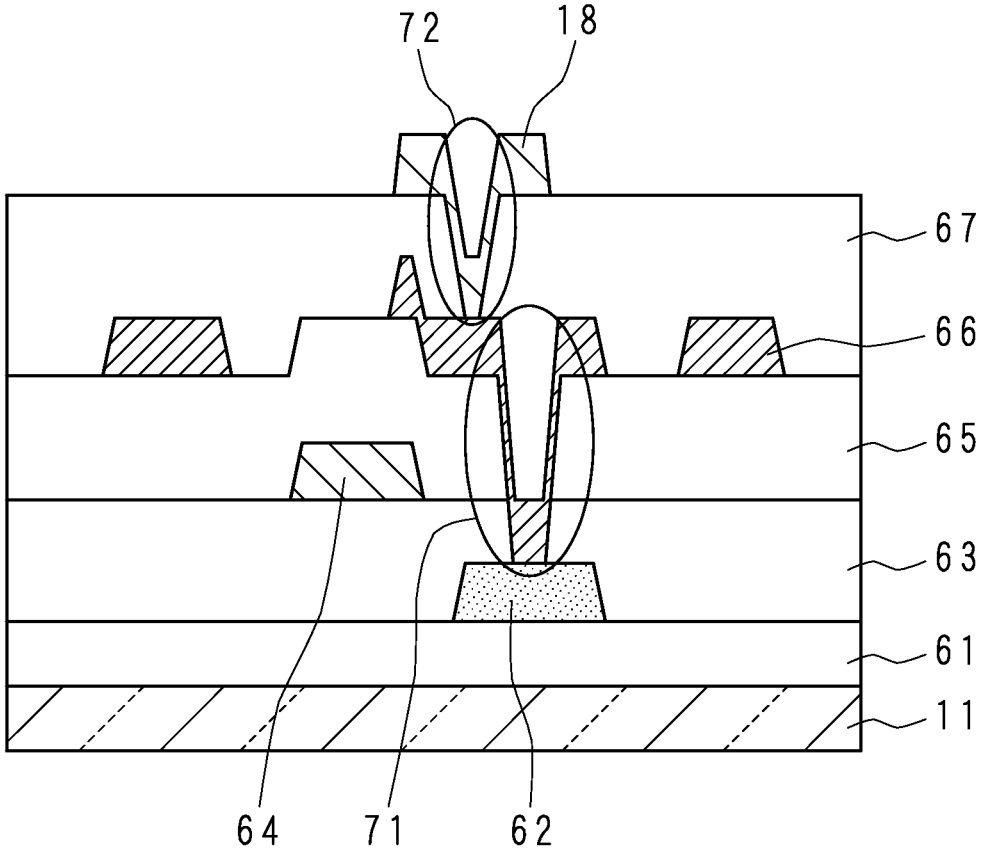
FIG. 32 is a schematic diagram that illustrates the manufacturing process of a display panel.

The description will be continued with reference to FIG. 32. As illustrated in FIG. 32, the manufacturing apparatus forms a flattening layer 67 that covers the drain 66 and the interlayer insulating layer 65 by using a spin coat method or the like. The manufacturing apparatus forms a hole formed from the front face of the flattening layer 67 up to the drain 66 by using a dry etching method or the like.

The manufacturing apparatus forms an anode electrode 18 of a predetermined shape by using a sputtering method, a photolithographic method, and the like. As described above, the material of the anode electrode 18 is a conductor. The conductor that is the material of the anode electrode 18 forms a second conduction part 72 that covers also the inner face of the hole and connects the anode electrode 18 and the drain 66.

Figure 33:
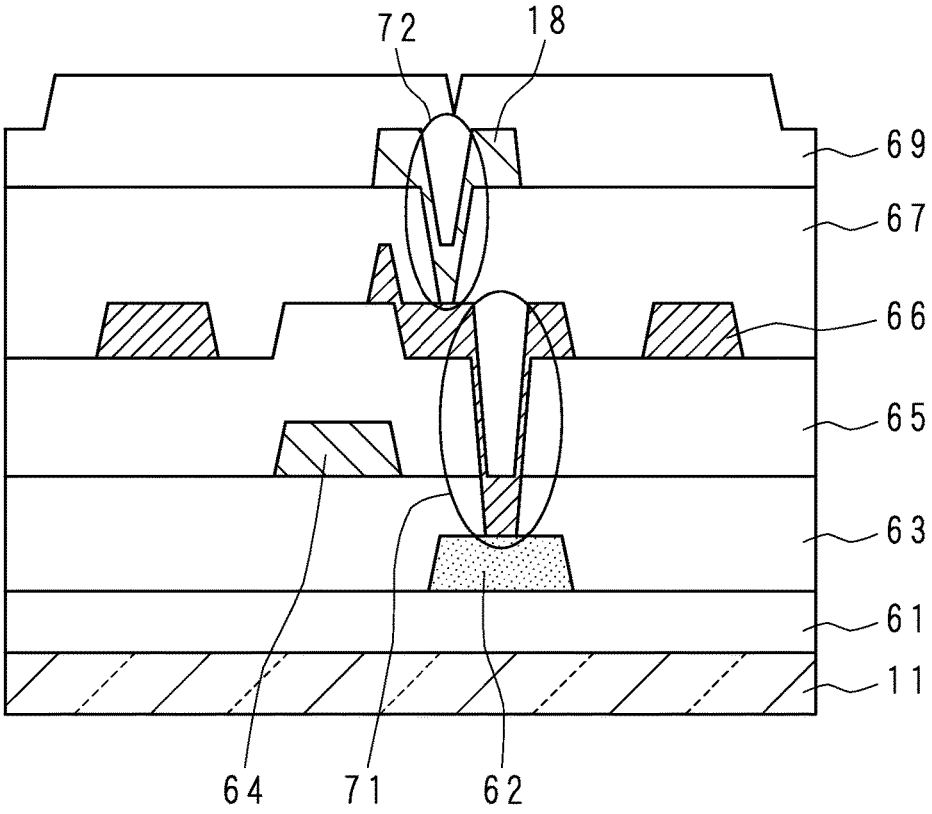
FIG. 33 is a schematic diagram that illustrates the manufacturing process of a display panel.

The description will be continued with reference to FIG. 33. As illustrated in FIG. 33, the manufacturing apparatus forms a first insulating part 69 of a predetermined shape by using a CVD method, a dry etching method, and the like. In the first insulating part 69, an opening portion 691 (refer to FIG. 6) not covering the anode electrode 18 is arranged.

The manufacturing apparatus sequentially laminates an organic light emitting layer not illustrated in the drawing, a cathode electrode 19 (refer to FIG. 1), and a second substrate 12 (refer to FIG. 1). As above, the display panel is completed.

As described above, the manufacturing apparatus forms the first wiring 41 and the second wiring 42 supplying the first signal and the third wiring 43 supplying the second signal at the first face of the first substrate 11 together with the pixel circuit 33 so as to be arranged in order of the first wiring 41, the third wiring 43, and the second wiring 42 along the first direction inside the area in which the pixel circuit 33 controlled using the first signal and the second signal is arranged. The manufacturing apparatus arranges the organic light emitting element 34 controlled by a current supplied by the pixel circuit 33 at the upper side of the pixel circuit 33, the first wiring 41, the second wiring 42, and the third wiring 43.

By using such a manufacturing method, consequently, the high-image quality display device 10 having decreased luminance unevenness can be manufactured. In addition, the display device 10 having high precision can be provided.

All the shapes of the active layer 62, the gate 64, the drain 66, and the like described in this embodiment are examples, and the drawings are schematic diagrams simplified for the description. In addition, the manufacturing process and the manufacturing apparatus used in each process are examples.

In this embodiment, the case has been illustrated as an example in which the P-type transistor is used as the pixel circuit 33. However, an N-type transistor may be used as the pixel circuit 33. In such a case, the source and the drain of the pixel circuit 33 are reversed.

[Embodiment 2]

This embodiment relates to a display device 10 sharing a high-power source line 451 and a reference power source line 454 between subpixels 32 adjacent in a first direction.

Figure 34:
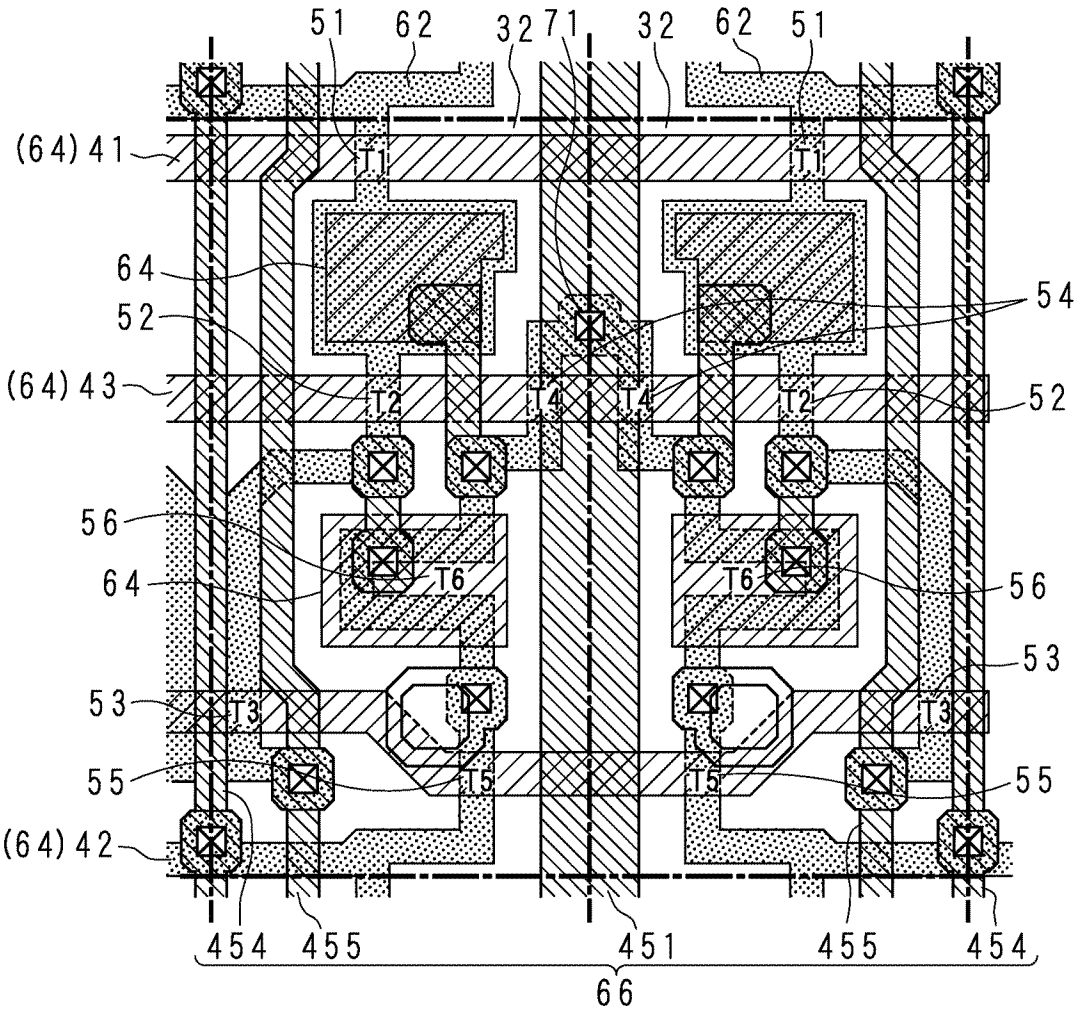
FIG. 34 is a schematic plan view of a subpixel according to Embodiment 2.

FIG. 34 is a schematic plan view of a subpixel 32 according to Embodiment 2. FIG. 34 is a diagram that illustrates two subpixels 32 and the periphery thereof viewed from the front side of the display device 10 in an enlarged scale. The display device 10 according to this embodiment will be described with reference to FIG. 34. Description of portions common to Embodiment 1 will not be presented.

A subpixel 32 illustrated at the left side in FIG. 34 will be described as an example. A drain 66 includes a high-power source line 451, a reference power source line 454, and a data line 455. Each of the high-power source line 451, the reference power source line 454, and the data line 455 has a belt shape extending in the vertical direction.

The high-power source line 451 is positioned at the right side of the subpixel 32 disposed at the left side. The reference power source line 454 is positioned at the left side of the subpixel 32 disposed at the left side. The data line 455 is positioned near the left side of the subpixel 32 disposed at the left side.

A first part of the active layer 62 extends along the lower side of the subpixel 32, is bent upward at an about ¾ position from the left side of the lower side, extends upward after a "U"-shaped portion of which the right side is open, is bent three times to the right side, the upper side, and the right side, and extends to a neighboring subpixel 32 over the right-side edge of the area of the subpixel 32. The first part extends to a subpixel 32 adjacent to the lowermost portion of the left side of the subpixel 32. In addition, the first part extends to an adjacent subpixel 32 also at the center portion of the lower side of the subpixel 32.

A second part of the active layer 62 includes a start end portion at an upper right side having inclination of a lower left angle of the subpixel 32, extends along a lower half of the left side of the subpixel 32, by way of the center portion of the subpixel 32, and further extends upward over the upper side of the subpixel 32 after an "L"-shaped area.

In other words, the active layer 62 is continuous inside two subpixels 32 adjacent in the vertical direction. In addition, the active layer 62 is continuous also inside two subpixels 32 adjacent in the horizontal direction.

The gate 64 includes a first wiring 41, a second wiring 42, a third wiring 43, an "L"-shaped area, and a rectangular area.

Each of the first wiring 41, the second wiring 42, the third wiring 43 has a belt shape extending in the horizontal direction. The first wiring 41, the second wiring 42, and the third wiring 43 extends to neighboring subpixels 32 over the boundaries of the right side and the left side of the subpixel 32. Each of the first wiring 41 and the third wiring 43 has a linear shape. The second wiring 42 has a shallow "U" shape bent toward the lower side of the subpixel 32 near the boundaries of the left and right subpixels 32.

The arrangement of transistors inside the subpixel 32 will be described using the subpixel 32 disposed at the left side in FIG. 34. A portion of the active layer 62 that overlaps the first wiring 41 forms a channel region of a first transistor 51. The active layer 62 overlaps the third wiring 43 at two portions. Out of these, a left portion of the active layer 62 forms a channel region of a second transistor 52. The active layer 62 of a right portion forms a channel region of a fourth transistor 54.

The active layer 62 overlaps the second wiring 42 at two portions. Out of these, a left portion of the active layer 62 forms a channel region of a third transistor 53. The active layer 62 of a right portion forms a channel region of a fifth transistor 55. The "U"-shaped portion of the active layer 62 forms a channel region of the drive transistor 56.

The shape of the active layers 62, the gates 64, and the drains 66 of the left and right subpixels 32 has line symmetry with respect to the long side of the subpixel 32 as its symmetrical axis. Accordingly, the subpixel 32 disposed at the left side shares the high-power source line 451 with the subpixel 32 disposed at the right side. Similarly, the subpixel 32 disposed at the left side shares the reference power source line 454 with the subpixel 32 disposed at the further left side. In addition, the subpixel 32 disposed at the right side shares the reference power source line 454 with the subpixel 32 disposed at the further right side.

The configuration of the subpixels 32 will be described with focusing on the high-power source line 451. The shape of the active layers 62, the gates 64, and the drain 66 of the left and right subpixels 32 has line symmetry with respect to the high-power source line 451 as its symmetrical axis. The configuration of the subpixels 32 will be described with focusing on the reference power source line 454. The shape of the active layers 62, the gates 64, and the drain 66 of the left and right subpixels 32 has line symmetry with respect to the reference power source line 454 as its symmetrical axis.

The high-power source line 451 is thicker than the reference power source line 454 and the data line 455.

The fourth transistor 54 of the subpixel 32 disposed at the right side and the fourth transistor 54 of the subpixel 32 disposed at the left side are connected to the high-power source line 451 through a first conduction part 71 positioned at the boundary line of the subpixels 32.

As described with reference to FIG. 2, one pixel 31 includes three subpixels 32. Two pixels 31 adjacent in the first direction include six subpixels 32. Two adjacent pixels 31 are in the same state as a state in which three sets of the two subpixels 32 illustrated in FIG. 34 are arrayed in the first direction.

As described above, the display device 10 includes a plurality of the pixels 31. The plurality of the pixels 31 is arrayed in a matrix pattern of M (here, M is an integer of two or more) rows and N (here, N is an integer of two or more) columns. The first direction is the row direction. The pixel circuits 33 of two pixels 31 adjacent in the row direction are arranged to have line symmetry with respect to the high-power source line 451 as the reference. The fourth transistors 54 included in two pixels 31 adjacent in the row direction are commonly connected to the high-power source line 451 that is the reference.

According to this embodiment, since the neighboring subpixels 32 shares the high-power source line 451, the number of high-power source lines 451 included in the display device 10 is decreased by half. For this reason, the size of the subpixel 32 can be decreased. Accordingly, the display device 10 having high precision can be provided.

According to this embodiment, since the neighboring subpixels 32 share the reference power source line 454, the number of reference power source lines 454 included in the display device 10 is decreased by half. For this reason, the size of the subpixel 32 can be decreased. Accordingly, the display device 10 having high precision can be provided.

According to this embodiment, the high-power source line 451 is thicker than the reference power source line 454 and the data line 455, the high-power source voltage VDD can be stably applied to the pixel circuit 33 and the organic light emitting element 34.

In addition, the subpixel 32 may be configured to share only one of the high-power source line 451 and the reference power source line 454 with a subpixel 32 adjacent thereto. The shape of the active layers 62, the gates 64, and the drains 66 of adjacent subpixels 32 may be any shape other than the line symmetry.

[Embodiment 3]

This embodiment relates to a display device 10 that does not share a reset power source line 453 and a reference power source line 454.

Figure 35:
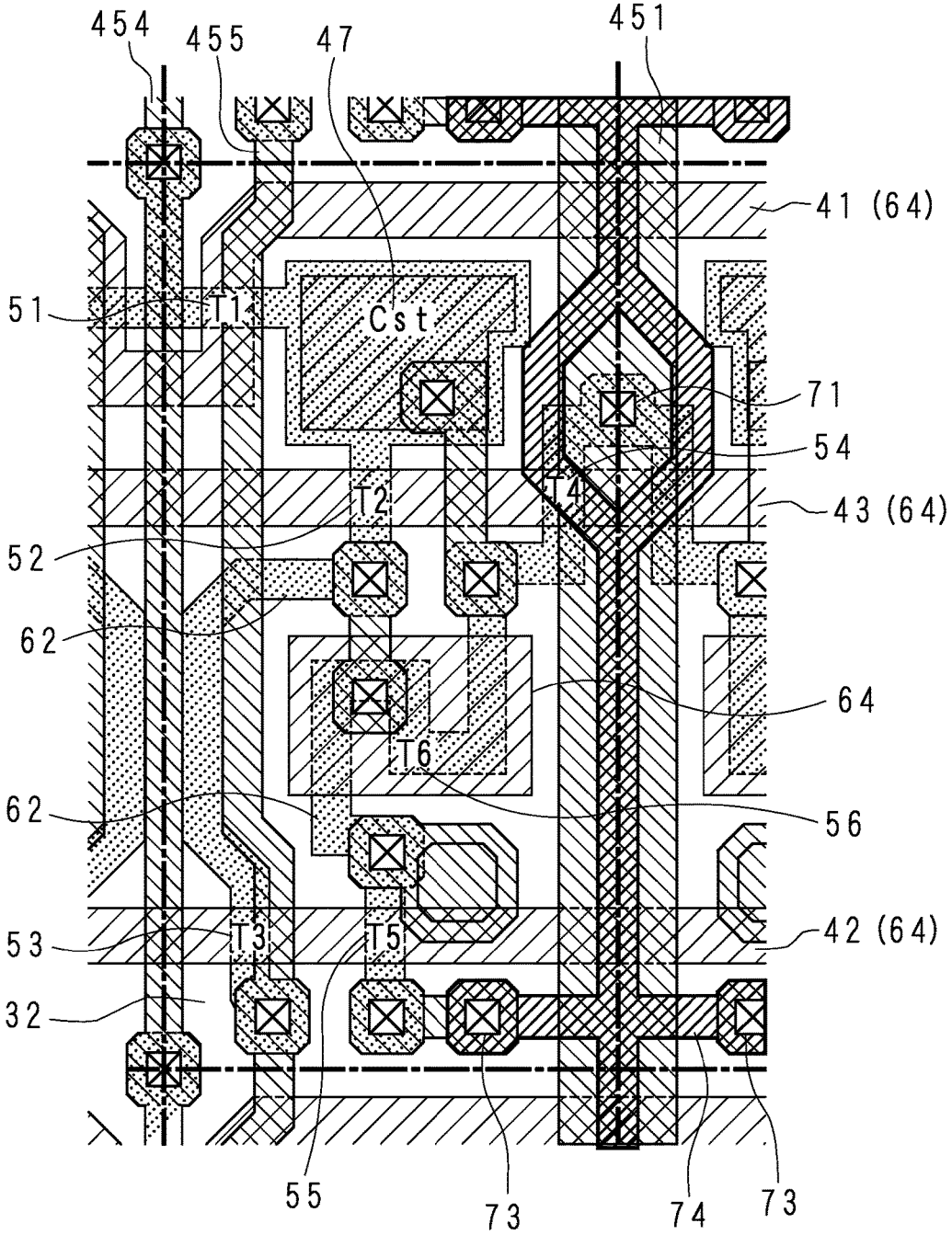
FIG. 35 is a schematic plan view of a subpixel according to Embodiment 3.
Figure 36:
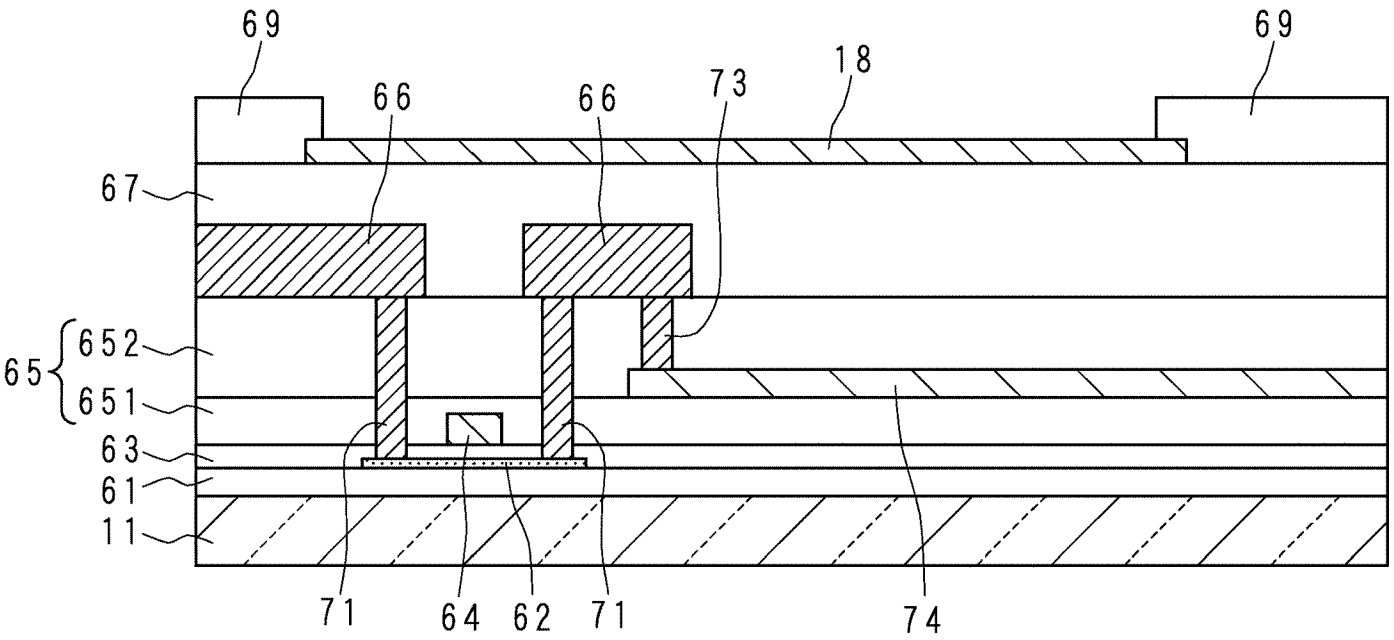
FIG. 36 is a schematic cross-sectional view of a subpixel according to Embodiment 3.

FIG. 35 is a schematic plan view of a subpixel 32 according to Embodiment 3. FIG. 36 is a schematic cross-sectional view of a subpixel 32 according to Embodiment 3. FIG. 35 is a diagram that illustrates one subpixel 32 and the periphery thereof viewed from the front side of the display device 10 in an enlarged scale. The display device 10 according to this embodiment will be described with reference to FIG. 35 and FIG. 36. Description of portions common to Embodiment 2 will not be presented.

Two subpixels 32, which are adjacent in the first direction, according to this embodiment, similar to the two subpixels 32, which are adjacent in the first direction, according to Embodiment 2, has line symmetry. The subpixel 32 illustrated in FIG. 35 corresponds to the subpixel 32 illustrated at the left side in FIG. 34.

First, major differences from Embodiment 2 will be described. As illustrated in FIG. 35, a common electrode part 74 is positioned at the right side of the subpixel 32 and extends to subpixels 32 adjacent to the upper and lower sides. The common electrode part 74 branches into two parts near a first conduction part 71 positioned at the right side of the subpixel 32. The common electrode part 74 includes a branch connecting to a third conduction part 73.

As illustrated in FIG. 35, an interlayer insulating layer 65 includes a first interlayer insulating layer 651 and a second interlayer insulating layer 652. The common electrode part 74 is positioned between the first interlayer insulating layer 651 and the second interlayer insulating layer 652.

The material of the common electrode part 74 is a conductor. The common electrode part 74 is connected to a drain 66 through a third conduction part 73. The common electrode part 74 supplies a reset voltage Vrst to a pixel circuit 33. Accordingly, an arbitrary reset voltage Vrst can be set without increasing the area of the subpixel 32.

According to this embodiment, the display device 10 in which the reset voltage Vrst is different from the reference voltage Vref can be provided.

Differences from Embodiment 2 other than the inclusion of the common insulating part 74 will be briefly described.

A first part of the active layer 62 includes a start end portion at the lower left side of the subpixel 32, is bent to the right side at a position extending along a lower half of the left side of the subpixel 32, extends to the left side after an "L"-shaped area by way of a center portion of the subpixel 32, and branches to two parts at a position intersecting with the left side of the subpixel 32. One branch extends upward along the left side of the subpixel 32 and includes a tip end portion at the boundary between the subpixel and a subpixel 32 adjacent at the upper side. The other branch extends to the inside of a subpixel 32 adjacent to the left side.

A second part of the active layer 62 extends upward from the start end portion positioned near the center portion of the lower side of the subpixel 32, extends upward after a "Z"-shaped portion falling over sideways, is bent to the right side at a position bending three times to the right side, the upper side, and the right side, and extends to a neighboring subpixel 32 over the right-side edge of the area of the subpixel 32. The second part is not continuous from the first part.

The gate 64 includes a first wiring 41, a second wiring 42, a third wiring 43, and an "L"-shaped area and a rectangular area.

Each of the first wiring 41, the second wiring 42, and the third wiring 43 has a belt shape extending in the horizontal direction. The first wiring 41, the second wiring 42, and the third wiring 43 extend to a neighboring subpixel 32 over the boundaries of the right side and the left side of the subpixel 32. Each of the second wiring 42 and the third wiring 43 has a linear shape. The first wiring 41 has a "U" shape bent to the lower side near the boundary between the subpixel and the subpixel 32 disposed at the left side.

The kinds of signals are not limited to the Em signal and the Scan signal. In other words, the signals include all the signals having mutually-different signal waveforms. In addition, the number of signal lines traversing the area in which subpixels are arrayed is not limited to three.

EXAMPLE

Figure 37:
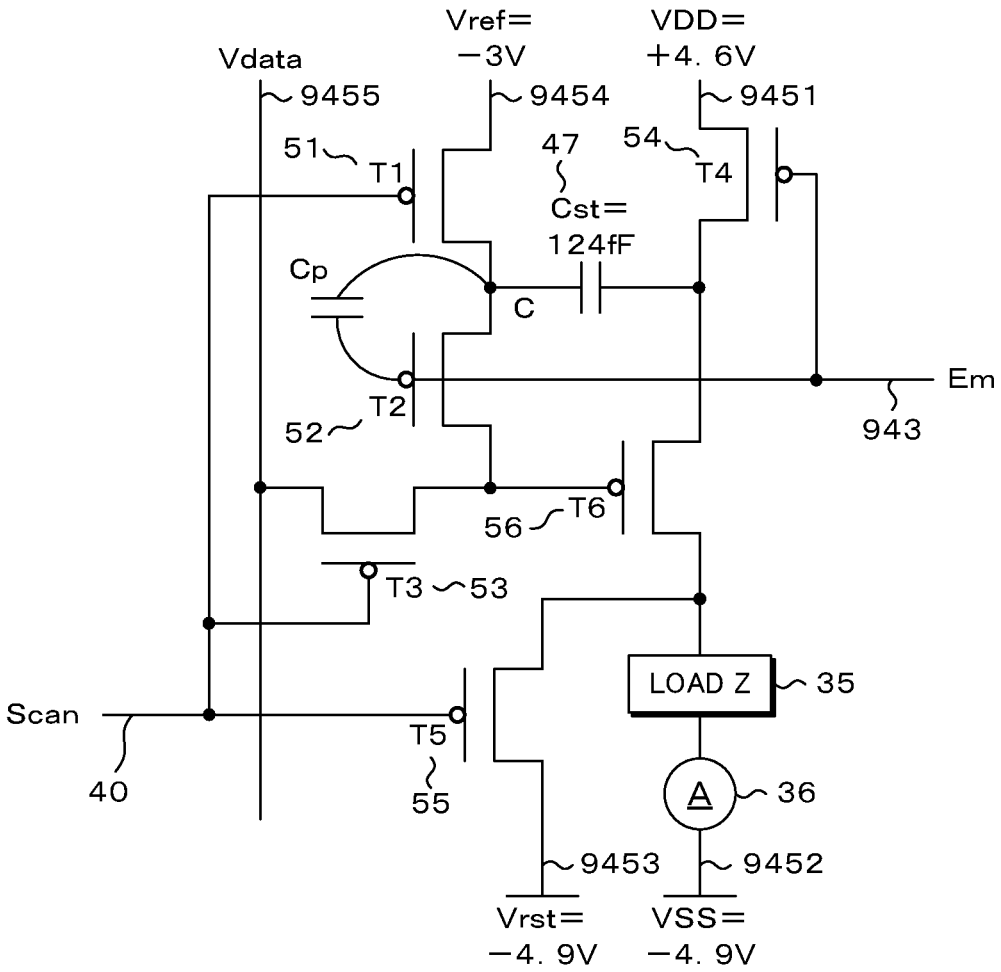
FIG. 37 is an equivalent circuit diagram of a 6T1C source follower-type (6T1C_S) pixel circuit used for verification.

A verification result of the effect of preventing the display (luminance) unevenness according to the feedthrough phenomenon using the display device of the organic light emitting type described in Embodiment 1 will be described. FIG. 37 is an equivalent circuit diagram of a 6T1C source follower-type (6T1C_S) pixel circuit used for verification. Description of portions common to the pixel circuit 933 of the comparative example of Embodiment 1 described with reference to FIG. 8 will not be presented.

[Description of Verification Circuit]

Instead of the organic light emitting element, a load Z 35 having sheet resistance of about 1 kΩ/ is used. The load Z 35 is a polysilicon film (active layer) of which resistance is decreased by injecting P-type impurities with a high density. A DC ammeter 36 is inserted between the load Z 35 and a negative power source Vss, and a current flowing through the load Z 35 is measured. As fixed voltages, high-power source Vdd=+4.6 V, Vss=−4.9 V, reset power source Vrst=−4.9 V, and reference power source Vref=−3 V.

The capacitance Cst of the holding capacitor 47 is 124 fF. Parasitic capacitance Cp is formed between the third wiring 943 and the node C that is the first terminal of the holding capacitor 47. Here, five kinds of 6T1C_S pixel circuits having mutually-different Cp/(Cp+Cst) from 0% to 2% at 0.5% step are manufactured.

The scan line 40 is connected to the gate of the first transistor 51, the gate of the third transistor 53, and the gate of the fifth transistor 55. The third wiring 943 is connected to the gate of the second transistor 52 and the gate of the fourth transistor 54.

Figure 38:
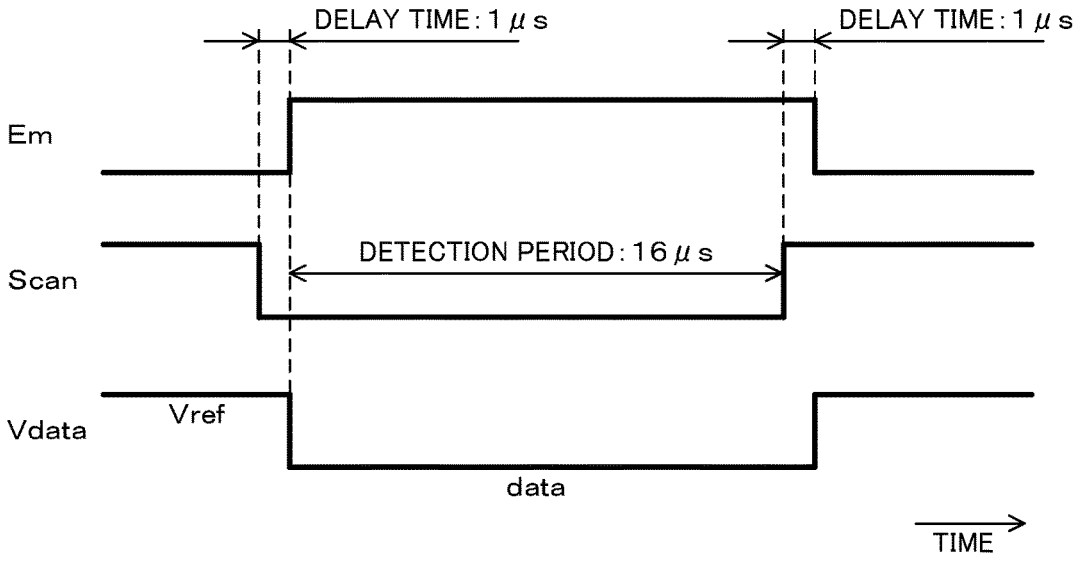
FIG. 38 is a timing diagram that illustrates control signals of a pixel circuit.

FIG. 38 is a timing diagram that illustrates control signals of the pixel circuit 33. An overview of the timing diagram will be described with reference to FIG. 38. In FIG. 38, the horizontal axis is the time. Scan represents a first signal input to the scan line 40. Em represents a signal input to the third wiring 943. Vdata represents a signal input to the data line 9455. Vref represents a state in which the same reference voltage Vref is input to the data line 9455 and the reference power source line 9454. In addition, data represents a voltage that represents luminance with which the organic light emitting element 34 emits light.

As illustrated in FIG. 38, in this example, the detection period (also referred to as a data storage period or a threshold detection period) is 16 μs, and the delay time is 1 μs. In the Scan signal and the Em signal, the low electric potential Vgl is −9 V, and the high electric potential Vgh is +6 V. The voltage of the signal Vdata input to the data line 9455 changes from Vref to data in the data storage period.

Figure 39:
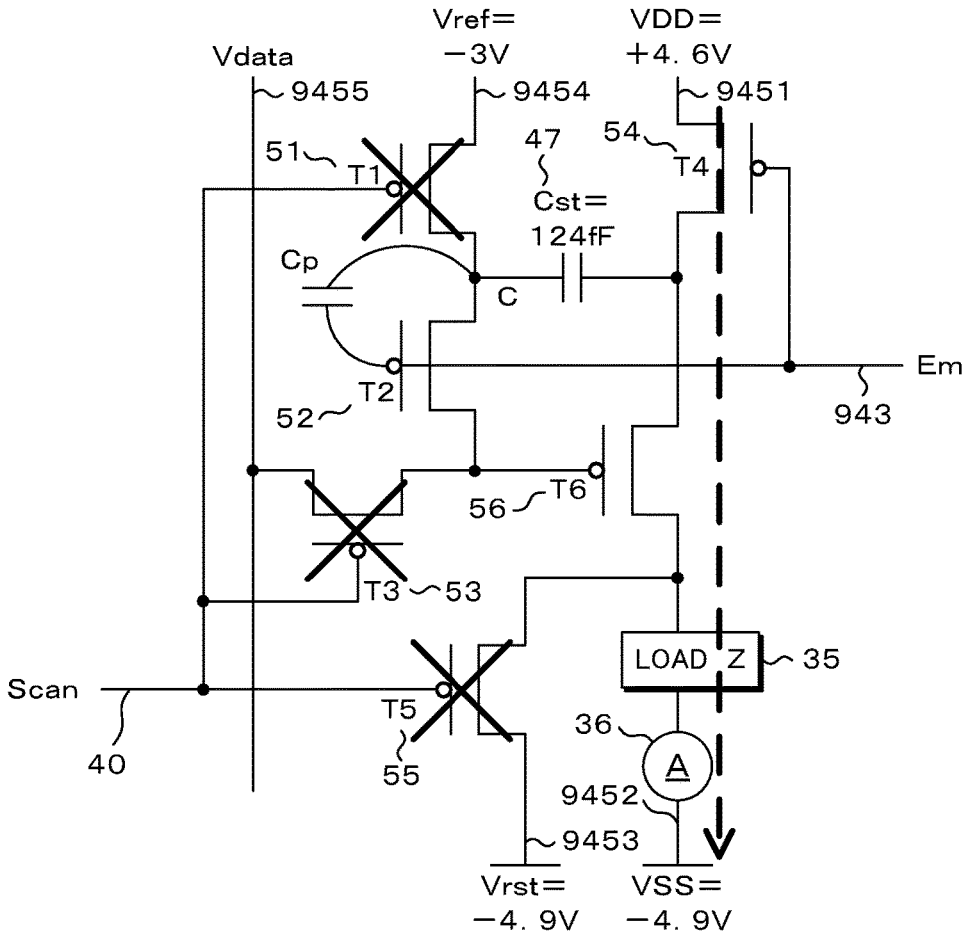
FIG. 39 is a schematic diagram that illustrates the state of a 6T1C_S pixel circuit used for verification after a signal pattern illustrated in FIG. 38 is input.

FIG. 39 is a schematic diagram that illustrates the state of the 6T1C_S pixel circuit used for verification after the signal pattern illustrated in FIG. 38 is input. The first transistor 51, the third transistor 53, and the fifth transistor 55 are in the cutoff state. The fourth transistor 54 and the second transistor 52 are in the conduction state. The data voltage Vdata changes from −5 V to +2 V. The DC ammeter 36 measures the value of a flowing current from Vdd to Vss.

[Test Result]

Figure 40:
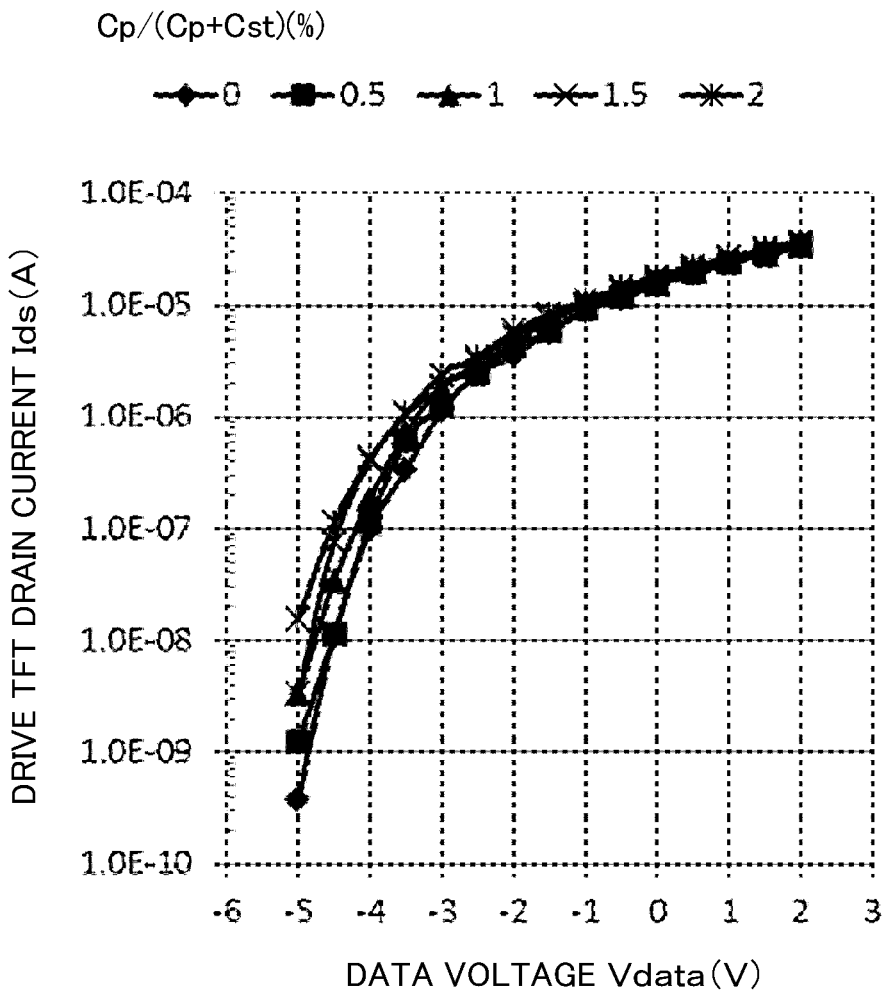
FIG. 40 is a graph that illustrates data voltage dependency of a drain current Ids of a drive transistor.

FIG. 40 is a graph that illustrates data voltage dependency of the drain current Ids of the drive transistor 56. In FIG. 40, the horizontal axis represents the data voltage Vdata input from the data line 9455, and the unit is volts. In FIG. 40, the vertical axis represents the value of the flowing current from Vdd to Vss, in other words, the drain current Ids of the drive transistor 56. In FIG. 40, the unit of the vertical axis is amperes. In FIG. 40, the vertical axis is a current value measured by the DC ammeter 36.

A plot of rhombuses represents a relation between the data voltage Vdata and the drain current Ids of a case where Cp/(Cp+Cst)=0%. A plot of rectangles represents a relation between the data voltage Vdata and the drain current Ids of a case where Cp/(Cp+Cst)=0.5%. A plot of triangles represents a relation between the data voltage Vdata and the drain current Ids of a case where Cp/(Cp+Cst)=1%. A plot of x marks represents a relation between the data voltage Vdata and the drain current Ids of a case where Cp/(Cp+Cst)=1.5%. A plot of * marks represents a relation between the data voltage Vdata and the drain current Ids of a case where Cp/(Cp+Cst)=2.0%.

In a case where Cp/(Cp+Cst)=0%, in the range of the data voltage Vdata from −5 V to +1 V, the drain current Ids of the drive transistor 56 is changed from $3\times10^{-10}$ A to $2\times10^{-5}$ A. This is a current that can cause the organic light emitting element to be changed from a dark state to a bright state. As Cp/(Cp+Cst) increases, the drain current Ids of the drive transistor 56 tends to increase.

Figure 41:
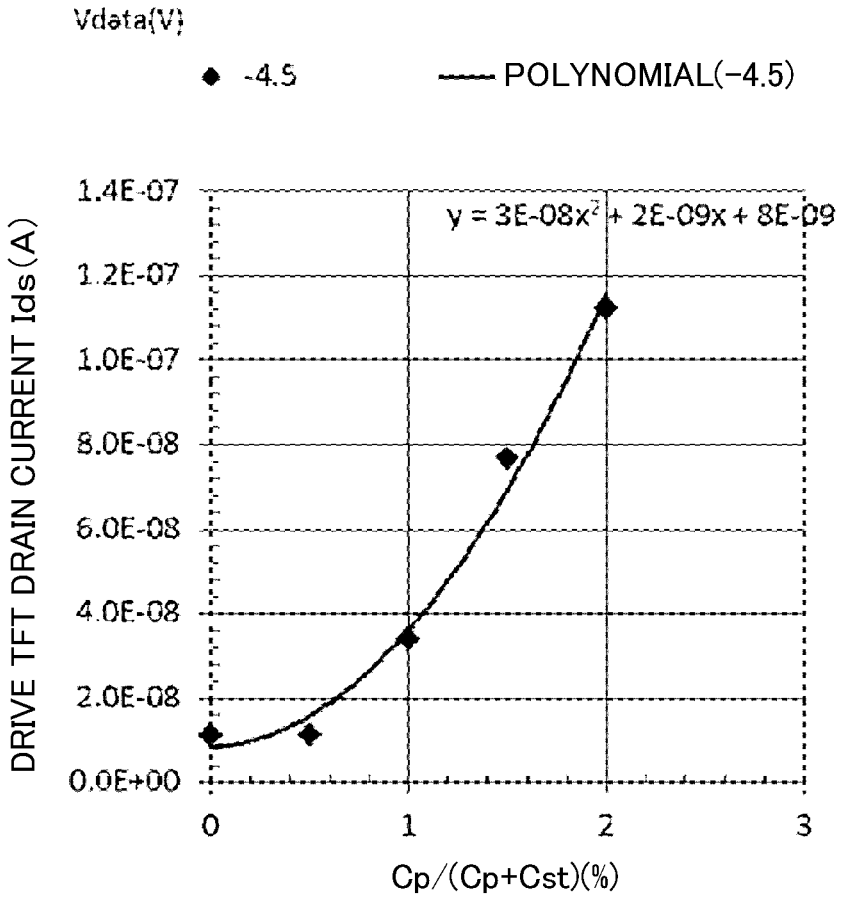
FIG. 41 is a graph that illustrates Cp/(Cp+Cst) dependency of a drain current Ids of a drive transistor.

FIG. 41 is a graph that illustrates Cp/(Cp+Cst) dependency of the drain current Ids of the drive transistor 56. In FIG. 41, the vertical axis represents Cp/(Cp+Cst), and the unit is percent. In FIG. 41, the vertical axis represents the value of the flowing current from Vdd to Vss, in other words, the drain current Ids of the drive transistor 56. In FIG. 40, the unit of the vertical axis is ampere. In FIG. 40, the vertical axis is a current value measured by the DC ammeter 36.

A plot of rhombuses represents actually-measured values of the relation between Cp/(Cp+Cst) and the drain current Ids of a case where the data voltage Vdata is −4.5 V. A solid line represents a graph of an approximation equation acquired by approximating the actually-measured values using a polynomial.

[Deriving Approximation Equation]

Hereinafter, a method of deriving the approximation equation will be described. As described above, the drain current Ids of the drive transistor 56 is represented in Equation (5).

[Numerical Expression 5]

$$Ids=\beta/2\times(Vgs-Vth)^2 \quad (5)$$

$$\beta=\mu\times CoxW/L$$

W is a channel width of the transistor.

L is a channel length.

μ is mobility.

Cox is the capacitance of the gate insulating film.

Vgs is a gate-to-source voltage.

Vth is a threshold voltage.

The gate voltage Vg of the drive transistor 56 is represented using Equation (2) described above. Here, the source voltage of the drive transistor 56 is assumed to be Vs=Vdd, and the gate-to-source voltage of the drive transistor 56 is assumed to be Vgs=Vg−Vs. By eliminating the gate voltage Vg from Equations (5) and (2), Equation (6) representing a relation between the drain current Ids of the drive transistor 56 and k can be acquired. As described above, k=Cp/(Cp+Cst).

[Numerical Expression 6]

$$Ids=\beta(Vgl-Vgh-Vdd+V\text{data}-Vth)^2k^2$$

$$+2\beta(V\text{ref}-Vdd)(Vgl-Vgh-Vdd+V\text{data}-Vth)k$$

$$+\beta(V\text{ref}-Vdd)^2 \quad (6)$$

Since Ids represented at the left side of Equation (6) is represented as a quadratic function of k, by calculating each coefficient of a polynomial of the second degree by using the least squares method, an approximation equation represented in Equation (7) can be acquired.

[Numerical Expression 7]

$$Ids=2.6\times10^{-8}k^2+1.6\times10^{-9}k+8.4\times10^{-9} \quad (7)$$

In FIG. 41, the approximation equation in which each coefficient is rounded off to one digit is represented.

[Relation Between Variation in Cp/(Cp+Cst) and Display Unevenness]

Based on the approximation equation of Equation (7), a relation between the variation in Cp/(Cp+Cst) and the display unevenness will be described. In a case where the size of a portion at which wirings of the parasitic capacitance Cp intersect with each other is 4 μm×2.5 μm, and the capacitance per unit area is 0.075 (fF/m$^2$), Cp=0.75 fF. In a case where the capacitance of the holding capacitor 47 is Cst=124 fF, k=Cp/(Cp+Cst) is calculated as 0.0060.

Based on manufacturing variations, a variation of several percent in the width of each wiring is projected inside the substrate and between substrates. This variation causes a variation in the parasitic capacitance of the portion at which the wirings intersect with each other.

Based on Equation (7), in a case where k varies ±5% from 0.0060 at the center, a variation in the drain current Ids is ±3.3%. According to the variation in the drain current, the luminance of the organic light emitting elements varies. In a case where the drain current varies by 2%, a variation in the luminance of the organic light emitting element is in an easily visible state. Accordingly, display unevenness occurs.

[Comparison with Embodiment 1]

In Embodiment 1, instead of the scan line 40, a total of two first wirings 41 and two second wirings 42 are respectively arranged at the upper end and the lower end of the subpixel 32, and the third wiring 43 is arranged therebetween. Since an intersection of wirings can be avoided, the parasitic capacitance according to the intersection of wirings Cp=0. Accordingly, even in a case where there is a variation in each wiring due to the manufacturing variation, the parasitic capacitance Cp is not changed from "0". In other words, the drain current Ids of the drive transistor 56 is not changed, and the problem of the display unevenness caused by the feedthrough accompanied with an intersection of wirings can be solved.

In addition, technical characteristics (configuration requirements) described in each embodiment may be combined with each other, and new technical characteristics may be formed by combining the same.

It is to be noted that, as used herein and in the appended claims, the singular forms "a", "an", and "the" include plural referents unless the context clearly dictates otherwise.

It is to be noted that the disclosed embodiment is illustrative and not restrictive in all aspects. The scope of the present invention is defined by the appended claims rather than by the description preceding them, and all changes that fall within metes and bounds of the claims, or equivalence of such metes and bounds thereof are therefore intended to be embraced by the claims.

What is claimed is:

1. A display device comprising:

a plurality of pixels, each of which includes an organic light emitting element and a pixel circuit that controls a current supplied to the organic light emitting element;

a first wiring and a second wiring that supply a first signal to control the pixel circuit to the pixel circuit; and a drive circuit that connects to a branch source wiring that branches into the first wiring and the second wiring, wherein the drive circuit supplies the first signal to the branch source wiring, wherein a branch part where the branch source wiring branches to the first wiring and the second wiring is outside an area in which the pixel circuit is disposed, wherein the plurality of pixels is arrayed in a matrix pattern of M (here, M is an integer of two or more) rows and N (here, N is an integer of two or more) columns, wherein the first wiring, the second wiring, and a third wiring are disposed in the area in which the pixel circuit is disposed, wherein the first wiring and the second wiring supply the first signal to the pixel circuits of a plurality of pixels arrayed in one row among the M rows, and wherein the third wiring supplies a second signal to the pixel circuits of the plurality of the pixels arranged in the one row.

2. The display device according to claim 1, wherein the pixel circuit includes a drive transistor configured to control a current supplied to the organic light emitting element and first, second, and third transistors, wherein the first, second, third transistors are connected in series in this order, wherein a connection point of the second transistor and the third transistor is connected to a gate of the drive transistor, and wherein the first, third, second wirings are connected to gates of the first, second, and third transistors respectively.

3. The display device according to claim 2, further comprising:

a first connection wiring that connects a channel region of the first transistor and a channel region of the second transistor; and a second connection wiring that connects the channel region of the second transistor and a channel region of the third transistor, wherein the first connection wiring and the second connection wiring are disposed along a second direction intersecting with a first direction.

4. The display device according to claim 3, wherein the first direction is orthogonal to the second direction.

5. The display device according to claim 3, wherein the first connection wiring and the second connection wiring include an active layer of semiconductor.

6. The display device according to claim 2, wherein the pixel circuit further includes fourth and fifth transistors and a capacitor, wherein the fourth transistor is connected between a first power source line and the drive transistor, wherein the organic light emitting element is connected between the drive transistor and a second power source line, an electric potential applied to the second power source line being less than an electric potential applied to the first power source line, wherein the fifth transistor is connected between a connection point of the drive transistor and the organic light emitting element and a third power source line, an electric potential applied to the third power source line being less than an electric potential applied to the first power source line, wherein the capacitor is connected between a connection point of the first transistor and the second transistor and a connection point of the fourth transistor and the drive transistor, wherein the first transistor is connected between a fourth power source line and the second transistor, wherein the third transistor is connected between a fifth power source line supplying a voltage applied to the gate of the drive transistor and the second transistor, wherein the second wiring is further connected to a gate of the fifth transistor, and wherein the third wiring is further connected to a gate of the fourth transistor.

7. The display device according to claim 6, wherein the capacitor is disposed in an area between the first wiring and the third wiring, and wherein the first power source line, the fourth power source line, and the fifth power source line are disposed along a second direction.

8. The display device according to claim 7, wherein the pixel circuits of two pixels adjacent in the row direction are arranged to have line symmetry with respect to the first power source line as a reference, and wherein the fourth transistors included in the two pixels are commonly connected to the first power source line.

9. The display device according to claim 1, further comprising:

wherein the drive circuit is disposed on an outer side of a display area in which the plurality of the pixels is arrayed and drives the pixel circuits of the plurality of the pixels based on the first signal and the second signal, wherein the drive circuit supplies the same first signal to the first wiring and the second wiring and supplies the second signal to the third wiring.

10. The display device according to claim 9, wherein the third wiring is disposed between the first wiring and the second wiring, and wherein the branch source wiring branches to the first wiring and the second wiring in an area disposed between the display area and the area in which the drive circuit is disposed.

11. The display device according to claim 10, further comprising M branch source wirings and M third wirings, wherein the first wiring and the second wiring branched from an i-th (here, i is an integer of 1 to M) branch source wiring supply the first signal to the pixel circuits of a plurality of pixels arrayed in an i-th row, and wherein the i-th third wiring supplies the second signal to the pixel circuits of the plurality of pixels arrayed in the i-th row.

12. The display device according to claim 1, wherein the first wiring is disposed at a side of a first side of the pixel, wherein the second wiring is disposed at a side of a second side of the pixel, the second side facing the first side, and wherein the third wiring is arranged near center between the first wiring and the second wiring.

13. The display device according to claim 1, wherein the first wiring and the second wiring are insulated from each other in the pixel circuit.

* * * * *